US009039377B2

(12) United States Patent
Lagman et al.

(10) Patent No.: US 9,039,377 B2
(45) Date of Patent: May 26, 2015

(54) FAN ASSEMBLIES AND METHODS FOR ASSEMBLING SAME

(75) Inventors: Curtis Nolan Lagman, Cornelius, NC (US); Jean Tuck McGregor, Waxhaw, NC (US); James Michael Broughman, Huntersville, NC (US); John Caleb Dawson, Troy, AL (US); Dominic Louis Sasso, Dallas, NC (US)

(73) Assignee: LOWE'S COMPANIES, INC., Mooresville, NC (US)

( * ) Notice: Subject to any disclaimer, the term of this patent is extended or adjusted under 35 U.S.C. 154(b) by 850 days.

(21) Appl. No.: 13/188,021

(22) Filed: Jul. 21, 2011

(65) Prior Publication Data

US 2012/0034085 A1 Feb. 9, 2012

Related U.S. Application Data

(60) Provisional application No. 61/372,024, filed on Aug. 9, 2010.

(51) Int. Cl.
*F04D 29/34* (2006.01)
*F04D 25/08* (2006.01)

(52) U.S. Cl.
CPC ..... *F04D 29/34* (2013.01); *Y10T 29/49327* (2015.01); *F04D 25/088* (2013.01)

(58) Field of Classification Search
CPC ..... F04D 29/34; F04D 29/36; F04D 25/08; F04D 25/088
USPC ..... 416/5, 210 R, 244 R, 207, 205
See application file for complete search history.

(56) References Cited

U.S. PATENT DOCUMENTS 225,413 A 3/1880 Opdyke
415,947 A 11/1889 Poulson (Continued)

FOREIGN PATENT DOCUMENTS

CN 101358610 A 2/2009
CN 101555882 A 10/2009

OTHER PUBLICATIONS

First Office Action and Search Report dated Feb. 13, 2015, issued by the Chinese Patent Office related to CN Patent Application No. 201110224706.2 in the name of Lowe's Companies, Inc.

*Primary Examiner* — Liam McDowell
*Assistant Examiner* — Maxime Adjagbe
(74) *Attorney, Agent, or Firm* — Moore & Van Allen PLLC; W. Kevin Ransom

(57) ABSTRACT

In general terms, embodiments of the present invention relate to fan assemblies and methods for installing the same. For example, some embodiments of the present invention include a fan assembly that includes: (a) a rotational member; (b) a connection member structured for connection to the rotational member and including a body portion and a head portion; and (c) a blade arm defining an opening therein, such that the opening includes an open end portion and a closed end portion. In some embodiments, the connection member and the blade arm are configured such that, (a) when the blade arm is positioned in a support state, the head portion of the connection member rests against the blade arm to support the blade arm relative to the rotational member, and (b) when the blade arm is positioned in a secure state, the head portion of the connection member at least partially bears against the blade arm adjacent to the opening defined in the blade arm. Also, some of these embodiments of the present invention may be characterized as "easy install" fan assemblies because they include an "easy install" blade arm to motor connection, as described above, and/or an "easy install" blade arm to fan blade connection.

29 Claims, 29 Drawing Sheets

(56) References Cited

U.S. PATENT DOCUMENTS

| | | | |
|---|---|---|---|
| 474,141 | A | 5/1892 | Morton |
| 516,524 | A | 3/1894 | Denison |
| 544,405 | A | 8/1895 | Fleece |
| 671,527 | A | 4/1901 | Phillips |
| 686,211 | A | 11/1901 | Dowson |
| 727,365 | A | 5/1903 | Holzmark |
| 741,107 | A | 10/1903 | Burnes |
| 750,904 | A | 2/1904 | Smith |
| 752,275 | A | 2/1904 | Webber |
| 873,460 | A | 12/1907 | Sakovitch |
| 888,575 | A | 5/1908 | Barth et al. |
| 925,031 | A | 6/1909 | Russel |
| 1,104,204 | A | 7/1914 | MacCormack |
| 1,150,241 | A | 8/1915 | Banzhof |
| 1,190,852 | A | 7/1916 | Bishop |
| 1,198,661 | A | 9/1916 | Recker |
| 1,324,231 | A | 12/1919 | Condon |
| 1,361,785 | A | 12/1920 | Tucker |
| 1,382,836 | A | 6/1921 | Juelson |
| 1,479,895 | A | 1/1924 | Colby |
| 1,485,552 | A | 3/1924 | Colby |
| 1,501,201 | A | 7/1924 | Cates |
| 1,567,401 | A | 12/1925 | Stuart |
| 1,583,864 | A | 5/1926 | Tucker |
| 1,614,190 | A | 1/1927 | Dyer |
| 1,685,323 | A | 9/1928 | Hansen |
| D82,179 | S | 9/1930 | Ringwald |
| 1,806,539 | A | 5/1931 | Cram |
| 1,841,959 | A | 1/1932 | Kingsbury |
| 1,856,017 | A | 4/1932 | Baker |
| 1,861,025 | A | 5/1932 | Pavlecka |
| 1,868,528 | A | 7/1932 | Gardner |
| 1,869,802 | A | 8/1932 | Dore |
| 1,898,628 | A | 2/1933 | Hollerith |
| 1,935,314 | A | 11/1933 | Finch et al. |
| 2,031,466 | A | 2/1936 | Criqui |
| 2,040,504 | A | 5/1936 | Siegel |
| 2,041,507 | A | 5/1936 | Zeder |
| 2,041,555 | A | 5/1936 | Lee |
| 2,079,942 | A | 5/1937 | Le Velle |
| 2,119,398 | A | 5/1938 | Morse |
| 2,237,039 | A | 4/1941 | Newnham |
| 2,258,932 | A | 10/1941 | Jacobs |
| 2,270,583 | A | 1/1942 | Forton |
| 2,290,607 | A | 7/1942 | De Lavaud |
| 2,318,548 | A | 5/1943 | Whitehead et al. |
| 2,336,303 | A | 12/1943 | Schubert |
| 2,581,872 | A | 1/1952 | Morrison |
| 2,610,377 | A | 9/1952 | Bedford, Jr. |
| 2,620,039 | A | 12/1952 | Allen |
| 2,670,050 | A | 2/1954 | Enos |
| 2,678,104 | A | 5/1954 | Davis |
| 2,681,708 | A | 6/1954 | Mix |
| 2,765,859 | A | 10/1956 | Hartzell et al. |
| 2,794,509 | A | 6/1957 | Mix |
| 2,908,335 | A | 10/1959 | Petty |
| 2,983,320 | A | 5/1961 | Uhrich et al. |
| 3,014,563 | A | 12/1961 | Bratton |
| 3,026,943 | A | 3/1962 | Huber |
| 3,104,093 | A | 9/1963 | Craig et al. |
| 3,147,811 | A | 9/1964 | Klonoski |
| 3,161,239 | A | 12/1964 | Andersen |
| 3,174,553 | A | 3/1965 | Spears |
| 3,315,749 | A | 4/1967 | Parsons et al. |
| 3,421,588 | A | 1/1969 | Saula |
| 3,452,820 | A | 7/1969 | Philipsen et al. |
| 3,514,820 | A | 6/1970 | Rogg |
| 3,628,888 | A | 12/1971 | Wooden |
| 3,656,865 | A | 4/1972 | Spears, Jr. |
| 3,693,220 | A | 9/1972 | Pabich et al. |
| 3,707,303 | A | 12/1972 | Petri |
| 3,711,219 | A | 1/1973 | Strick |
| 3,731,515 | A | 5/1973 | Master et al. |
| 3,733,147 | A | 5/1973 | Felker |
| 3,799,699 | A | 3/1974 | Master et al. |
| 3,825,369 | A | 7/1974 | Albertzart |
| 3,909,927 | A | 10/1975 | Steward |
| 3,986,780 | A | 10/1976 | Nivet |
| 4,019,298 | A | 4/1977 | Johnson, IV |
| 4,035,093 | A | 7/1977 | Redshaw |
| 4,050,847 | A | 9/1977 | New et al. |
| 4,139,330 | A | 2/1979 | Neal |
| 4,140,435 | A | 2/1979 | Huber |
| 4,187,056 | A | 2/1980 | Schwinn et al. |
| 4,197,054 | A | 4/1980 | Morrill |
| D256,614 | S | 8/1980 | Hoyt |
| 4,245,960 | A | 1/1981 | Matthews |
| 4,249,861 | A | 2/1981 | Charles |
| 4,319,866 | A | 3/1982 | Kolthoff |
| 4,396,352 | A | 8/1983 | Pearce |
| 4,419,794 | A | 12/1983 | Horton, Jr. et al. |
| 4,437,784 | A | 3/1984 | Peterson |
| 4,439,078 | A | 3/1984 | Dessouroux |
| 4,496,332 | A | 1/1985 | Keller et al. |
| 4,511,310 | A | 4/1985 | Pearce |
| 4,560,321 | A | 12/1985 | Kawai |
| 4,565,494 | A | 1/1986 | Dinger |
| 4,606,103 | A | 8/1986 | Koehl et al. |
| 4,606,702 | A | 8/1986 | Dinger |
| 4,621,977 | A | 11/1986 | Markwardt |
| 4,636,142 | A | 1/1987 | Baranski |
| 4,640,668 | A | 2/1987 | Yang |
| D290,039 | S | 5/1987 | Greenberg |
| 4,662,823 | A | 5/1987 | Cooke |
| 4,693,673 | A | 9/1987 | Nee |
| D292,313 | S | 10/1987 | Kawai |
| 4,715,784 | A | 12/1987 | Mosiewicz |
| 4,720,241 | A | 1/1988 | Markwardt |
| 4,746,271 | A | 5/1988 | Wright |
| 4,776,761 | A | 10/1988 | Diaz |
| 4,808,071 | A | 2/1989 | Chau |
| 4,810,145 | A | 3/1989 | Villas |
| 4,826,405 | A | 5/1989 | Robb |
| 4,834,616 | A | 5/1989 | Kasarsky et al. |
| 4,850,799 | A | 7/1989 | Bucher, Sr. et al. |
| 4,865,485 | A | 9/1989 | Finnefrock, Sr. |
| 4,884,947 | A | 12/1989 | Rezek |
| D306,643 | S | 3/1990 | Taylor, III |
| 4,917,573 | A | 4/1990 | Sikula, Jr. |
| 4,936,751 | A | 6/1990 | Marshall |
| D309,183 | S | 7/1990 | Taylor, III |
| D313,467 | S | 1/1991 | Frampton |
| 5,024,409 | A | 6/1991 | Bohnen |
| D321,935 | S | 11/1991 | Ignon |
| 5,072,341 | A | 12/1991 | Huang |
| 5,102,302 | A | 4/1992 | Schilling et al. |
| 5,108,260 | A | 4/1992 | Monrose, III et al. |
| 5,110,261 | A | 5/1992 | Junkin |
| 5,118,256 | A | 6/1992 | Violette et al. |
| 5,135,341 | A | 8/1992 | Leyder |
| 5,165,856 | A | 11/1992 | Schilling et al. |
| 5,180,284 | A | 1/1993 | Monrose, III et al. |
| D336,513 | S | 6/1993 | Junkin et al. |
| D341,419 | S | 11/1993 | Taylor, III |
| 5,304,037 | A | 4/1994 | Scofield |
| D347,056 | S | 5/1994 | Bucher et al. |
| D360,942 | S | 8/1995 | Bucher et al. |
| D361,124 | S | 8/1995 | Pearce |
| 5,458,463 | A | 10/1995 | Chiang |
| 5,458,464 | A | 10/1995 | Lee |
| 5,464,323 | A | 11/1995 | Scofield |
| 5,486,094 | A | 1/1996 | Davis, Jr. et al. |
| 5,664,936 | A | 9/1997 | Cunha et al. |
| D397,783 | S | 9/1998 | Gee, II |
| 5,873,701 | A | 2/1999 | Shiu |
| D408,521 | S | 4/1999 | Zuege |
| 5,899,663 | A | 5/1999 | Feder et al. |
| 5,927,945 | A | 7/1999 | Chen |
| 5,944,486 | A | 8/1999 | Hodgkins, Jr. |
| 5,951,197 | A | 9/1999 | Wu |
| 5,954,449 | A | 9/1999 | Wu |
| 5,980,353 | A | 11/1999 | Wu |
| 6,010,306 | A | 1/2000 | Bucher et al. |
| 6,027,310 | A | 2/2000 | Kerr, Jr. et al. |

(56) References Cited

U.S. PATENT DOCUMENTS

| | | | |
|---|---|---|---|
| 6,039,540 | A | 3/2000 | Wu |
| 6,042,339 | A | 3/2000 | Blateri et al. |
| 6,048,173 | A | 4/2000 | Chen |
| 6,059,531 | A | 5/2000 | Tai |
| 6,062,820 | A | 5/2000 | Wang |
| 6,095,753 | A | 8/2000 | Hsu |
| 6,139,276 | A | 10/2000 | Blateri et al. |
| 6,146,191 | A | 11/2000 | Kerr, Jr. et al. |
| 6,149,388 | A | 11/2000 | Liao |
| 6,155,786 | A | 12/2000 | Blateri et al. |
| 6,155,787 | A | 12/2000 | Hodgkins, Jr. |
| 6,171,059 | B1 | 1/2001 | Bucher et al. |
| 6,210,117 | B1 | 4/2001 | Bucher et al. |
| 6,241,475 | B1 | 6/2001 | Blateri et al. |
| 6,241,476 | B1 | 6/2001 | Lee |
| 6,261,064 | B1 | 7/2001 | Tang |
| 6,309,183 | B1 | 10/2001 | Bucher et al. |
| 6,336,792 | B1 | 1/2002 | Bucher et al. |
| 6,352,409 | B1 | 3/2002 | Blateri et al. |
| 6,352,411 | B1 | 3/2002 | Bucher et al. |
| 6,382,917 | B1 | 5/2002 | Zuege |
| 6,382,918 | B1 | 5/2002 | Tang |
| 6,390,777 | B1 | 5/2002 | Kerr, Jr. |
| 6,390,778 | B1 | 5/2002 | Lee |
| 6,419,451 | B1 | 7/2002 | Moody et al. |
| 6,431,834 | B1 | 8/2002 | Lackey et al. |
| 6,464,524 | B1 | 10/2002 | Kerr, Jr. et al. |
| 6,494,682 | B1 | 12/2002 | Blateri et al. |
| 6,508,629 | B2 | 1/2003 | Kerr, Jr. |
| 6,524,071 | B2 | 2/2003 | Wong |
| 6,558,124 | B2 | 5/2003 | Bucher et al. |
| 6,585,488 | B1 | 7/2003 | Bucher et al. |
| 6,595,754 | B2 | 7/2003 | Kuang |
| 6,644,925 | B1 | 11/2003 | Collmar |
| 6,648,488 | B1 | 11/2003 | Pearce |
| 6,652,234 | B2 | 11/2003 | MacCuaig |
| 6,652,236 | B2 | 11/2003 | Hai |
| 6,666,652 | B2 | 12/2003 | Bucher et al. |
| 6,669,446 | B2 | 12/2003 | Hodgkins, Jr. |
| 6,676,376 | B2 | 1/2004 | Kerr, Jr. |
| 6,688,850 | B2 | 2/2004 | Bucher et al. |
| 6,692,233 | B2 | 2/2004 | Liang |
| 6,695,585 | B2 | 2/2004 | Moody et al. |
| 6,699,014 | B1 | 3/2004 | Lam et al. |
| 6,719,531 | B2 | 4/2004 | Wu |
| 6,726,453 | B1 | 4/2004 | Hsieh |
| D489,811 | S | 5/2004 | Hsieh |
| 6,758,626 | B1 | 7/2004 | Tseng |
| 6,802,694 | B2 | 10/2004 | Bucher et al. |
| 6,821,091 | B2 | 11/2004 | Lee |
| 6,840,739 | B2 | 1/2005 | Cortez et al. |
| 6,857,854 | B2 | 2/2005 | Pearce |
| 6,863,498 | B2 | 3/2005 | Liang |
| 6,863,499 | B2 | 3/2005 | Pearce |
| 6,872,053 | B2 | 3/2005 | Bucher et al. |
| 6,884,035 | B2 | 4/2005 | Young |
| 6,902,374 | B2 | 6/2005 | Pearce |
| 6,902,375 | B2 | 6/2005 | Bird et al. |
| 6,916,156 | B2 | 7/2005 | Tseng |
| 6,932,576 | B2 | 8/2005 | Bird |
| 6,935,842 | B2 | 8/2005 | Tai |
| 7,008,192 | B2 | 3/2006 | Hidalgo |
| 7,037,080 | B2 | 5/2006 | Bucher et al. |
| 7,134,844 | B2 | 11/2006 | Robin |
| RE39,448 | E | 12/2006 | Wu |
| 7,163,377 | B2 | 1/2007 | Blateri et al. |
| 7,223,078 | B1 | 5/2007 | Mares et al. |
| 7,249,744 | B2 | 7/2007 | Bacon et al. |
| 7,281,899 | B1 | 10/2007 | Bucher et al. |
| 7,351,037 | B1 | 4/2008 | Mares et al. |
| 7,396,210 | B2 | 7/2008 | Bucher et al. |
| 7,402,025 | B2 | 7/2008 | Wang |
| 7,527,478 | B2 | 5/2009 | Pearce |
| 7,665,970 | B2 | 2/2010 | Pearce |
| 7,762,782 | B2 | 7/2010 | Wang |
| 7,766,622 | B1 | 8/2010 | Bucher et al. |
| 7,771,172 | B2 | 8/2010 | Wang |
| 7,775,771 | B2 | 8/2010 | Wang |
| 7,780,418 | B2 | 8/2010 | Wang |
| 2001/0046442 | A1 | 11/2001 | Bucher et al. |
| 2002/0054816 | A1 | 5/2002 | Bucher et al. |
| 2002/0127107 | A1 | 9/2002 | Hodgkins, Jr. |
| 2002/0172598 | A1 | 11/2002 | Bucher et al. |
| 2002/0182076 | A1 | 12/2002 | Bucher et al. |
| 2003/0228224 | A1 | 12/2003 | Lee |
| 2004/0013527 | A1 | 1/2004 | Pearce |
| 2004/0197193 | A1 | 10/2004 | Bird |
| 2004/0208747 | A1 | 10/2004 | Pearce |
| 2004/0219023 | A1 | 11/2004 | Bird et al. |
| 2005/0095135 | A1 | 5/2005 | Bucher et al. |
| 2006/0024165 | A1 | 2/2006 | Gajewski |
| 2006/0140770 | A1 | 6/2006 | Liu |
| 2007/0269314 | A1 | 11/2007 | Pearce |
| 2008/0175710 | A1 | 7/2008 | Pearce |
| 2008/0175713 | A1 | 7/2008 | Pearce |
| 2008/0175715 | A1 | 7/2008 | Pearce |
| 2009/0004014 | A1* | 1/2009 | Wang ..... 416/210 R |
| 2009/0035143 | A1* | 2/2009 | Wang ..... 416/210 R |
| 2009/0246028 | A1 | 10/2009 | Richardson |
| 2010/0104442 | A1 | 4/2010 | Haynes |

* cited by examiner 100B
114
112
120
103D
103A
110
118
118A
103B
103
103C
120
122
124

132D
137B
136
132B
130B
132A
137
137B
132
139
138
136
132C 132C
136
132A
132F
132B
132G
130B 100B
114
112
118
136
124
132
110
118A
130B
122
103
137B
120
136
132A
103C
118
114
137B 100B
112
130B
118
103D
118A
110
103A
103
132
132B
114
124
120
136
137B
132G
112
114

FAN ASSEMBLIES AND METHODS FOR ASSEMBLING SAME

CROSS-REFERENCE TO RELATED APPLICATIONS

The present application claims priority to U.S. Provisional Patent Application No. 61/372,024, which was filed on Aug. 9, 2010, is entitled "Fan Assemblies and Methods for Assembling Same," and is incorporated by reference herein in its entirety.

FIELD

In general terms, embodiments of the present invention relate to fan assemblies and methods for assembling same.

BACKGROUND

The process of installing a conventional ceiling fan assembly can often be complicated, time-consuming, costly, and/or frustrating. As an example, due to balancing reasons, most ceiling fan assembly manufacturers recommend that a ceiling fan motor be suspended from a ceiling surface before the blade arms and fan blades of the ceiling fan assembly are attached to the motor. In addition, most conventional blade arms are connected to a ceiling fan motor by threading a plurality of fasteners through corresponding apertures in the blade arm. Thus, in order to install such conventional ceiling fan assemblies, an installer must stand on a stool or ladder and perform an overhead installation, all while simultaneously supporting a blade arm, a plurality of fasteners, and a screwdriver or other installation tool. Accordingly, there is a need to provide fan assemblies, and methods for installing the same, that mitigate or eliminate some of the complications, delays, costs, and frustrations typically associated with installing conventional fan assemblies.

SUMMARY OF SELECTED EMBODIMENTS OF THE PRESENT INVENTION

In general terms, embodiments of the present invention relate to fan assemblies and methods for assembling the same. For example, some embodiments provide a fan assembly that includes: (a) a rotational member, (b) a connection member structured for connection to the rotational member, where the connection member includes a body portion and a head portion, and (c) a blade arm having at least one opening defined therein. In some embodiments of the fan assembly, the opening includes an open end portion and a closed end portion. Additionally or alternatively, in some embodiments, the connection member and the blade arm are configured such that when the blade arm is connected to the rotational member, the head portion of the connection member at least partially bears against the blade arm adjacent to the opening defined in the blade arm.

In some embodiments of the fan assembly, the connection member is configured to have at least a first position and a second position. In some embodiments, when in the first position, the head portion of the connection member is spaced apart from the rotational member at a distance greater than a dimension of the blade arm, such that, when the blade arm is positioned relative to the rotational member, the head portion of the connection member rests against the blade arm to support the blade arm relative to the rotational member. In some embodiments, when in the second position, the head portion of the connection member is spaced apart from the rotational member at a distance approximating a dimension of the blade arm, such that, when the blade arm is connected to the rotational member, the head portion of the connection member applies a force against the blade arm sufficient to secure the blade arm relative to the rotational member.

In some embodiments of the fan assembly, the opening includes at least one recessed portion that extends transversely into the opening, and, when the blade arm is in a secure state and/or when the connection member is in the second position, the head portion of the connection member at least partially bears against the recessed portion of the opening. In some embodiments, the opening has a length extending approximately from the open end portion of the opening to approximately the closed end portion of the opening. Additionally or alternatively, in some embodiments, the recessed portion of the opening extends into the opening in a direction that is substantially perpendicular to the length of the opening. In some embodiments of the fan assembly, the body portion of the connection member has a first width, the head portion of the connection member has a second width, the open end portion of the opening has a third width, such that the second width is greater than the third width and the third width is greater than the first width.

In some embodiments of the fan assembly, the recessed portion of the opening is positioned at or near the closed end portion of the opening. Additionally or alternatively, in some embodiments, the opening includes an elongate portion positioned between the open end portion and the closed end portion, the recessed portion of the opening is positioned at or near the closed end portion, and the opening is structured to receive the body portion of the connection member through the open end portion of the opening, through the elongate portion, and at or near the closed end portion. In some embodiments, the recessed portion of the opening is structured to at least partially receive the head portion of the connection member therein, such that, when the blade arm is in a secure state, the head portion of the connection member is substantially prevented from moving laterally within the recessed portion.

In some embodiments of the fan assembly, the blade arm includes a first connecting end for connecting the blade arm to the rotational member and a second connecting end for connecting the blade arm to a fan blade, the open end portion of the opening is positioned at or near an end portion of the first connecting end of the blade arm, and the closed end portion of the opening is positioned on the first connection portion of the blade arm at a location between the open end portion of the opening and the second connection portion of the blade arm.

As another example, some embodiments of the present invention provide a method for installing a blade arm to a rotational member of a fan motor. In accordance with some embodiments, (a) the rotational member is structured for connection to a connection member, (b) the connection member includes a body portion and a head portion, (c) the blade arm has at least one opening defined therein, and (d) the opening includes an open end portion and a closed end portion. Additionally or alternatively, the method includes: (a) positioning the blade arm relative to the connection member, and (b) urging the connection member relative to the rotational member, such that the head portion of the connection member at least partially bears against the blade arm.

In some embodiments of the method, the rotational member is rotatable about a rotational axis, and positioning the blade arm relative to the connection member includes sliding the blade arm relative to the connection member in a direction that is substantially perpendicular to the rotational axis. Additionally or alternatively, in some embodiments of the method, urging the connection member relative to the rotational member includes urging the connection member relative to the rotational member in a direction that is substantially parallel to the rotational axis. In some embodiments of the method, positioning the blade arm relative to the connection member includes sliding the blade arm relative to the connection member, such that the body portion of the connection member enters the open end portion of the opening and terminates (and/or remains) at or near the recessed portion of the opening.

In some embodiments of the method, the opening includes at least one recessed portion that extends transversely into the opening. In some embodiments, the opening includes an elongate portion that is positioned between the open end portion and the closed end portion. In some embodiments, the recessed portion of the opening is positioned at or near the closed end portion. In some embodiments, positioning the blade arm relative to the connection member includes sliding the blade arm relative to the connection member, such that the body portion of the connection member enters the open end portion of the opening, moves through the elongate portion, and then terminates (and/or remains) at or near the closed end portion. In some embodiments of the method, urging the connection member relative to the rotational member includes urging the head portion of the connection member at least partially into the recessed portion of the opening, such that the head portion is substantially prevented from moving laterally within the recessed portion.

In some embodiments of the method, when in a first position, the head portion of the connection member is spaced apart from the rotational member at a distance greater than a dimension of the blade arm, such that, when the blade arm is positioned relative to the connection member, the head portion of the connection member rests against the blade arm to support the blade arm relative to the rotational member. Additionally or alternatively, in some embodiments of the method, urging the connection member relative to the rotational member includes urging the connection member to a second position, where the head portion of the connection member is spaced apart from the rotational member at a distance approximating a dimension of the blade arm, such that, when the blade arm is connected to the rotational member, the head portion of the connection member applies a force against the blade arm sufficient to secure the blade arm relative to the rotational member.

As yet another example, some embodiments of the present invention provide a blade arm that includes: (a) a first connection portion structured for connection to a rotational member of a fan motor, where the first connection portion defines an opening therein, and where the opening has an open end portion and a closed end portion; (b) a second connection portion structured for connection to a fan blade; and (c) an elongate portion positioned between the first connection portion and the second connection portion.

In some embodiments of the blade arm, the opening has a length extending from approximately the open end portion of the opening to approximately the closed end portion, and the first connection portion further defines a recessed portion that extends into the first connection portion in a direction that is substantially perpendicular to the length of the opening. Additionally or alternatively, in some embodiments of the blade arm, the opening is positioned at least partially within the recessed portion, the recessed portion is structured for receiving a head portion of a connection member at least partially therein, and the opening is structured for receiving a body portion of the connection member at least partially therein. Further, in some embodiments of the blade arm, the first connection portion further defines a tab that is structured for connection to the rotational member.

As another example, some embodiments of the present invention provide a fan assembly that includes: (a) a rotational member; (b) a connection member structured for connection to the rotational member, where the connection member has a head portion and a body portion; and (c) a spacer defining an opening therein, where the opening has an open end portion and a closed end portion, and where the opening is structured for receiving the body portion of the connection member therein. In some of these embodiments, the body portion of the connection member can be connected to the rotational member and positioned within the opening of the spacer, such that the spacer is positioned at least partially between the head portion of the connection member and the rotational member, and such that the head portion is maintained a predetermined distance away from the rotational member.

In some embodiments, the fan assembly further includes a blade arm defining a second opening therein, where the second opening has an open end portion and a closed end portion, and where the second opening is structured for receiving the body portion of the connection member therein. In some of these embodiments, the blade arm has a height dimension less than the predetermined distance, so that the blade arm can be positioned, in place of the spacer, between the head portion of the connection member and the rotational member.

Additionally or alternatively, in some embodiments of the fan assembly, the opening defined in the spacer includes a first set of teeth structured for at least partially bearing against the body portion of the connection member. In other embodiments, the spacer includes a first grip portion, a second grip portion, and a connection portion, where the first grip portion defines the opening therein, where the second grip portion defines a second opening therein, and where the connection portion is positioned at least partially between the first grip portion and the second grip portion, such that the spacer is C-shaped.

As another example, some embodiments of the present invention provide an easy install fan assembly that includes: (a) an easy install blade arm to motor connection having: (i) a rotational member, (ii) a connection member structured for connection to the rotational member, where the connection member includes a body portion and a head portion, and (iii) a blade arm defining an opening therein, where the opening includes an open end portion and a closed end portion.

In some embodiments of the easy install fan assembly, the connection member can be pre-installed so that the position of the head portion relative to the rotational member allows mounting of the blade arm to the rotational member in such a way that the blade arm remains preliminarily supported by the head portion, so that an installer can urge the connection member (and/or the head portion thereof) into a tightening state and/or the second position without the installer needing to hold the blade arm manually. When the blade arm is in a secure state, the head portion of the connection member at least partially bears against the blade arm and keeps the blade arm from becoming dislodged from the rotational member during full-speed rotation of the motor. Additionally or alternatively, in some embodiments, the easy install fan assembly further includes an easy install blade arm to fan blade connection.

BRIEF DESCRIPTION OF THE FIGURES

Figure 1:
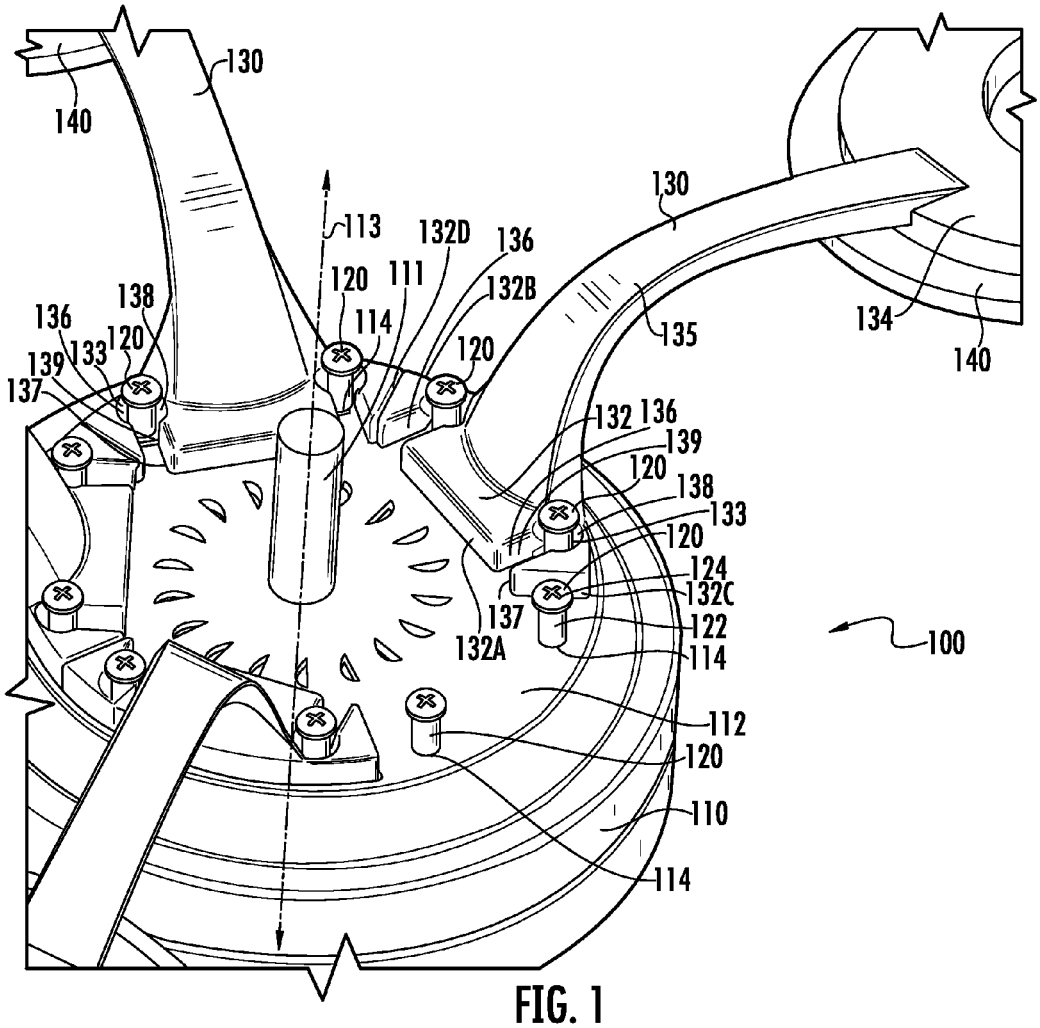
Figure 2B:
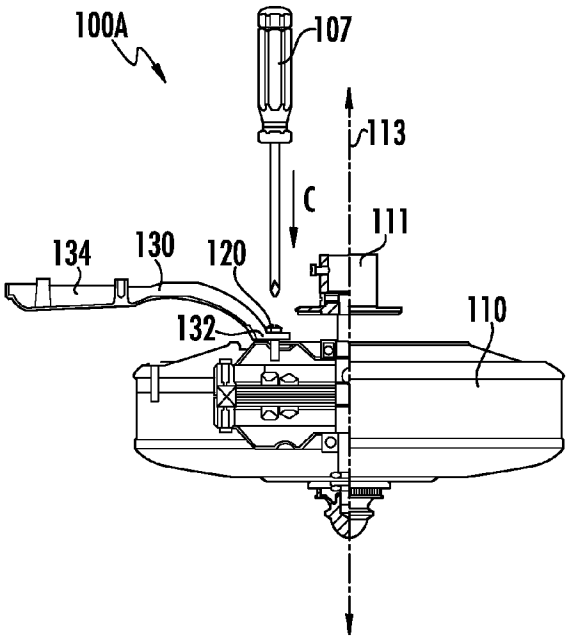
Figure 2A:
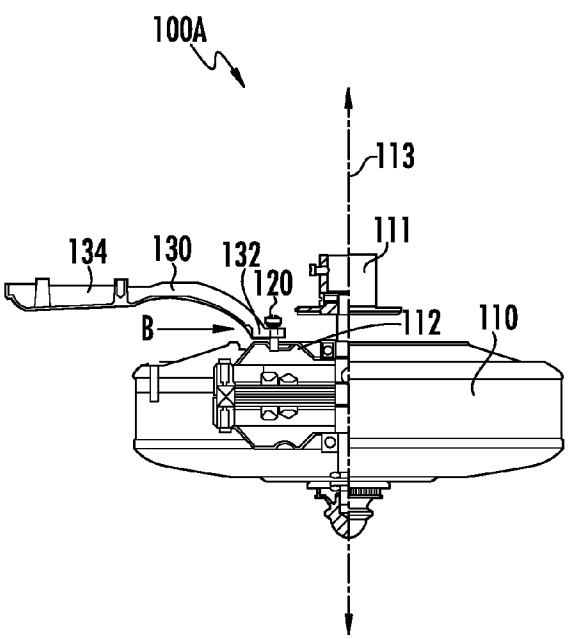
Figure 2:
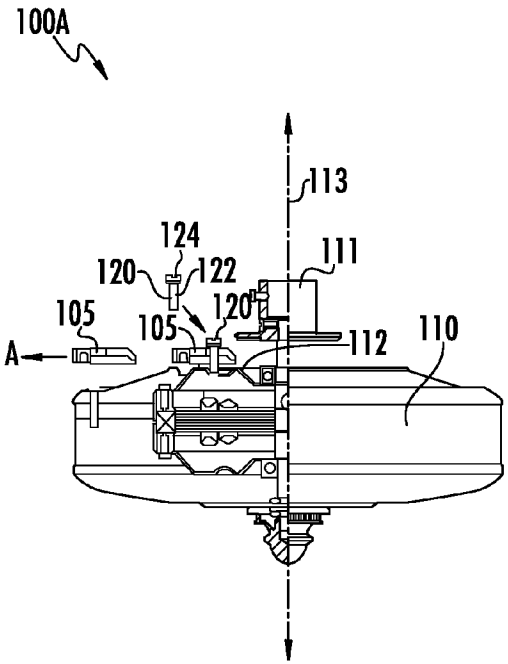
Figure 3:
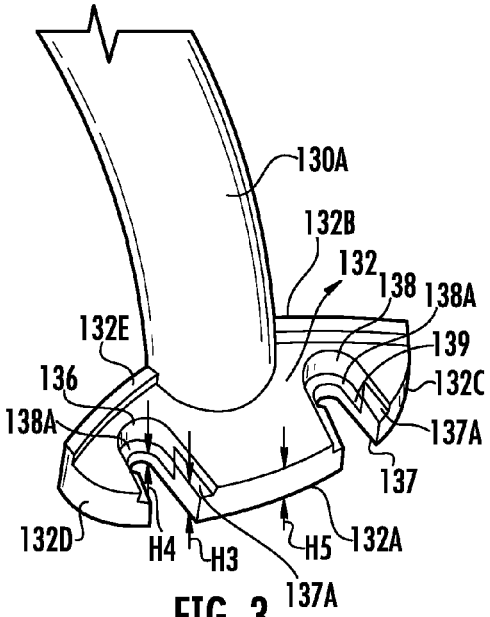
Figure 3A:
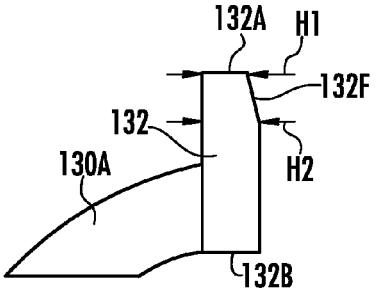
Figure 3B:
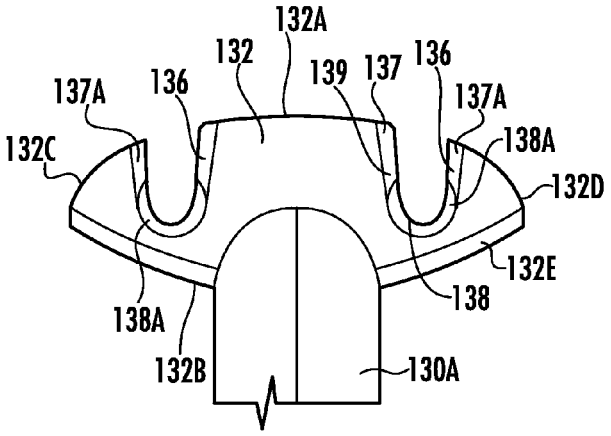
Figures 4, 4A, 4B, 4C, 4D:
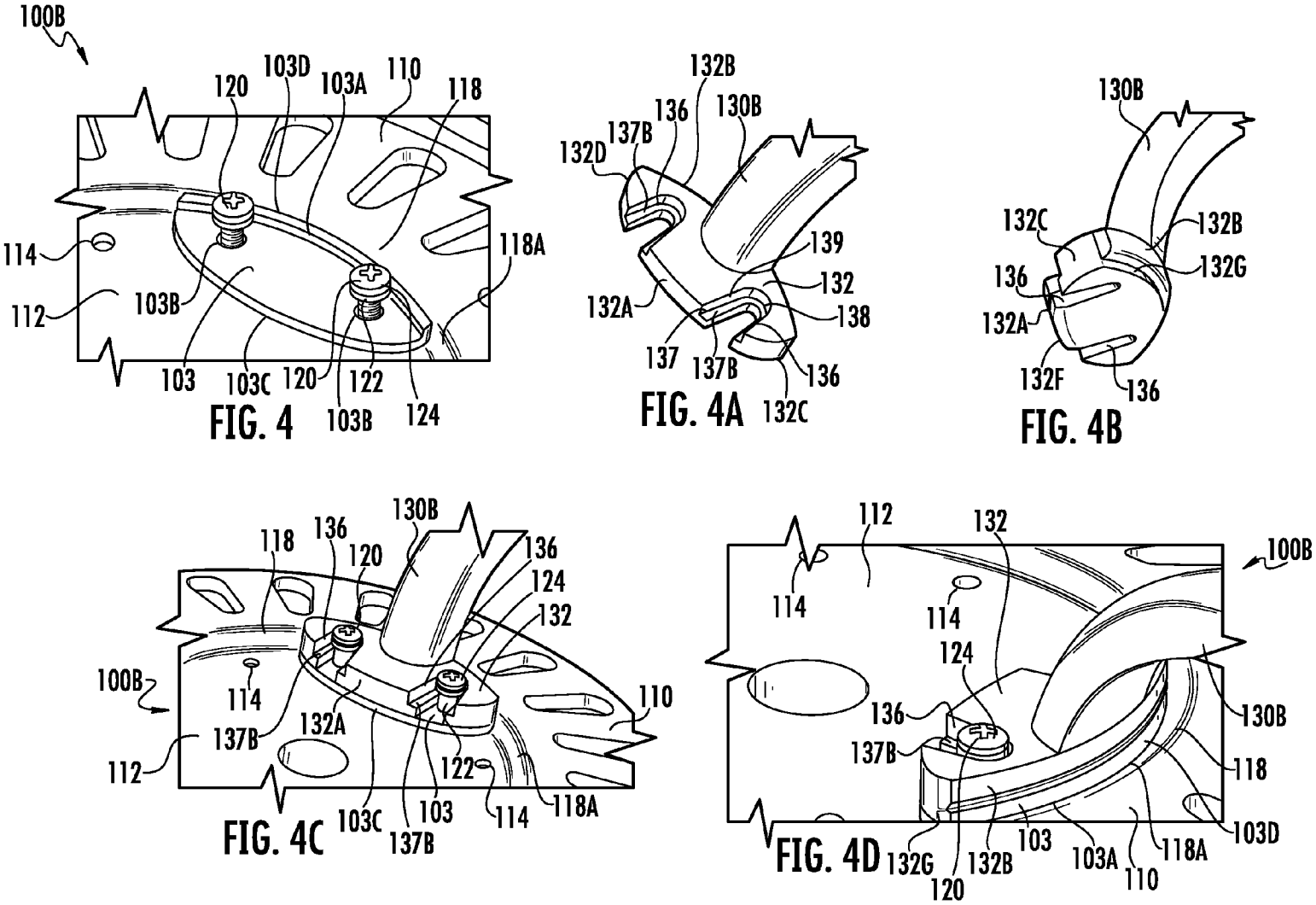
Figure 5:
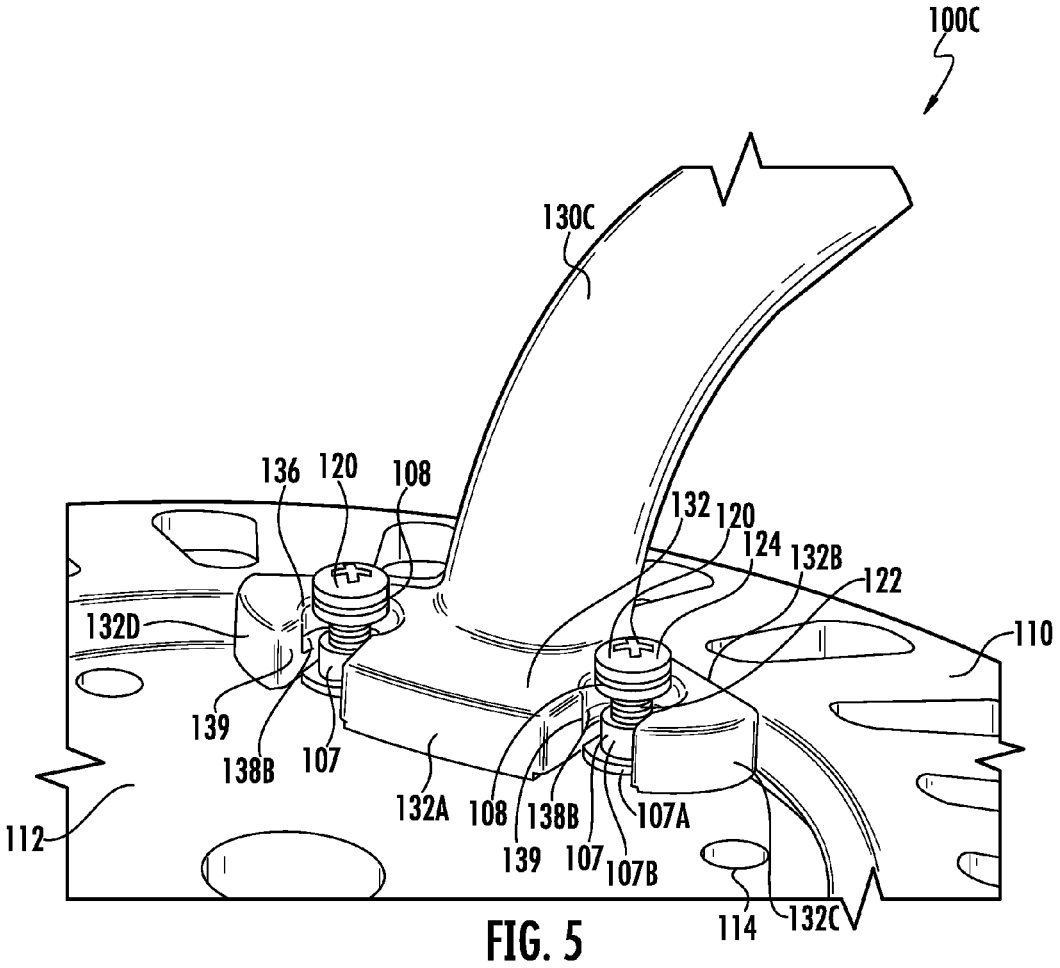
Figure 5A:
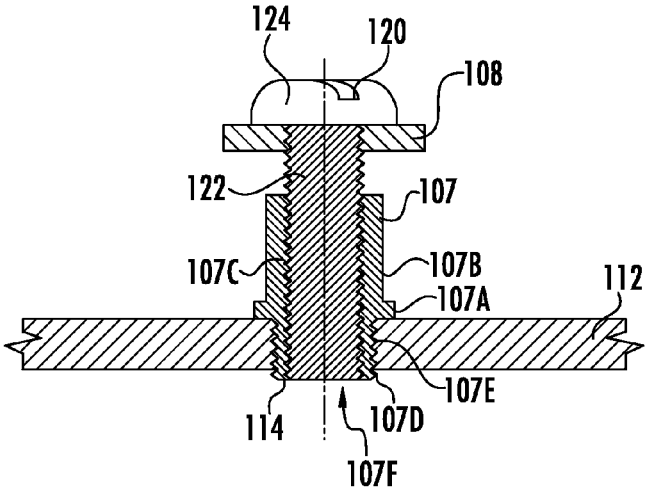
Figure 6:
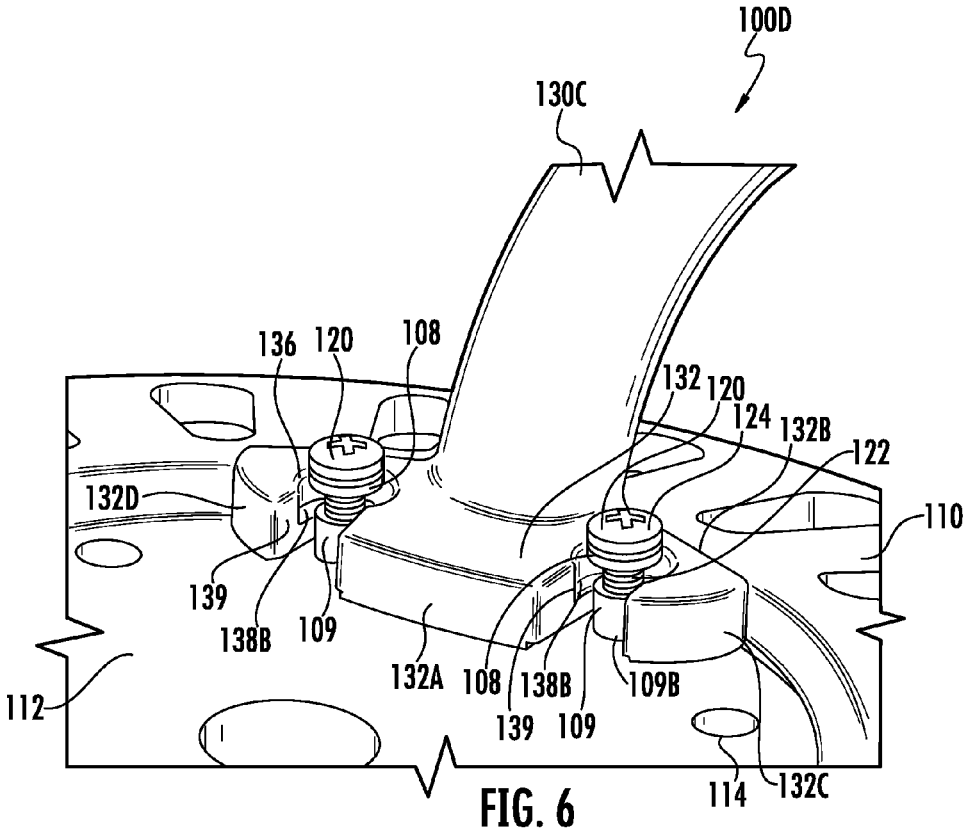
Figure 6A:
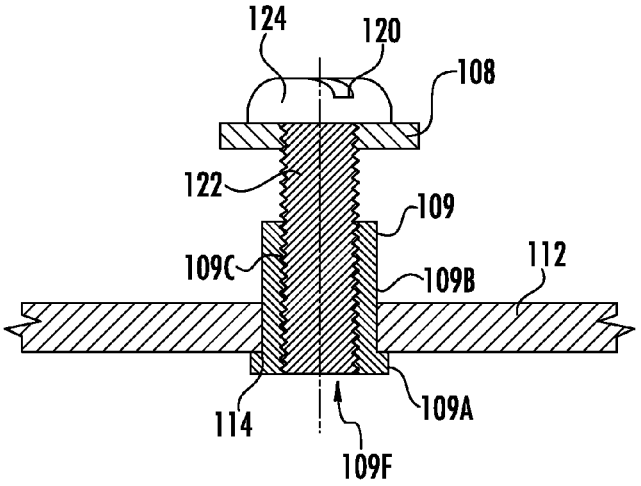
Figure 7:
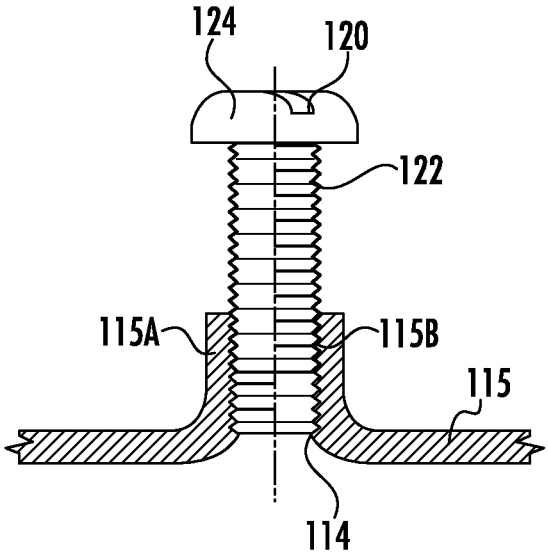
Figure 8:
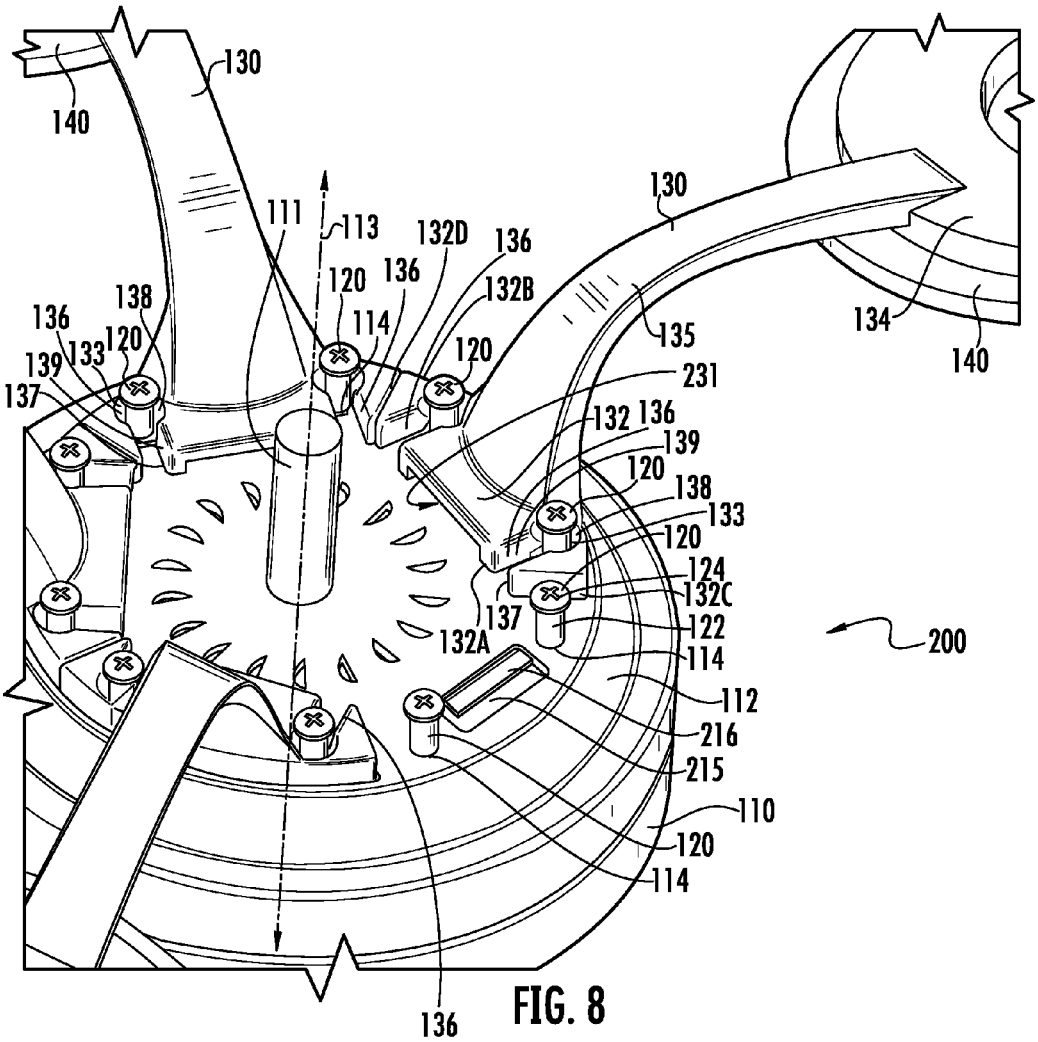
Figure 9:
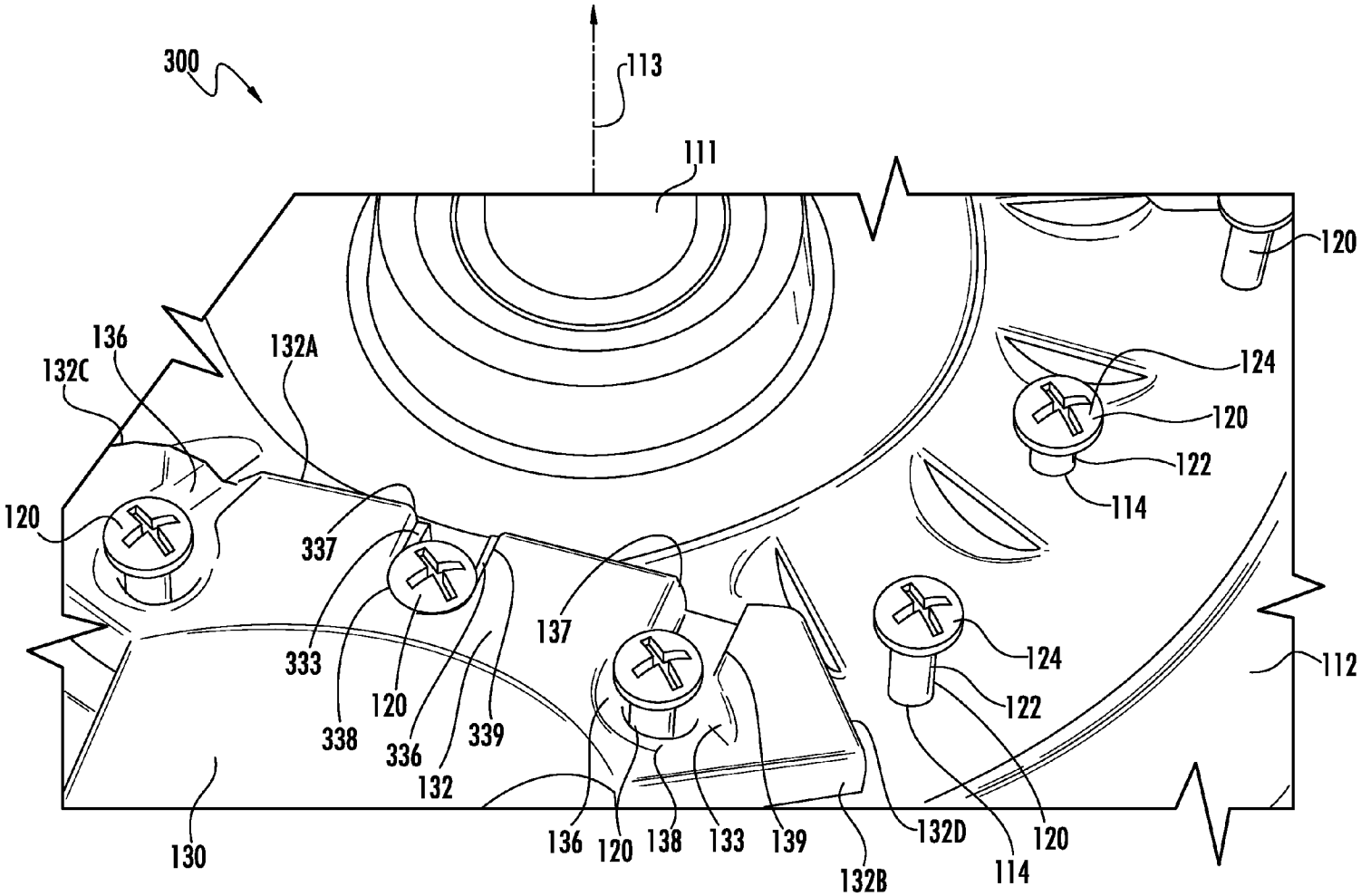
Figure 10:
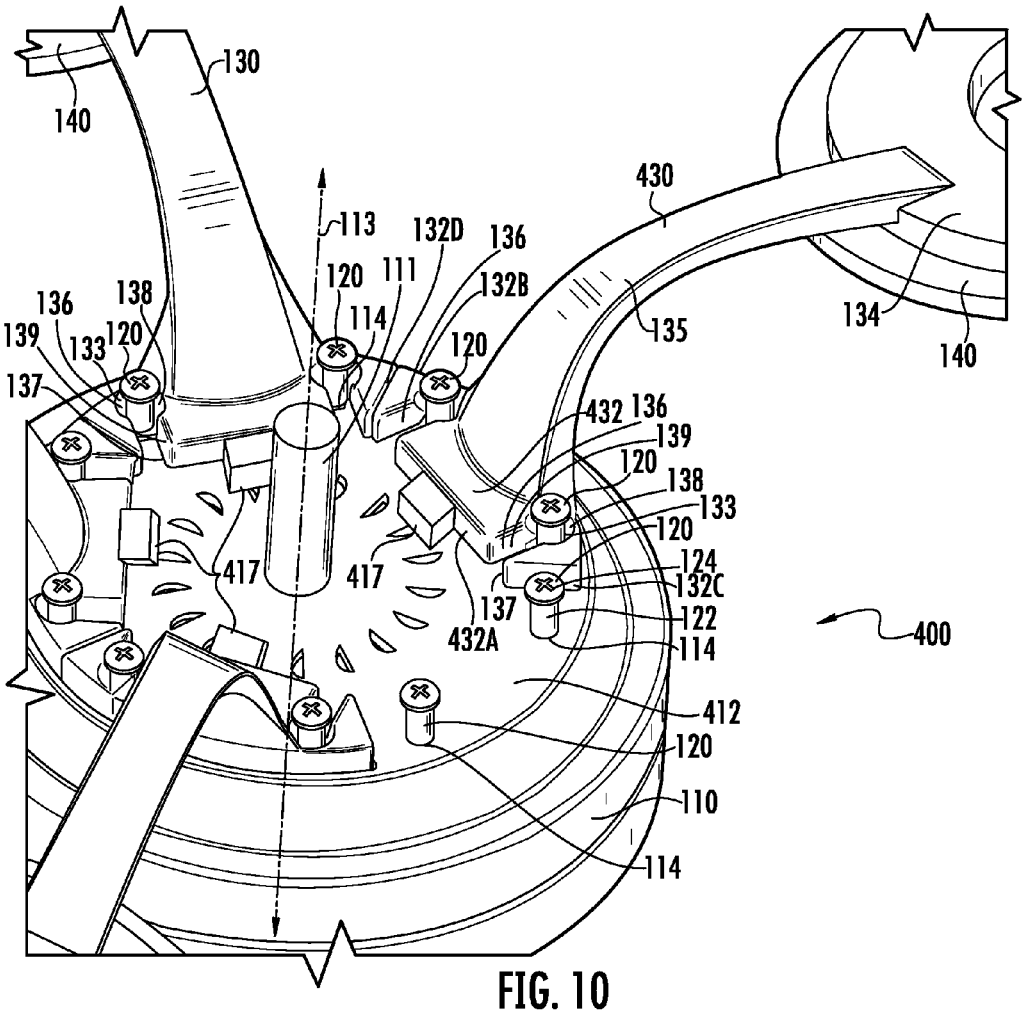
Figure 11:
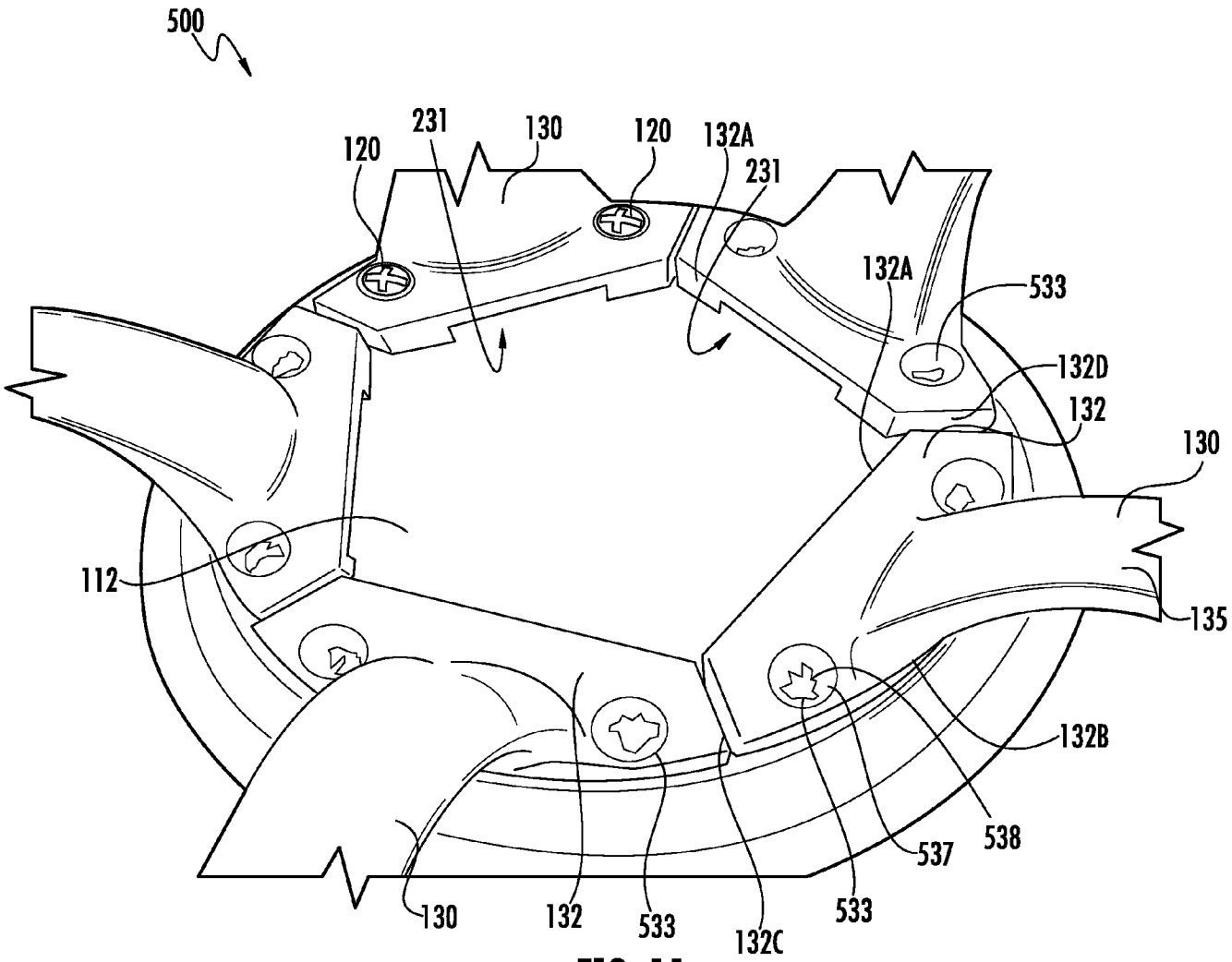
Figure 11A:
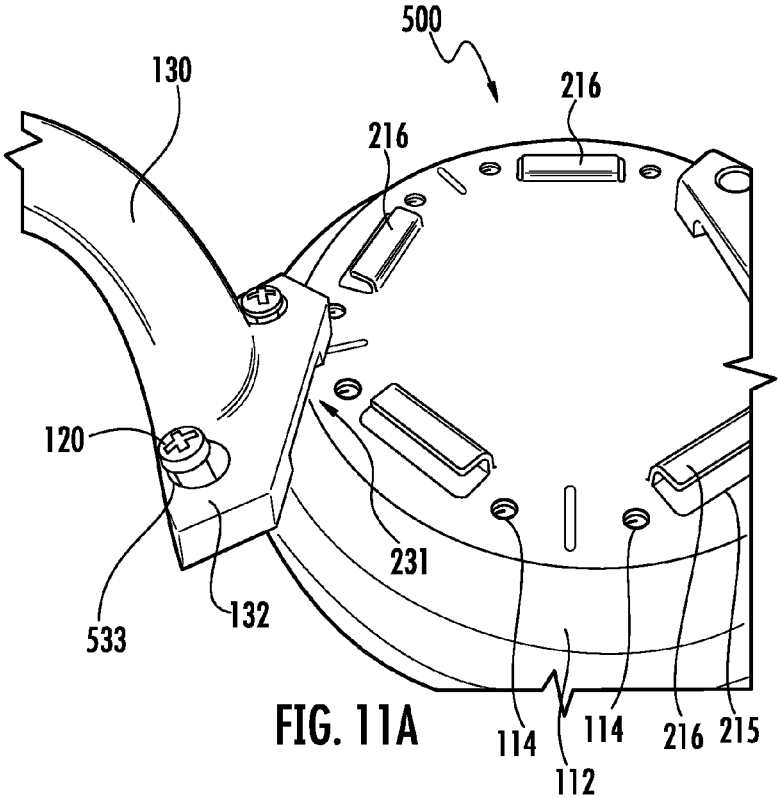
Figure 11B:
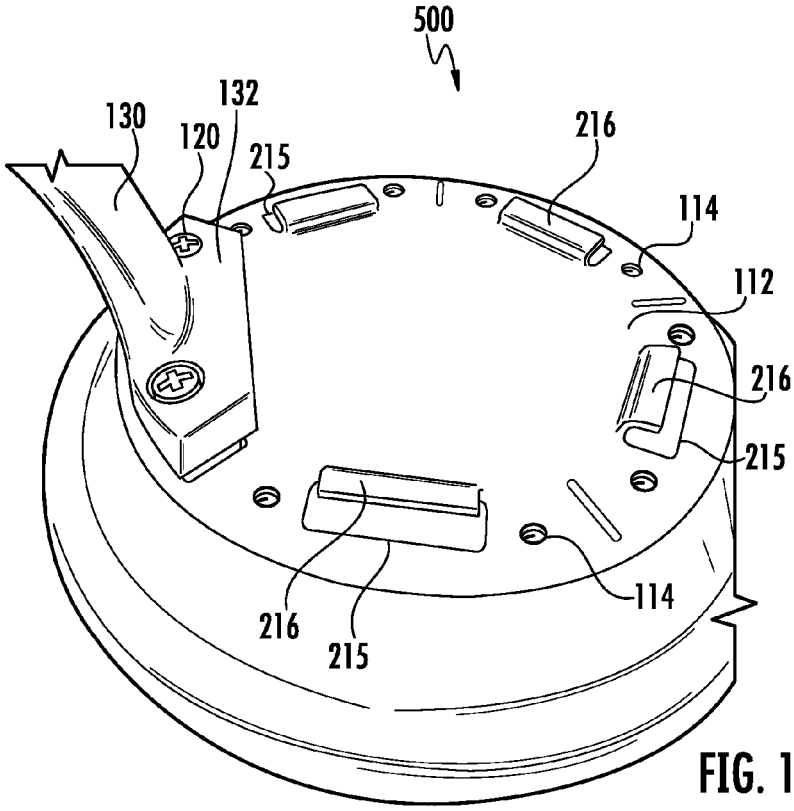
Figure 11C:
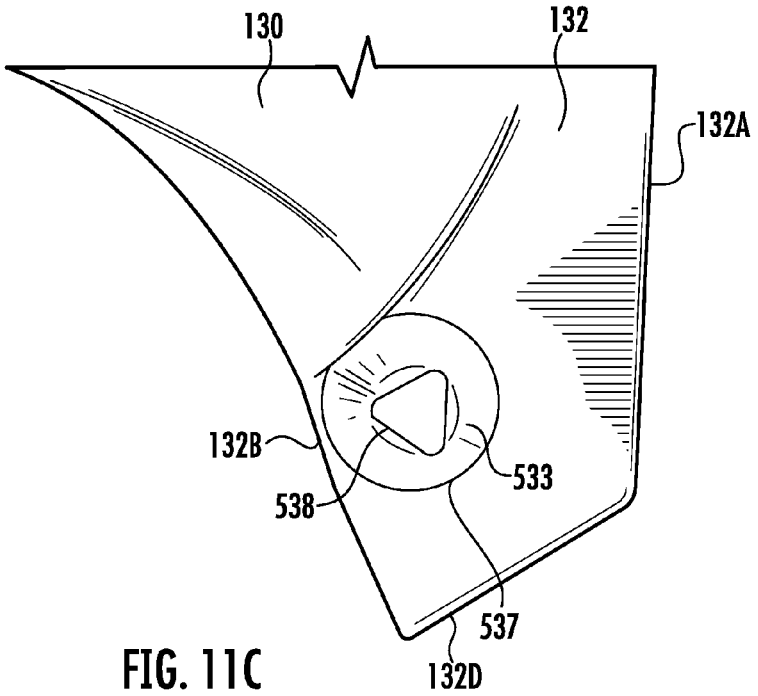
Figure 11D:
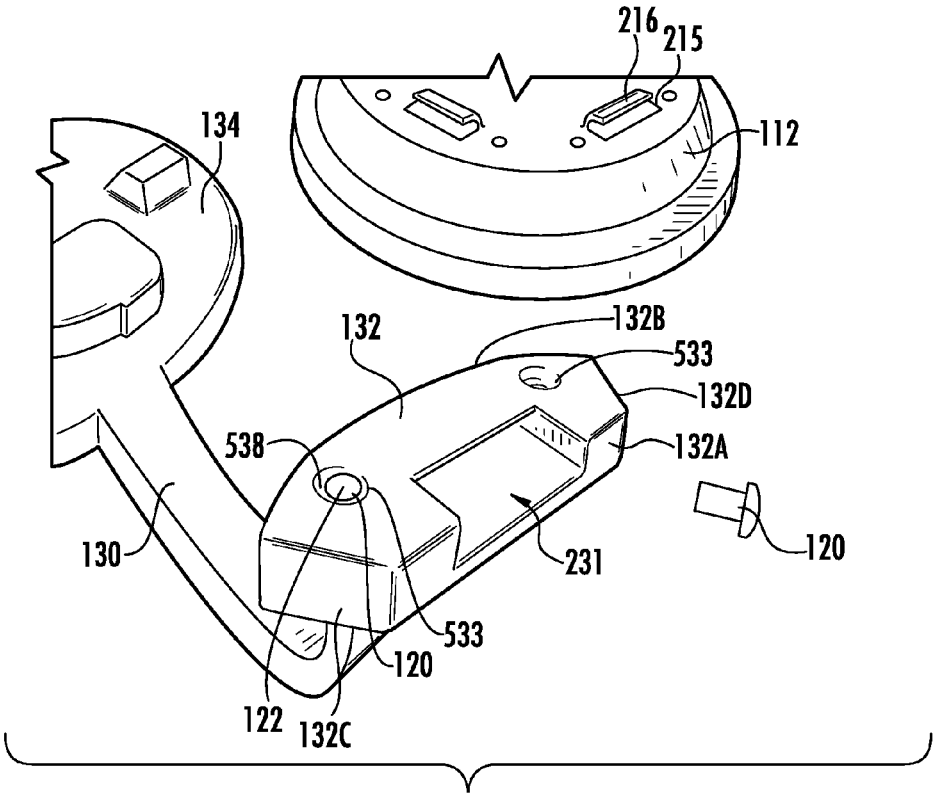
Figure 12:
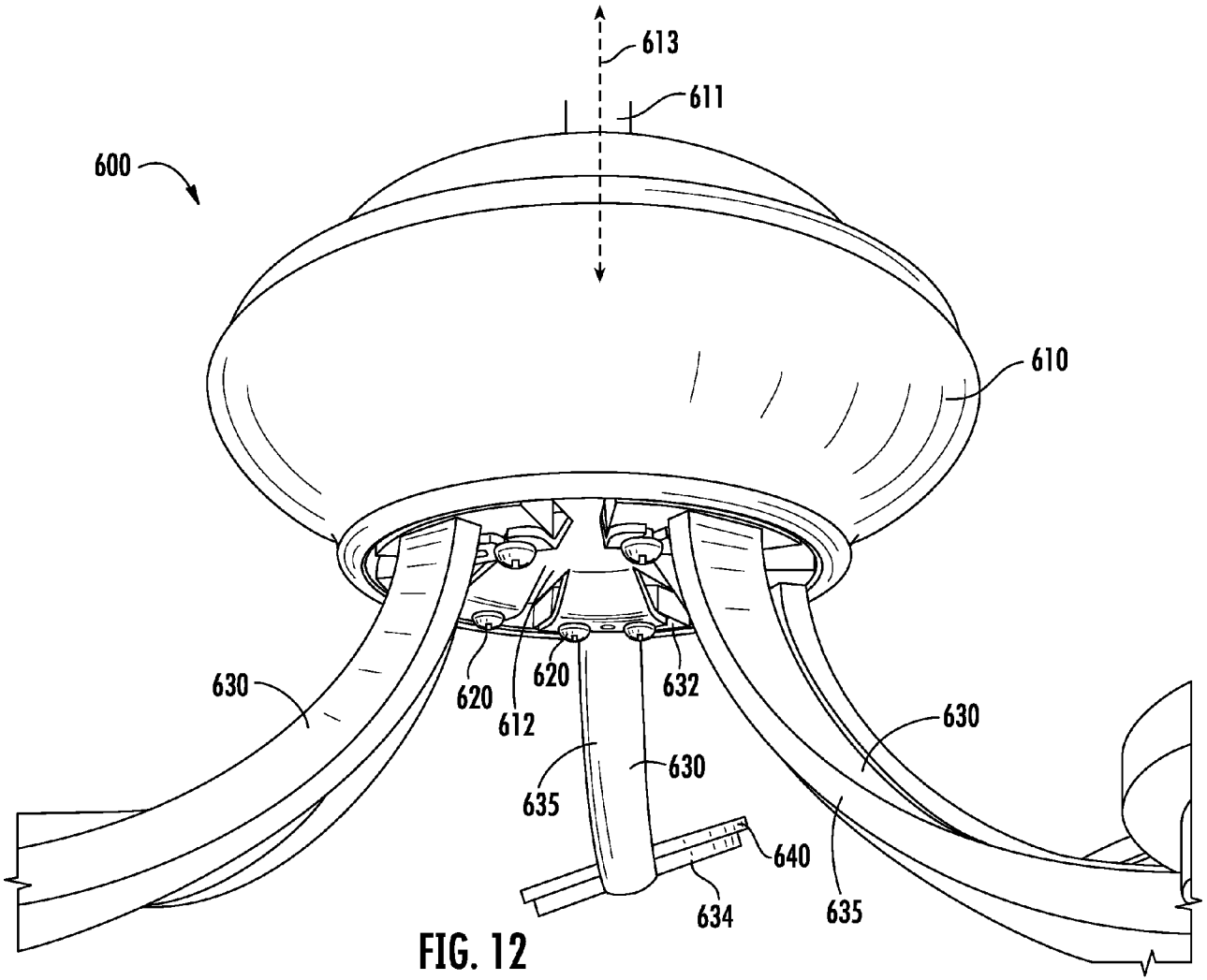
Figure 12A:
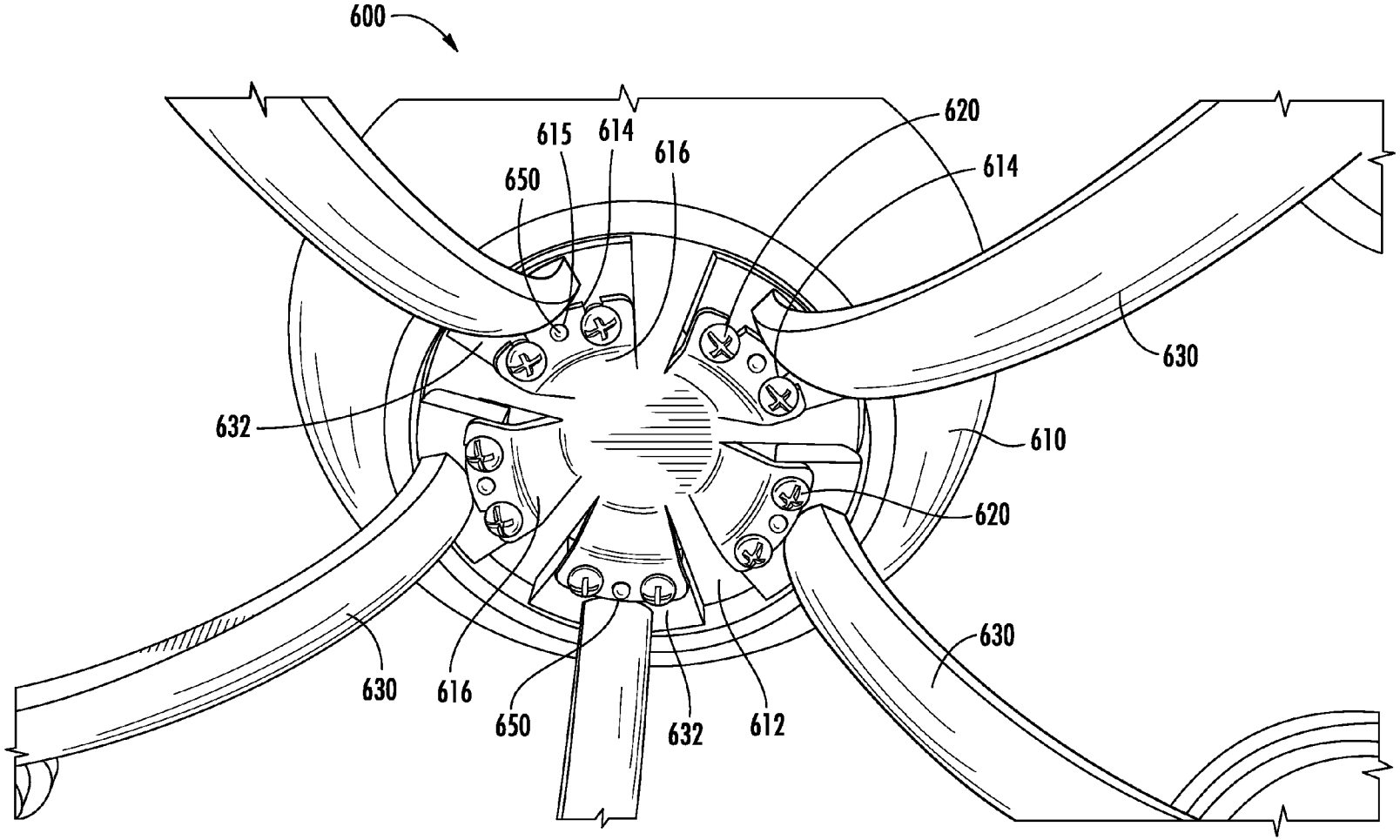
Figure 12B:
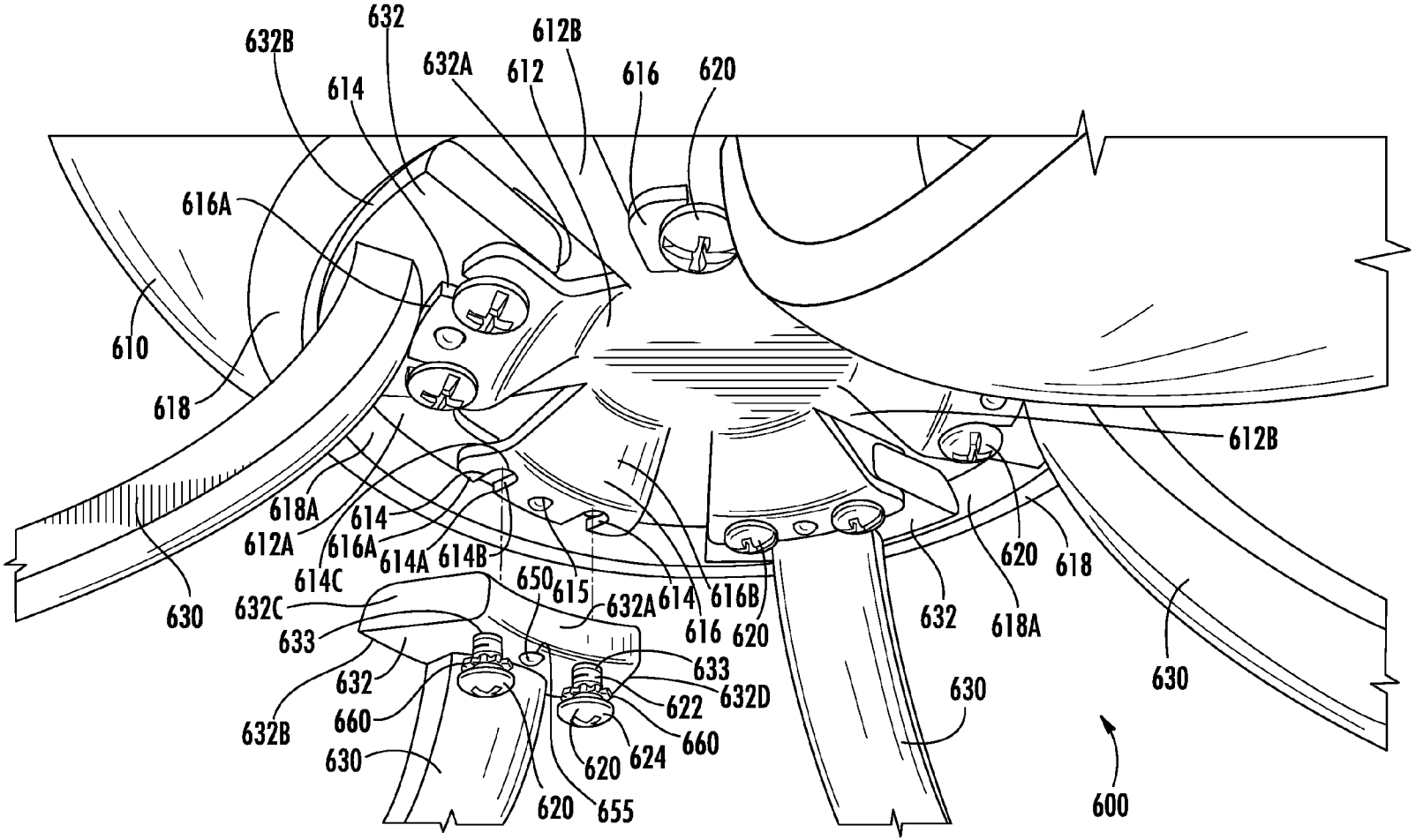
Figure 12C:
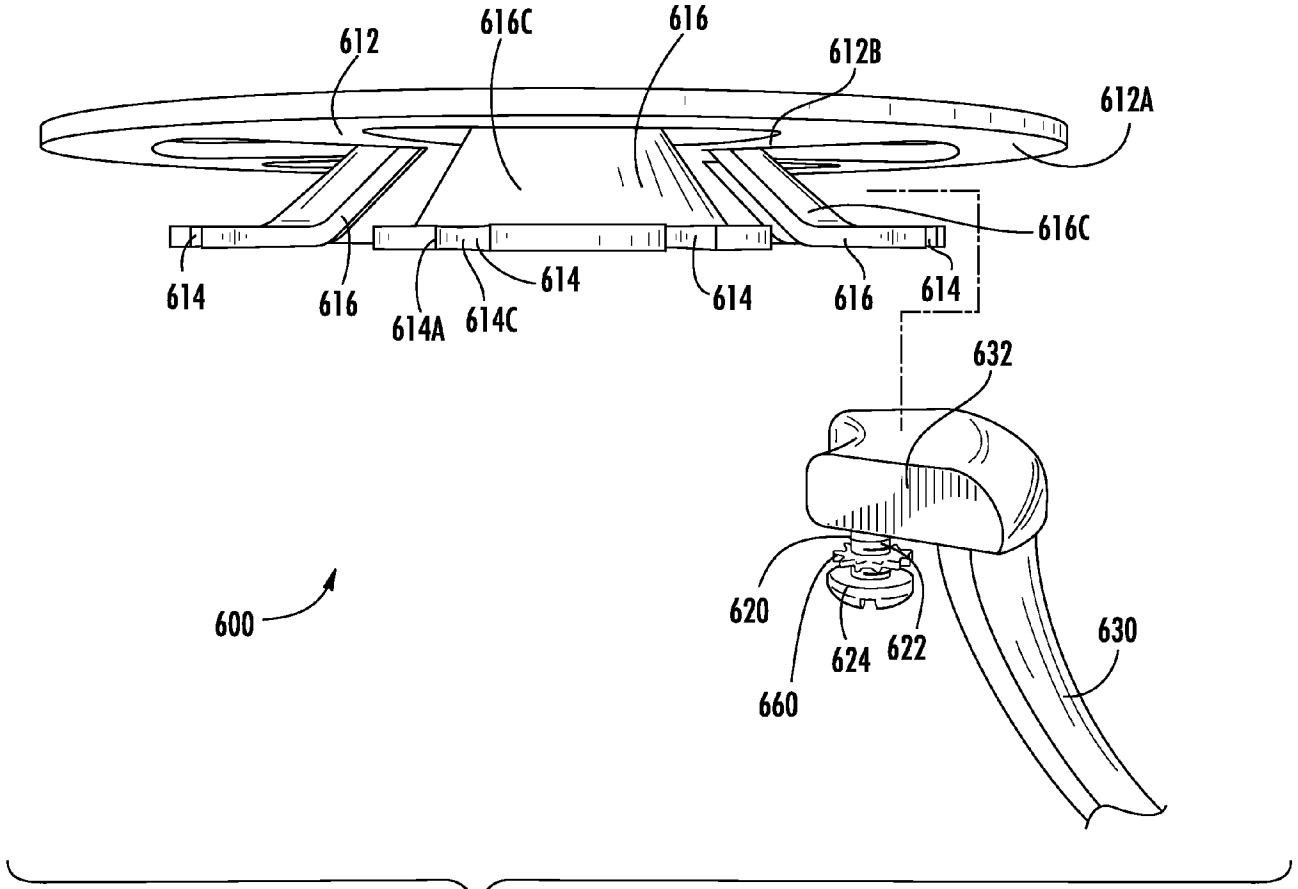
Figure 12D:
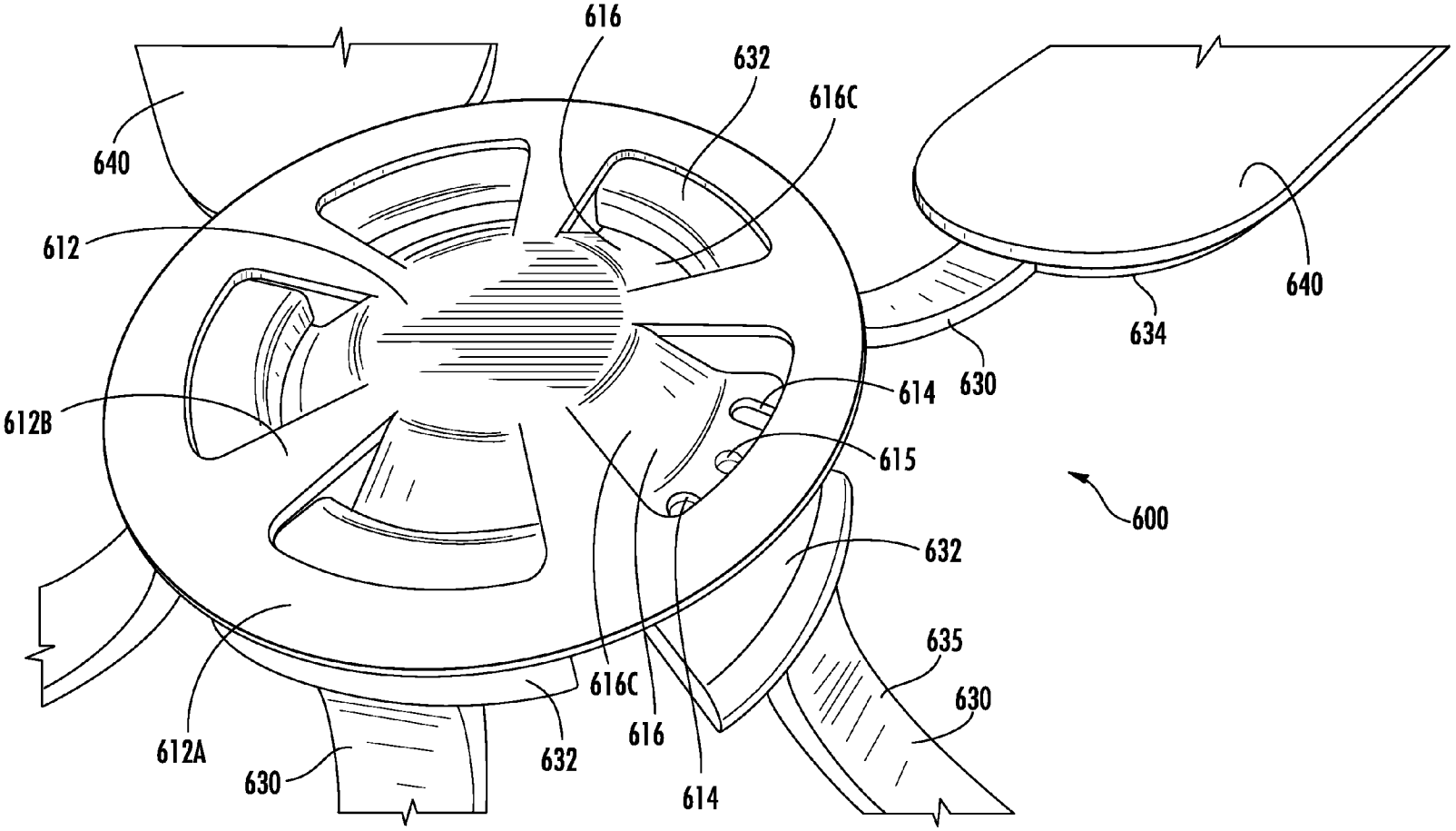
Figure 13:
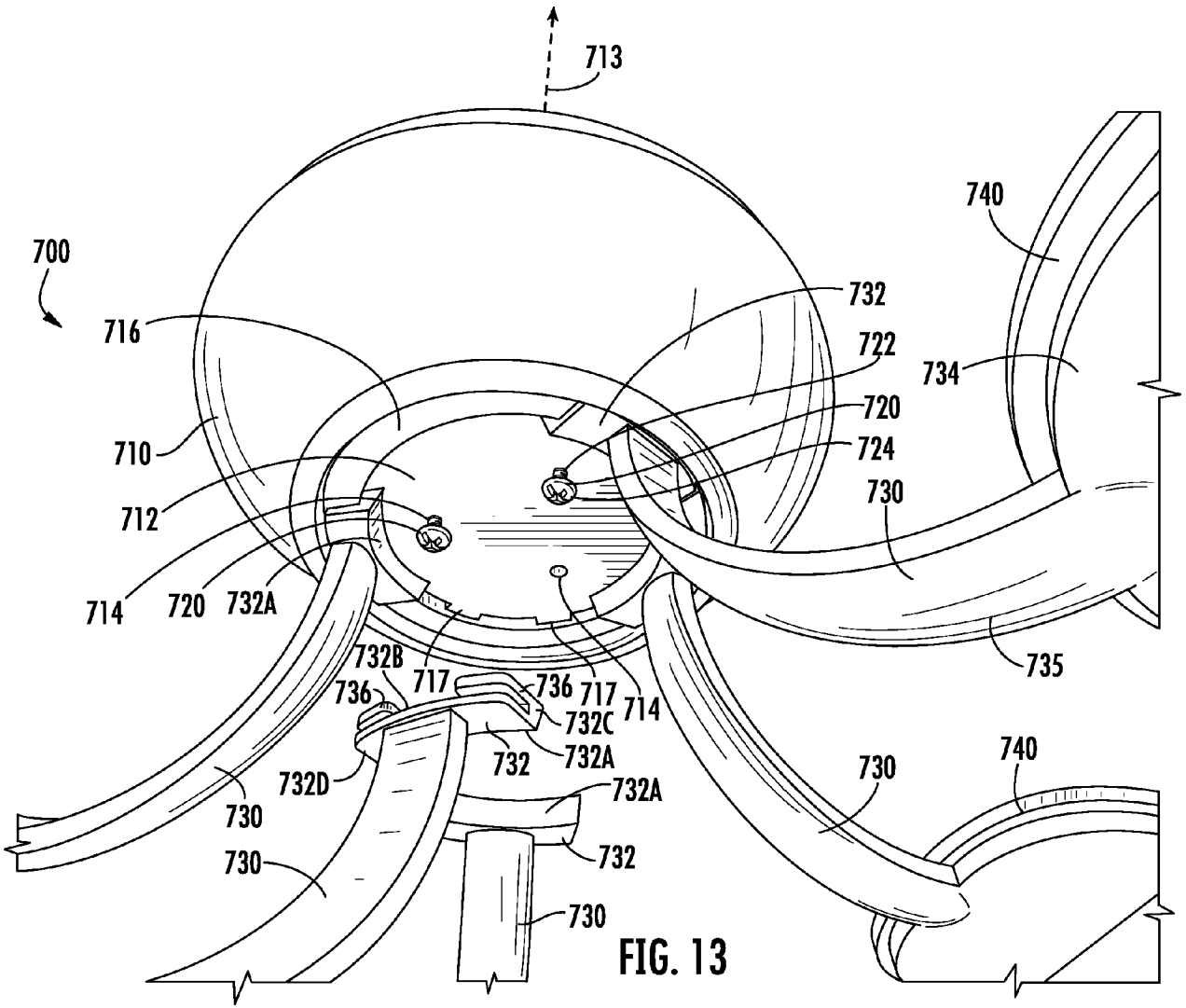
Figure 13A:
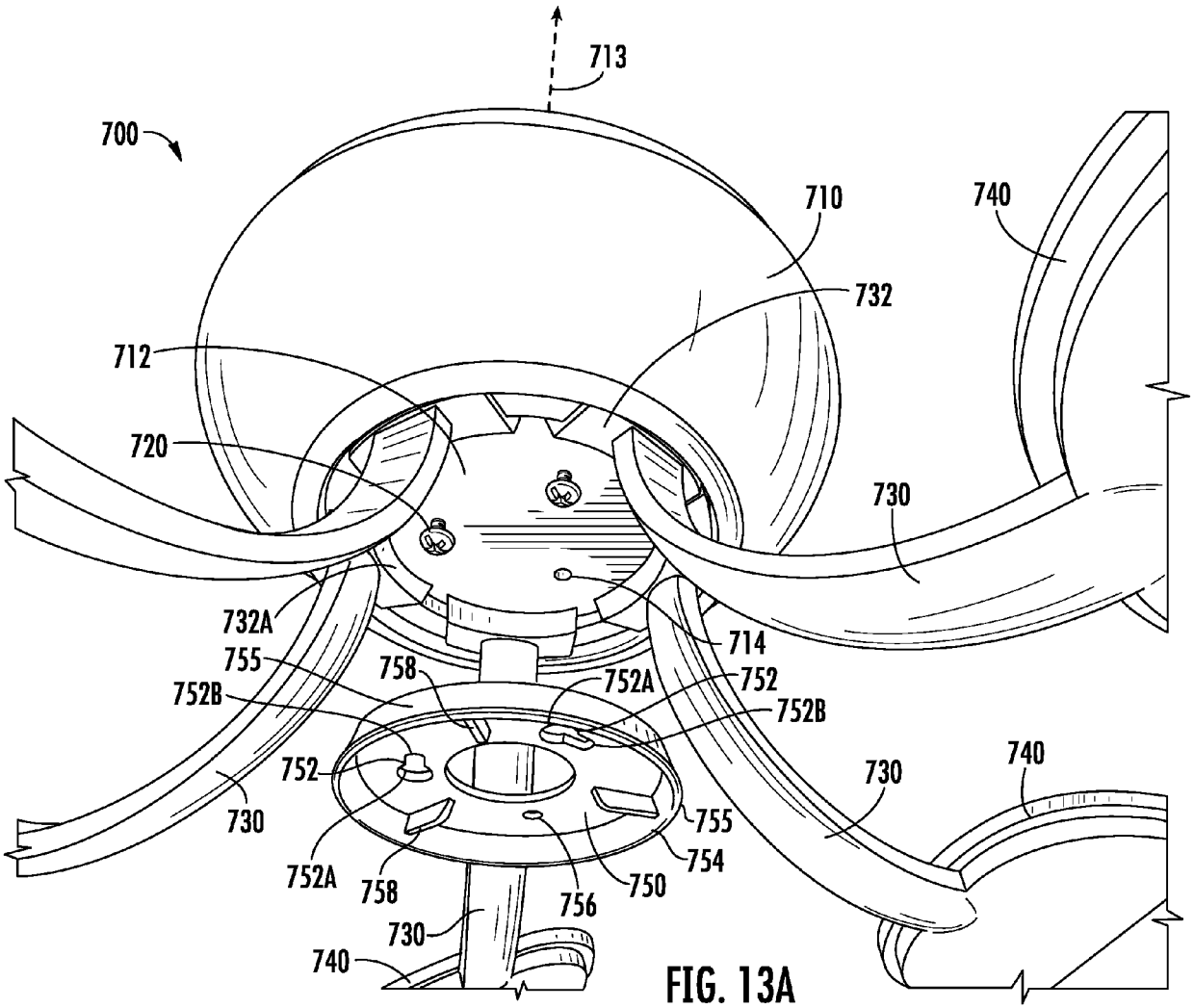
Figure 13B:
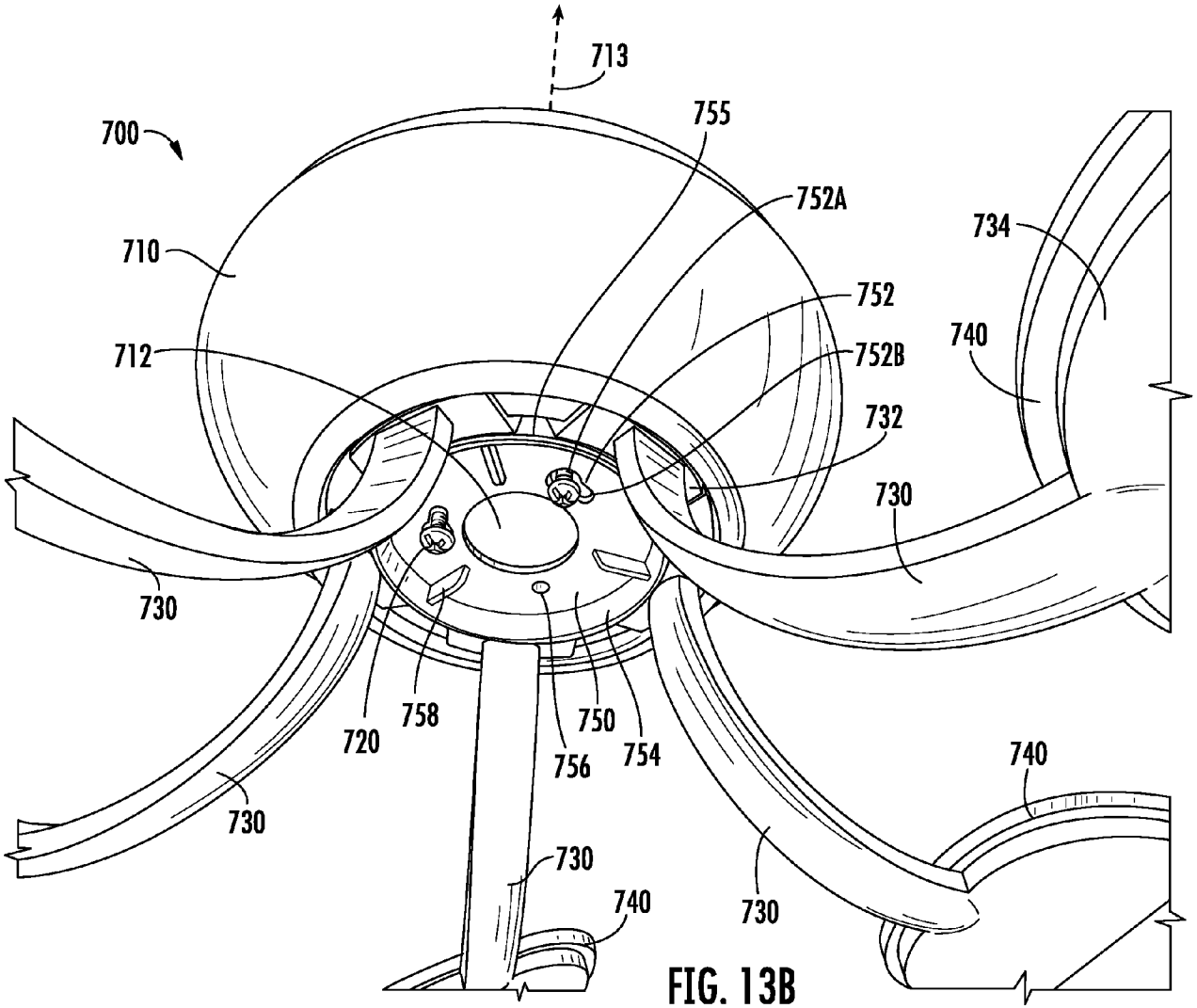
Figure 13C:
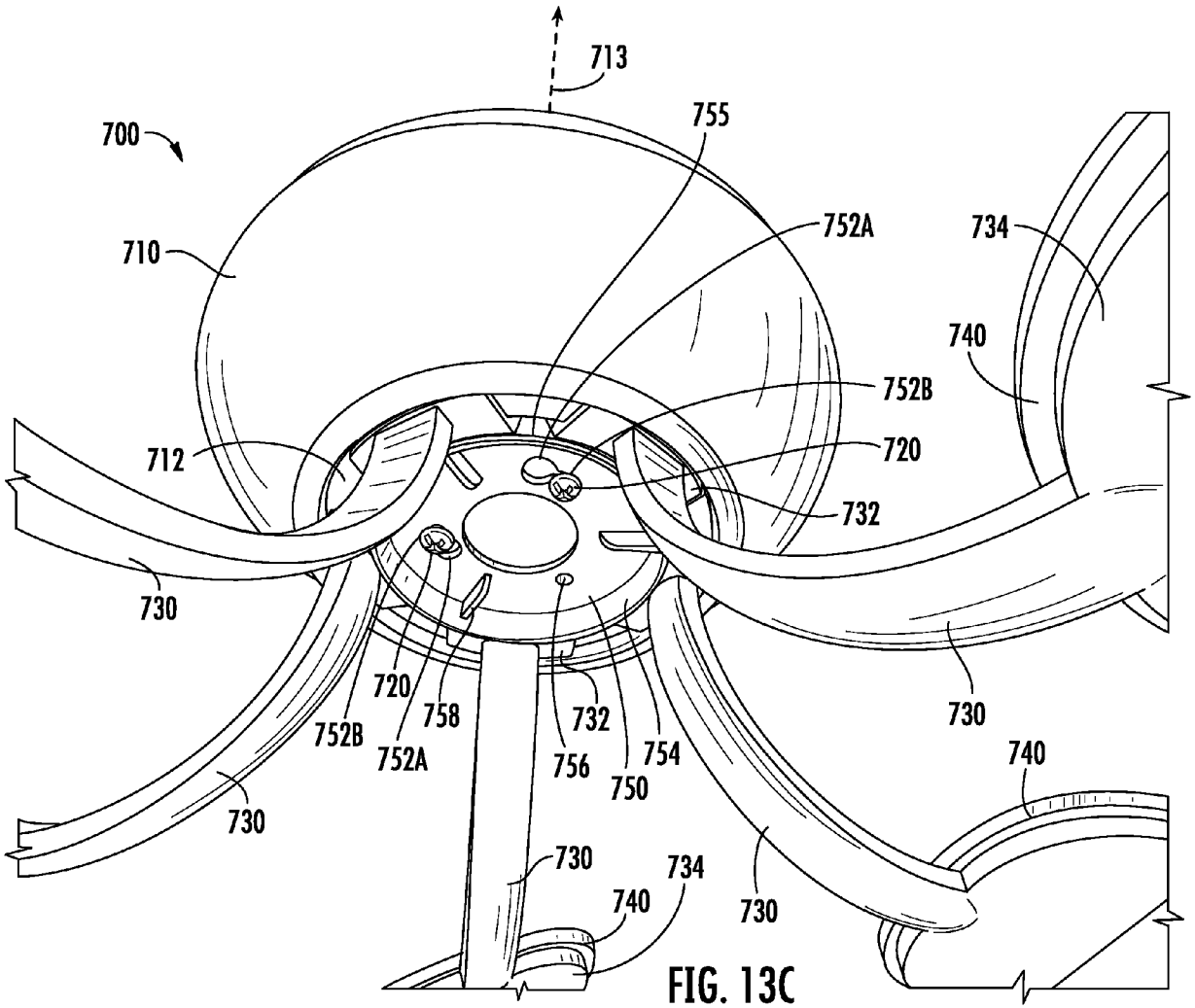
Figure 13D:
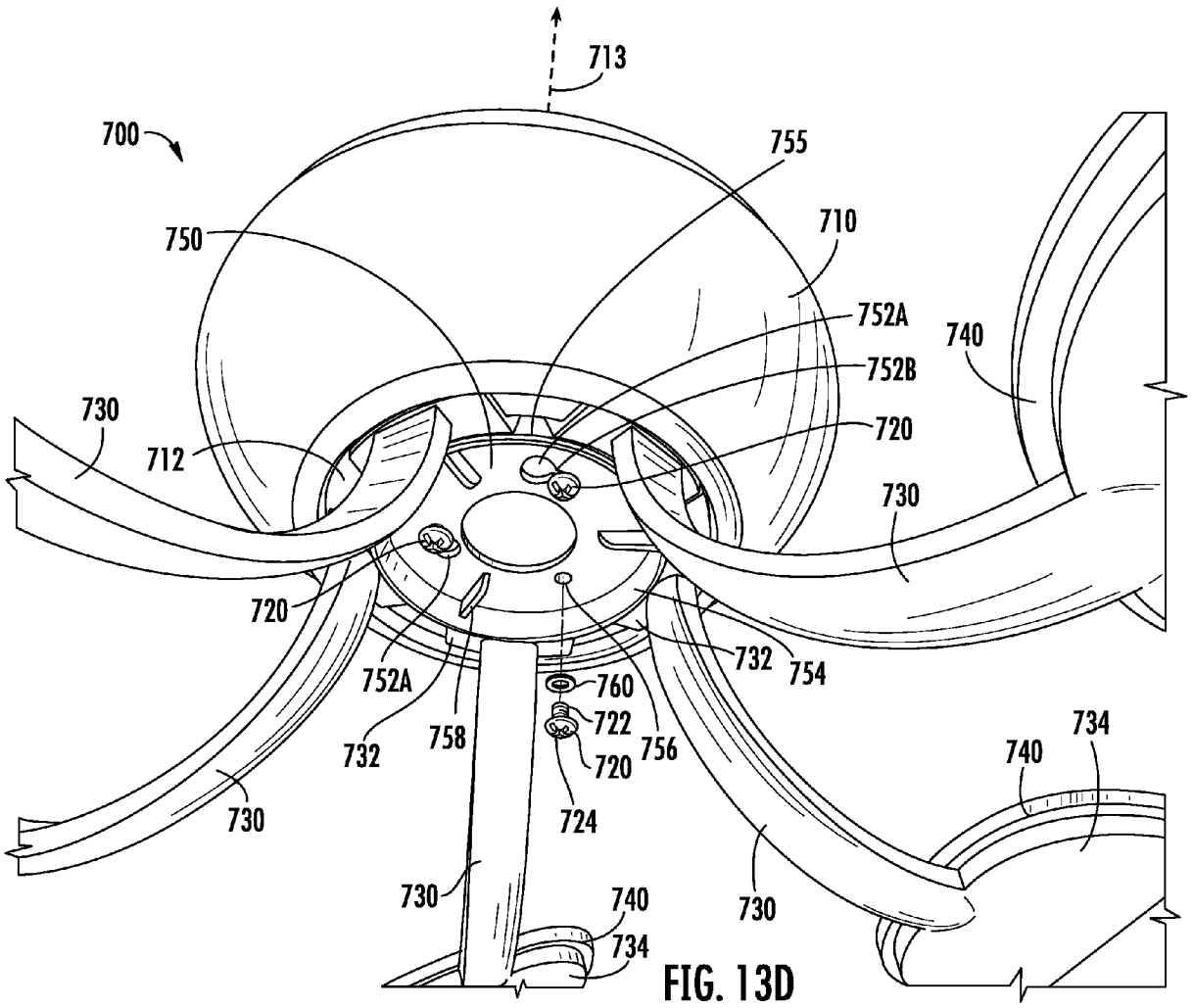
Figure 13E:
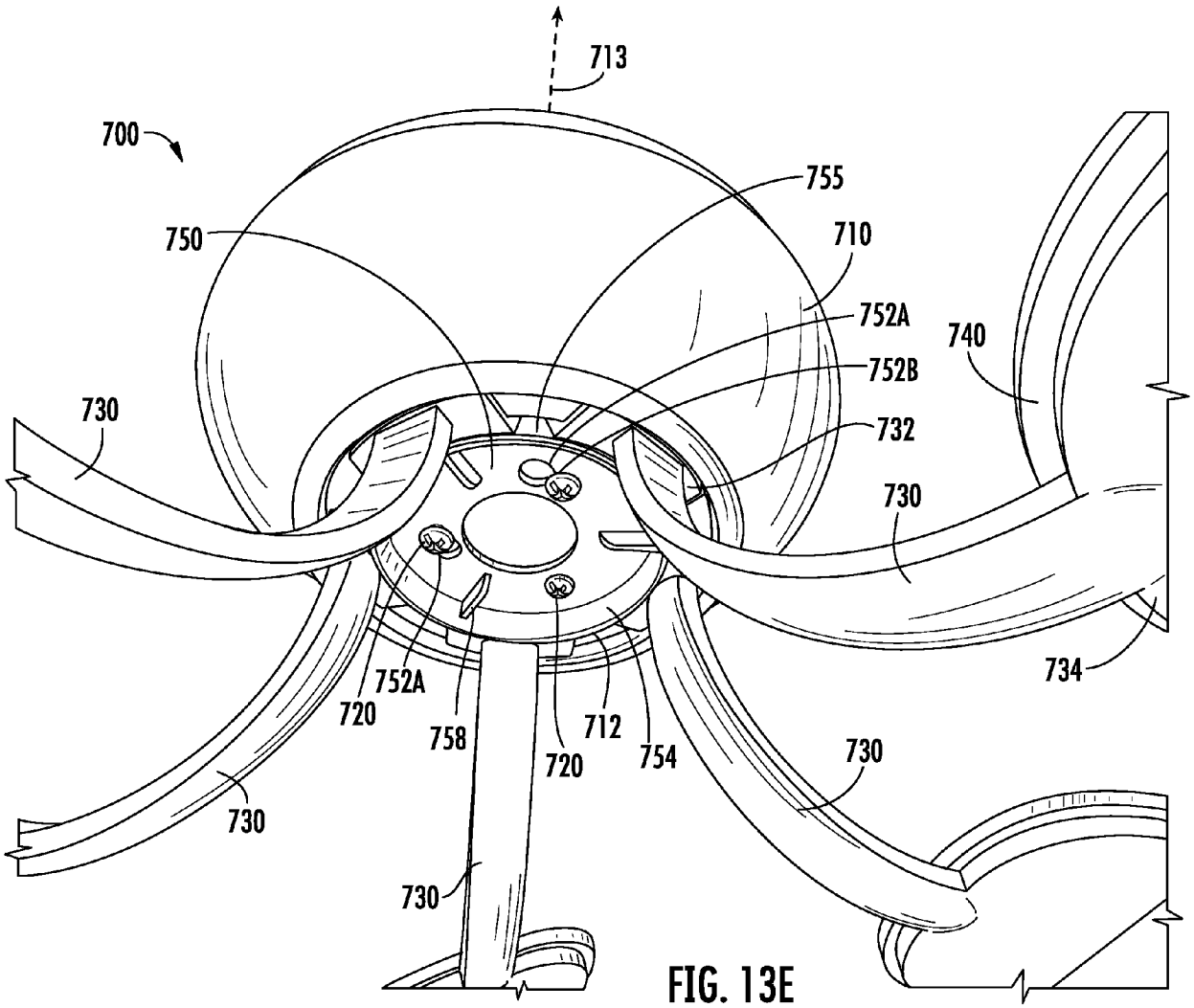
Figure 14:
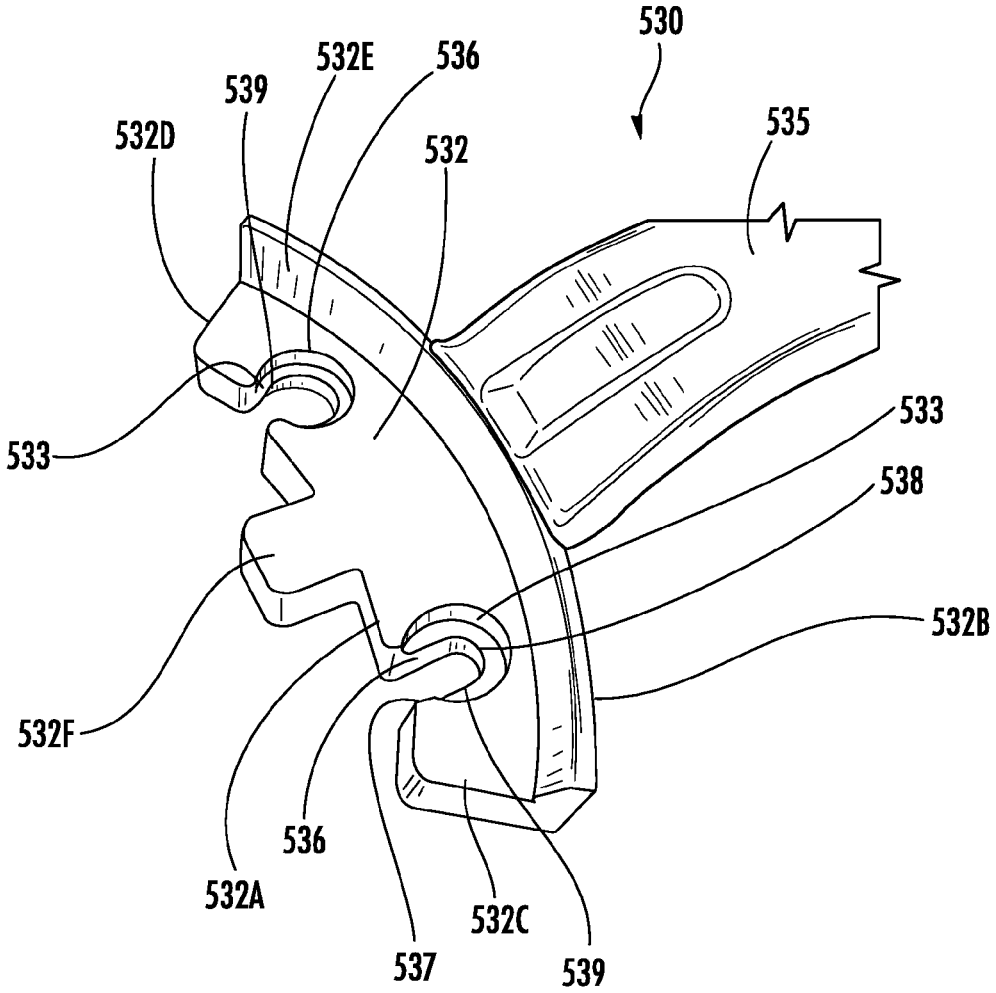
Figure 14A:
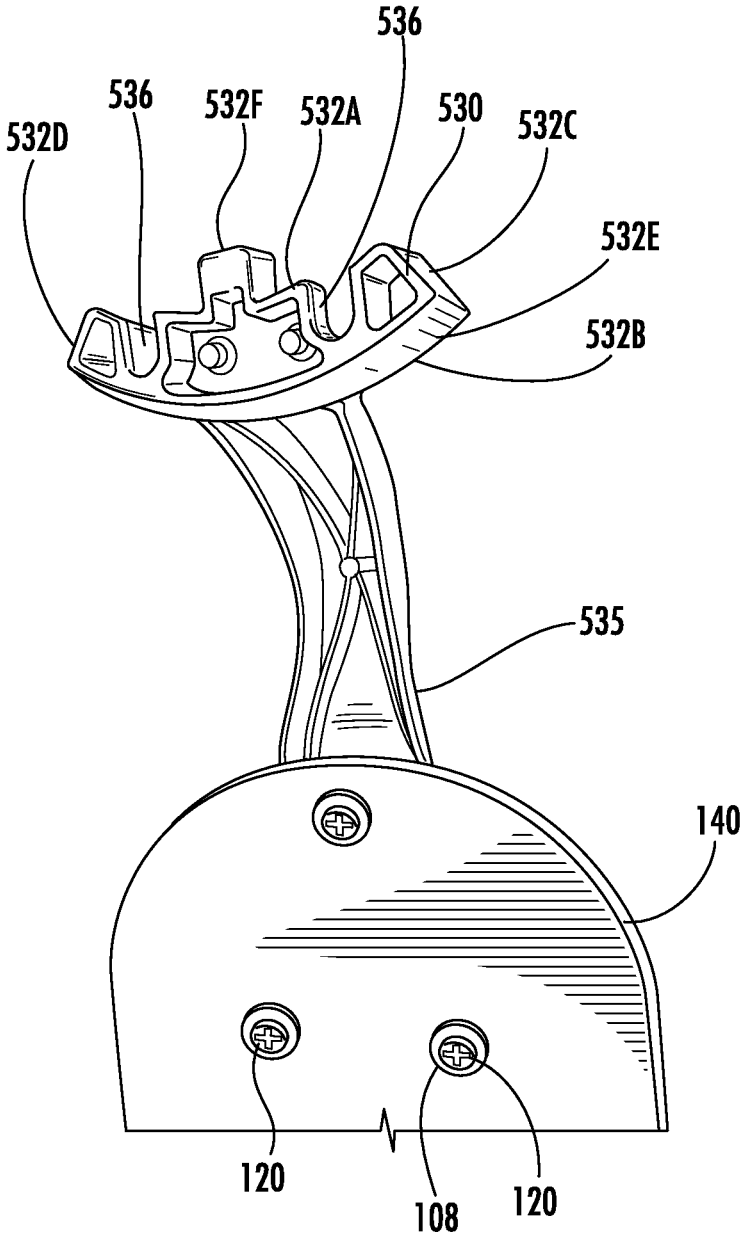
Figure 14B:
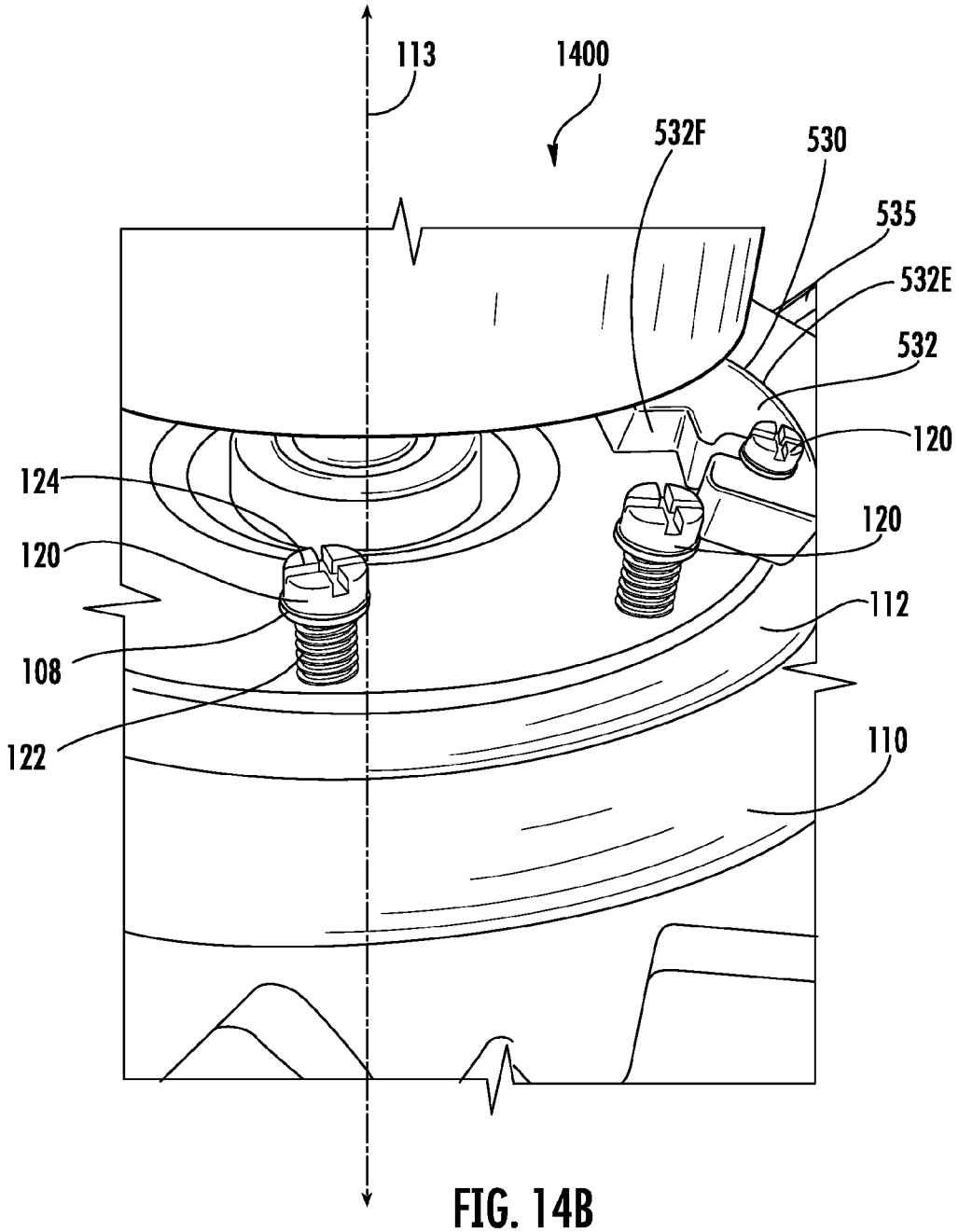
Figure 15:
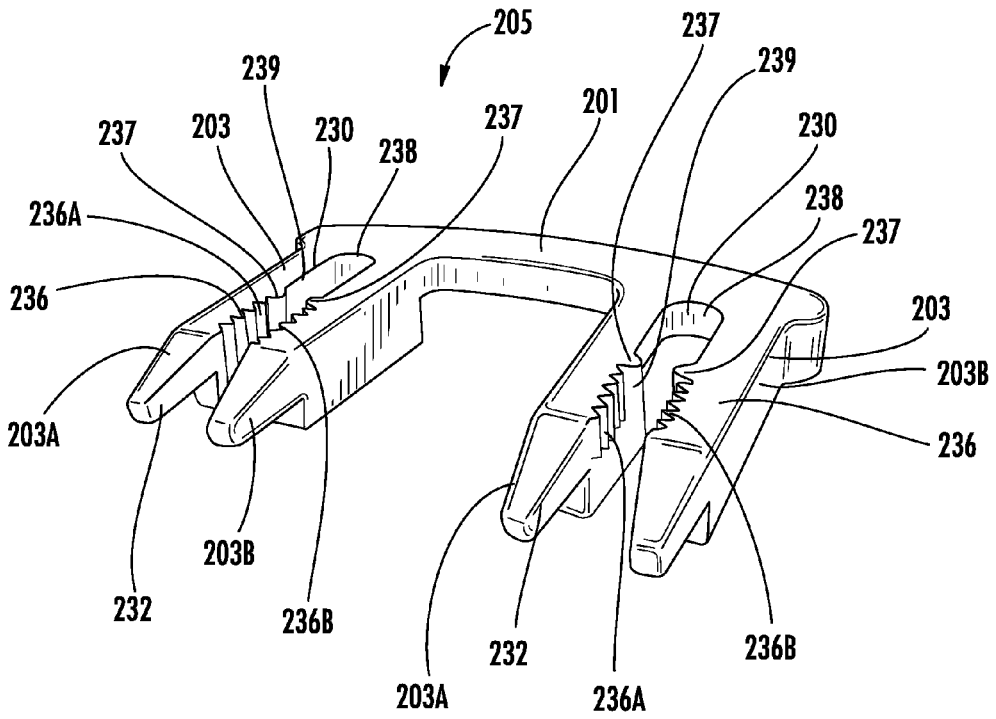
Figure 15A:
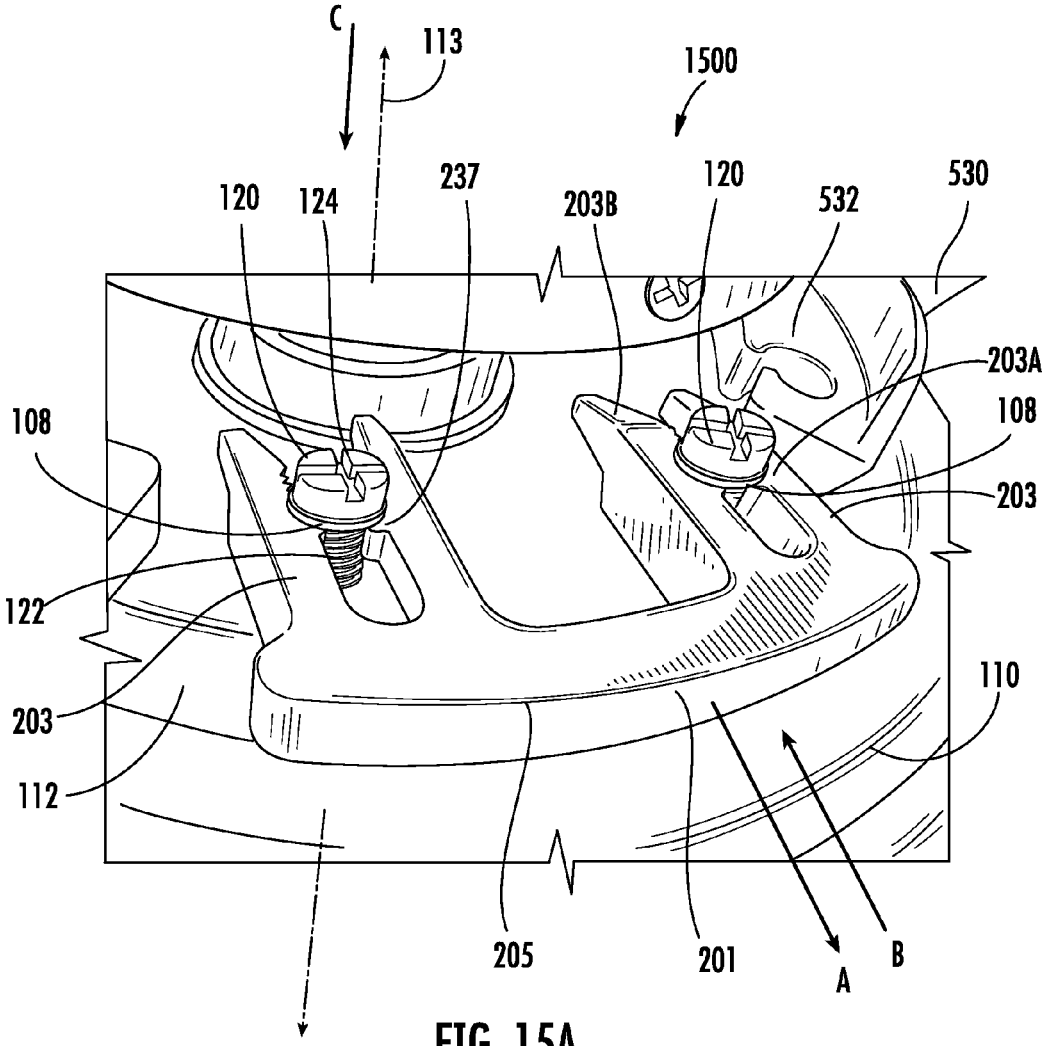

Having thus described embodiments of the invention in general terms, reference will now be made to the accompanying figures, which are not necessarily drawn to scale, and wherein:

FIG. 1 illustrates a perspective view of a fan assembly, in accordance with a first embodiment of the present invention;

FIG. 2 illustrates an elevational and partial cross-sectional view of a fan assembly, in accordance with a second embodiment of the present invention;

FIG. 2A illustrates another elevational and partial cross-sectional view of the fan assembly shown in FIG. 2, in accordance with the second embodiment of the present invention;

FIG. 2B illustrates another elevational and partial cross-sectional view of the fan assembly shown in FIG. 2, in accordance with the second embodiment of the present invention;

FIG. 3 illustrates a perspective view of a blade arm of a fan assembly, in accordance with a third embodiment of the present invention;

FIG. 3A illustrates a side view of the blade arm shown in FIG. 3, in accordance with the third embodiment of the present invention;

FIG. 3B illustrates a top plan view of the blade arm shown in FIG. 3, in accordance with the third embodiment of the present invention;

FIG. 4 illustrates a perspective view of a plate positioned relative to a rotational member of a fan assembly, in accordance with a fourth embodiment of the present invention;

FIG. 4A illustrates a perspective view of a blade arm of a fan assembly, in accordance with the fourth embodiment of the present invention;

FIG. 4B illustrates another perspective view of the blade arm shown in FIG. 4A, in accordance with the fourth embodiment of the present invention;

FIG. 4C illustrates a perspective view of a fan assembly that includes the blade arm shown in FIG. 4A and the plate shown in FIG. 4, in accordance with the fourth embodiment of the present invention;

FIG. 4D illustrates another perspective view of the fan assembly shown in FIG. 4C, in accordance with the fourth embodiment of the present invention;

FIG. 5 illustrates a perspective view of a fan assembly that includes a standoff, a connection member, and a rotational member, in accordance with a fifth embodiment of the present invention;

FIG. 5A illustrates an elevational and cross-sectional view of the standoff, the connection member, and the rotational member of the fan assembly shown in FIG. 5, in accordance with the fifth embodiment of the present invention;

FIG. 6 illustrates a perspective view of a fan assembly that includes a standoff, a connection member, and a rotational member, in accordance with a sixth embodiment of the present invention;

FIG. 6A illustrates an elevational and cross-sectional view of the standoff, the connection member, and the rotational member of the fan assembly shown in FIG. 6, in accordance with the sixth embodiment of the present invention;

FIG. 7 illustrates an elevational and cross-sectional view of a connection member and a raised portion of a rotational member of a fan assembly, in accordance with a seventh embodiment of the present invention;

FIG. 8 illustrates a perspective view of a fan assembly that includes a blade arm having a slot portion and a rotational member having a flange portion, in accordance with an eighth embodiment of the present invention;

FIG. 9 illustrates a perspective view of a fan assembly that includes a blade arm having a supplemental opening, in accordance with a ninth embodiment of the present invention;

FIG. 10 illustrates a perspective view of a fan assembly that includes a rotational member having a stabilizing structure, in accordance with a tenth embodiment of the present invention;

FIG. 11 illustrates a perspective view of a fan assembly that includes a blade arm defining an aperture therein, in accordance with an eleventh embodiment of the present invention;

FIG. 11A illustrates a perspective view of a blade arm and a rotational member of the fan assembly shown in FIG. 11, in accordance with the eleventh embodiment of the present invention;

FIG. 11B illustrates another perspective view of the blade arm and the rotational member of the fan assembly shown in FIG. 11, in accordance with the eleventh embodiment of the present invention;

FIG. 11C illustrates a top plan view of the blade arm of the fan assembly shown in FIG. 11, in accordance with the eleventh embodiment of the present invention;

FIG. 11D illustrates another perspective view of the blade arm and the rotational member of the fan assembly shown in FIG. 11, in accordance with the eleventh embodiment of the present invention;

FIG. 12 illustrates a perspective view of a fan assembly that includes a rotational member defining a flange portion, in accordance with a twelfth embodiment of the present invention;

FIG. 12A illustrates a bottom plan view of the fan assembly shown in FIG. 12, in accordance with the twelfth embodiment of the present invention;

FIG. 12B illustrates another perspective view of the fan assembly shown in FIG. 12, in accordance with the twelfth embodiment of the present invention;

FIG. 12C illustrates an elevational view of the rotational member and a blade arm of the fan assembly shown in FIG. 12, in accordance with the twelfth embodiment of the present invention;

FIG. 12D illustrates another perspective view of the rotational member and the blade arm of the fan assembly shown in FIG. 12, in accordance with the twelfth embodiment of the present invention;

FIG. 13 illustrates a perspective view of a fan assembly that includes a rotational member defining an outer rim portion, in accordance with a thirteenth embodiment of the present invention;

FIG. 13A illustrates another perspective view of the fan assembly shown in FIG. 13, in accordance with the thirteenth embodiment of the present invention;

FIG. 13B illustrates another perspective view of the fan assembly shown in FIG. 13, in accordance with the thirteenth embodiment of the present invention;

FIG. 13C illustrates another perspective view of the fan assembly shown in FIG. 13, in accordance with the thirteenth embodiment of the present invention;

FIG. 13D illustrates another perspective view of the fan assembly shown in FIG. 13, in accordance with the thirteenth embodiment of the present invention;

FIG. 13E illustrates another perspective view of the fan assembly shown in FIG. 13, in accordance with the thirteenth embodiment of the present invention;

FIG. 14 illustrates a perspective view of a blade arm having a tab and a rib portion, in accordance with a fourteenth embodiment of the present invention;

FIG. 14A illustrates another perspective view of the blade arm shown in FIG. 14, in accordance with the fourteenth embodiment of the present invention;

FIG. 14B illustrates a perspective view of a fan assembly, where the fan assembly includes the blade arm shown in FIG. 14, in accordance with the fourteenth embodiment of the present invention;

FIG. 15 illustrates a perspective view of a spacer, in accordance with a fifteenth embodiment of the present invention; and FIG. 15A illustrates a perspective view of a fan assembly, where the fan assembly includes the spacer shown in FIG. 15, in accordance with the fifteenth embodiment of the present invention.

DETAILED DESCRIPTION OF EMBODIMENTS OF THE PRESENT INVENTION

Embodiments of the present invention now will be described more fully herein with reference to the accompanying drawings, in which some, but not all, embodiments of the invention are shown. The present invention may be embodied in many different forms and should not be construed as limited to the embodiments set forth herein; rather, these embodiments are provided so that this disclosure will satisfy applicable legal requirements. It will be understood that, where possible, any of the advantages, features, and/or operational aspects of any of the embodiments described and/or contemplated herein may be included in any other embodiment of the present invention described and/or contemplated herein, and/or vice versa. It will also be understood that, where possible, any terms expressed in the singular form herein are meant to also include the plural form, and vice versa. Additionally, the terms "a" and/or "an" shall mean "one or more" herein, even though the phrase "one or more" may also be used herein. Like numbers and letters refer to like elements throughout.

It will be understood that, in accordance with some embodiments, the process of installing an easy install blade arm to motor connection includes one or more "operations" that result in one or more "states." Some of the embodiments described and illustrated herein disclose an installation process that results in the blade arm being positioned in an initial "support" state and/or a subsequent "secure" state. In a support state, the blade arm is supported, but not secured, relative to the motor. In a secure state, the blade arm is both supported and secured relative to the motor. It will be understood that the support state facilitates the installation of the blade arm to the motor because, for example, an installer does not need to simultaneously support a blade arm, one or more connection members (e.g., screws, etc.), and an installation tool (e.g., screwdriver, etc.) in order to secure the blade arm to the motor. It will also be understood that some of the embodiments of the present invention, as described in more detail herein, may achieve a support state and/or a secure state in the same or different ways, and/or by using the same or different components.

In addition, it will be understood that the embodiments described and illustrated herein are embodied as ceiling fan assemblies for simplicity. It will be understood, however, that the various embodiments of the present invention can be used in connection with any one or more other types of fan assemblies that involve connecting fan blades to blade arms and/or connecting blade arms to fan motors, and can be used with fan assemblies that involve the same or a different number of fan blades and blade arms from what is shown in the herein described and illustrated embodiments.

Also, it will be understood that various terms and phrases are used herein to describe various advantages, features, and/or operational aspects of the embodiments of the present invention. Sometimes different terms and phrases are used herein but different meanings are not implied. For example, the terms "opening," "aperture," and "slot" are used herein to describe various surfaces and/or structures, some of which may be similar or identical. As such, it will be understood that different meanings should not necessarily be ascribed to different terms.

First Embodiment

Referring now to FIG. 1, a perspective view of a fan assembly 100 is provided, in accordance with an embodiment of the present invention. The fan assembly 100 includes a motor housing 110, a plurality of connection members 120, a plurality of blade arms 130, and a plurality of fan blades 140. It will be understood that the motor housing 110 houses a motor (not shown) therein, and that the motor includes a rotational member 112 disposed thereon. It will also be understood that the motor delivers power to the rotational member 112, and that, when powered, the rotational member 112 rotates about a rotational axis 113.

It will be understood that, in some embodiments of the fan assembly 100, the rotational member 112 is positioned on a bottom surface of the motor housing 110, such that the blade arms 130 are positioned between the rotational member 112 and a floor surface (not shown). In such embodiments, the blade arms 130 extend downwardly and laterally away from the rotational member 112. It will also be understood that, in accordance with some embodiments, the motor housing 110 carries a support member 111 for supporting, for example, one or more light fixtures (not shown).

However, it will also be understood that, in alternative embodiments of the fan assembly 100, the rotational member 112 is positioned on a top surface of the motor housing 110, and that the motor housing 110 is suspended from a ceiling surface (not shown) by the support member 111. In such embodiments, for example, the blade arms 130 are positioned between the rotational member 112 and the ceiling surface. Additionally, in such embodiments, the blade arms 130, when in a secure state, extend upwardly and laterally away from the rotational member 112.

It will be understood that, regardless of whether the rotational member 112 is positioned on the top surface or the bottom surface (or any other surface) of the motor housing 110, the fan assembly 100 can be assembled such that a straight line passing through the motor housing 110, the rotational member 112, and one or more blade arms 130 extends in a substantially vertical direction, a substantially horizontal direction, and/or in any other direction in between. Additionally or alternatively, the fan assembly 100 can be configured such that the rotational axis 113 extends through the support member 111, and/or such that the longitudinal axis of the support member 111 is substantially collinear with the rotational axis 113. Further, the fan assembly 100 can be additionally or alternatively assembled such that the longitudinal axis of the support member 111 is substantially perpendicular to the rotational member 112.

It will also be understood that each of the plurality of connection members 120 shown is sized, dimensioned, shaped, configured, constructed, manufactured, built, designed, made, and/or structured (collectively referred to herein as "structured" for simplicity) for connection to the rotational member 112. Specifically, the rotational member 112 defines a plurality of apertures 114 (e.g., holes, bores, slots, recesses, depressions, hollows, etc.) that are spaced about the rotational axis 113, and each aperture 114 is structured to receive a corresponding connection member 120 at least partially therein. It will be understood that, when a connection member 120 is received within a corresponding aperture 114, the connection member 120 can be fastened, tightened, moved, positioned, and/or urged (collectively referred to herein as "urged" for simplicity) into, away from, within, and/or otherwise relative to the aperture 114. It will also be understood that each of the connection members 120 can be urged within the aperture 114 between a relatively "loosened" state and a relatively "tightened" state. It will be understood that less of the connection member 120 is positioned outside of the aperture 114 in a relatively tightened state than when the connection member 120 is positioned in a relatively loosened state. It will also be understood that the connection members 120 illustrated in FIG. 1 are positioned in a relatively loosened state.

In some embodiments of the fan assembly 100, the connection member 120 is additionally or alternatively configured to have at least a first position and a second position. In some embodiments, when in the first position, the head portion 124 of the connection member 120 is spaced apart from the rotational member 112 at a distance greater than a dimension of the blade arm 130, such that, when the blade arm 130 is positioned (e.g., preliminarily installed, etc.) relative to the rotational member 112, the head portion 124 of the connection member 120 rests against the blade arm 130 to support the blade arm 130 relative to the rotational member 112. In some embodiments, when in the second position, the head portion 124 of the connection member 120 is spaced apart from the rotational member 112 at a distance approximating a dimension of the blade arm 130, such that, when the blade arm 130 is connected to the rotational member 112, the head portion 124 of the connection member 120 applies a force against the blade arm 130 sufficient to secure the blade arm 130 relative to the rotational member 112.

It will be understood that, in accordance with some embodiments, the connection member 120 is positioned in a relatively loosened state when the connection member 120 is positioned in the first position. Additionally or alternatively, in accordance with some embodiments, the connection member 120 is positioned in a relatively tightened state when the connection member 120 is positioned in the second position. Also, in accordance with some embodiments, the blade arm 130 is positioned in a support state when the connection member 120 is positioned in the first position. Additionally or alternatively, in accordance with some embodiments, the blade arm 130 is positioned in a secure state when the connection member 120 is positioned in the second position.

In some embodiments, one or more of the connection members 120 are captively received in corresponding apertures 114, such that each captive connection member 120 may be urged within and relative to a corresponding aperture 114, but can not be removed from that aperture 114. This feature may eliminate the possibility that the connection members 120 will fall out or become lost during the installation or operation of the fan assembly 100. It will also be understood that, in some embodiments, the captive connection members 120 are also pre-installed on the rotational member 112, thereby eliminating the need to connect the connection members 120 to the rotational member 112 at the point of installation. The use of captive and/or pre-installed connection members 120 facilitates the installation process because an installer does not need to simultaneously support the blade arm 130, the connection member 120, and an installation tool (not shown) in order to secure the blade arm 130 to the rotational member 112. In other words, the pre-installed and/or captive connection member 120 enables an installer to position the blade arm 130 relative to the connection member 120 in such a way that the blade arm 130 remains preliminarily supported by the head portion 124, so that an installer can urge the connection member 120 (and/or the head portion 124) into a tightening state and/or the second position without the installer needing to manually hold the blade arm 130.

Additionally, in accordance with some embodiments, as shown in FIG. 1, each connection member 120 includes a body portion 122 and a head portion 124. The body portion 122 of the connection member 120 is embodied as an elongate body, and the head portion 124 is embodied as a protuberance disposed on an end of that elongate body. In some embodiments, as shown in FIG. 1, each of the connection members 120 is embodied as a round head screw having a protuberant, round head portion 124 and a cylindrical, elongate body portion 122. As shown, the diameter of the protuberant, round head portion 124 is greater than the diameter of the cylindrical, elongate body portion 122. Although not shown in FIG. 1, it will be understood that, in some embodiments, the elongate body portion 122 of each connection member 120 includes a threaded portion, and that each of the corresponding apertures 114 in the rotational member 112 includes a corresponding threaded portion, such that each threaded connection member 120 may be screwed into, away from, within, and/or otherwise relative to a corresponding threaded aperture 114. It will also be understood that, in such embodiments, a screwdriver or other installation tool (not shown) is typically used for urging the connection member 120 relative to the aperture 114 and/or rotational member 112.

Further, each of the plurality of blade arms 130 illustrated in FIG. 1 includes a first connection portion 132, an elongate portion 135, and a second connection portion 134. The first connection portion 132 of the blade arm 130 is structured to connect the blade arm 130 to the rotational member 112 of the motor by using one or more of the connection members 120. The second connection portion 134 of the blade arm 130 is structured to connect the blade arm 130 to the fan blade 140. The elongate portion 135 of the blade arm 130 extends between the first connection portion 132 and the second connection portion 134. It will be understood that, when the blade arm 130 is secured to the rotational member 112 at a location between the rotational member 112 and the ceiling surface, the elongate portion 135 of the blade arm 130 extends from a location near the first connection portion 132 to a location near the second connection portion 134 in a direction away from the rotational member 112. Additionally, as shown in FIG. 1, the elongate portion 135 can be configured to taper inwardly from a location near the first connection portion 132 to a location near the middle of the elongate portion 135. The structure of the blade arm enables access to the location where the blade arm 130 cooperates with the connection member 120, thereby facilitating the installation of the blade arm 130 to the rotational member 112.

Also shown in FIG. 1, the first connection portion 132 of each blade arm 130 defines a generally wedge-shaped body having a first end portion 132A, a second end portion 132B, a first side portion 132C, and a second side portion 132D. The body of the first connection portion 132 tapers inwardly from the second end portion 132B towards the first end portion 132A, such that the length of the second end portion 132B is greater than the length of the first end portion 132A. Also, when the blade arms 130 are installed to the rotational member 112, the first side portion 132C of the first connection portion 132 of a first blade arm 130 is structured to cooperatively mate with the second side portion 132D of the first connection portion 132 of a second blade arm 130 that is positioned adjacent to the first blade arm 130. Thus, adjacent blade arms 130, once installed on the rotational member 112, laterally support each other around the axis of rotation 113, thereby creating desired alignment and restricting movement of the blade arms 130 relative to the connection members 120 and/or the rotational member 112. This feature also facilitates the process of installing the blade arms 130 to the rotational member 112 as the side portions 132C, 132D of the first connection portion 132 of an already-installed blade arm 130 provide sliding surfaces for guiding adjacent blade arms 130 into position relative to corresponding connection members 120 and/or the rotational member 112.

FIG. 1 also illustrates that, in some embodiments, the first connection portion 132 of the blade arm 130 defines at least two openings 136 therein. As shown in the illustrated embodiment, each opening 136 is embodied as a generally concave surface (e.g., groove, slot, recess, nook, depression, pit, niche, hollow, concavity, etc.) that extends into the first end portion 132A of the first connection portion 132. As shown in FIG. 1, in accordance with some embodiments, each opening 136 includes an open end portion 137, a closed end portion 138, an optional elongate portion 139, and an optional recessed portion 133. The open end portion 137 of the opening 136 is positioned at or near the first end portion 132A of the first connection portion 132 of the blade arm 130. The closed end portion 138 is positioned on the first connection portion 132 of the blade arm 130 at a location between the open end portion 137 of the opening 136 and the second connection portion 134 of the blade arm 130. Further, the elongate portion 139 of the opening 136 extends between the open end portion 137 and the closed end portion 138, and, as shown in FIG. 1, the recessed portion 133 is positioned at or near the closed end portion 138 of the opening 136.

Each opening 136 has a length that generally extends from the open end portion 137 of the opening 136 to the closed end portion 138 of the opening 136. As shown in FIG. 1, when a bottom surface of the first connection portion 132 of the blade arm 130 is positioned substantially flush with a top surface of the rotational member 112, the length of each opening 136 extends in a direction that is substantially perpendicular to the rotational axis 113. As also shown, in some embodiments, both of the openings 136 on a single blade arm 130 are identically structured. In some embodiments, as shown in FIG. 1, both of the openings 136 on a single blade arm 130 extend into the blade arm 130, such that each of the two openings 136 extends in a direction that is substantially parallel to a direction in which the other extends. In other words, in some embodiments, an opening 136 on a single blade arm 130 is parallel with the other opening 136 on that same blade arm 130. It will be understood, however, that the two openings 136 on the same blade arm 130 could extend at an angle relative to each other.

FIG. 1 also shows that the optional recessed portion 133 of the opening 136 extends "transversely" into the opening 136, which means that the recessed portion 133 generally extends into the opening 136 at an angle relative to the length of the opening 136. In some embodiments, as shown in FIG. 1, the recessed portion 133 of the opening 136 extends into the opening 136 in a direction that is substantially perpendicular to the length of the opening 136. However, it will be understood that, in other embodiments of the fan assembly 100 not shown, the recessed portion 133 extends transversely into the opening 136 in any direction into the opening.

FIG. 1 further illustrates that the optional recessed portion 133 of each opening 136 is structured to interface with the head portion 124 of a corresponding connection member 120. In some embodiments, the structure of the recessed portion 133 of the opening 136 substantially conforms to the structure of the head portion 124 of the connection member 120. For example, in some embodiments, the head portion 124 of the connection member 120 has a round structure and the recessed portion 133 of the opening 136 has a corresponding substantially frusto-conical structure. In such embodiments, the round head portion 124 of the connection member 120 is structured to fit at least partially into the substantially frusto-conical recessed portion 133 of the opening 136. Thus, the head portion 124 can be urged towards and/or into the recessed portion 133, such that the head portion 124 closely fits against the recessed portion 133, thereby providing a more secure connection between the blade arm 130 and the rotational member 112.

In some embodiments, such as the one shown in FIG. 1, each opening 136 is structured to substantially resemble a keyhole slot having an open end portion 137. More specifically, the opening 136 has a substantially rectangular shape from the open end portion 137, through the elongate portion 139, and up to about the recessed portion 133. At the recessed portion 133, which is positioned in FIG. 1 at or near the closed end portion 138, the opening 136 has a substantially circular shape. Further, the diameter of the substantially circular shape of the opening 136 can be greater than the width of the substantially rectangular shape of the opening 136.

FIG. 1 also shows that each opening 136 is structured to receive the body portion 122 of a connection member 120 therein. In particular, in some embodiments, each opening 136 is structured so that the body portion 122 of a connection member 120 can enter the open end portion 137 of the opening 136, move through the elongate portion 139, and terminate (and/or remain) at or near the recessed portion 133 and/or the closed end portion 138. Accordingly, in such embodiments, the diameter (or width) of the body portion 122 of the connection member 120 is less than the width of the open end portion 137 of the opening 136, less than the width of the elongate portion 139, and less than the diameter (or width) of the recessed portion 133. As also shown in FIG. 1, in some embodiments, the diameter (or width) of the head portion 124 of the connection member 120 is greater than the width of the open end portion 137, greater than the width of the elongate portion 139, and greater than the diameter (or width) of at least a bottom portion of the recessed portion 133 of the opening 136. Thus, it will be understood that, in such embodiments, the head portion 124 of the connection member 120 cannot pass entirely and transversely through any portion of the opening 136.

It will be understood that the process of installing the blade arm 130 to the rotational member 112 typically includes at least two operations: (1) positioning the blade arm 130 relative to a connection member 120 to achieve a support state; and (2) urging the connection member 120 relative to the rotational member 112 to achieve a secure state. In a support state of the illustrated embodiment, the connection member 120 is positioned in a relatively loosened state, the connection member 120 is positioned in a first position, and/or the head portion 124 of the connection member 120 cooperates with the recessed portion 133 of the opening 136, such that the blade arm 130 is supported relative to the rotational member 112 of the motor. In a secure state of the illustrated embodiment, the connection member 120 is positioned in a relatively tightened state, the connection member 120 is positioned in the second position, and/or the head portion 124 of the connection member 120 at least partially bears against (e.g., abuts, touches, applies a force to, etc.) the recessed portion 133 of the opening 136, such that the blade arm 130 is supported and secured relative to the rotational member 112 of the motor. It will be understood that, when the blade arm 130 is in a secure state, the head portion 124 of the connection member 120 at least partially bears against the blade arm 130 to prevent the blade arm 130 from becoming dislodged from the rotational member 112 during full-speed rotation of the motor.

Examples of performing the positioning and urging operations are described in detail below, but it will be understood that each of these operations may be accomplished in other ways not explicitly described herein. It will also be understood that, in some embodiments, the operations can be combined into one single operation, and that, in other embodiments, the installation of the blade arm 130 to the rotational member 112 may include one or more operations in addition to, or instead of, the operations described herein.

In some embodiments, positioning the blade arm 130 relative to the connection member 120 includes positioning the blade arm 130 relative to the connection member 120, such that the head portion 124 of the connection member 120 rests against the blade arm 130 to support the blade arm 130 relative to the rotational member 112. In some embodiments, positioning the blade arm 130 relative to the connection member 120 includes positioning the head portion 124 of the connection member 120 in relative alignment with the recessed portion 133 of the opening 136. For example, in some embodiments, this includes positioning the body portion 122 of the connection member 120 between the head portion 124 of the connection member 120 and the recessed portion 133 of the opening 136. In some embodiments where the recessed portion 133 is positioned at or near the closed end portion 138 of the opening 136, such as the embodiment shown in FIG. 1, positioning the head portion 124 in relative alignment with the recessed portion 133 includes positioning the body portion 122 of the connection member 120 at or near the closed end 138 of the opening 136.

In some embodiments, positioning the blade arm 130 relative to the connection member 120 includes sliding the opening 136 of the blade arm 130 around the body portion 122 of the connection member 120. In some embodiments, positioning the blade arm 130 relative to the connection member 120 includes sliding the blade arm 130 relative to (e.g., towards, etc.) the connection member 120, such that the body portion 122 of the connection member 120 enters the open end portion 137 of the opening 136, moves through the elongate portion 139, and then terminates (and/or remains) at or near the recessed portion 133 and/or the closed end portion 138. It will be understood that, in some of these embodiments, the opening 136 of the blade arm 130 can be slid relative to the connection member 120 in a direction that is substantially perpendicular to the direction in which the connection member 120 extends from the rotational member 112. Additionally or alternatively, in some embodiments, the opening 136 of the blade arm 130 can be slid relative to the connection member 120 in a direction that is substantially perpendicular to the rotational axis 113 of the rotational member 112.

It will also be understood that, because the recessed portion 133 extends transversely into the opening 136, the blade arm 130 can be positioned relative to a connection member 120 that is positioned in a relatively loosened state, such that the head portion 124 of that connection member 120 cooperates with the recessed portion 133 of the opening 136 to loosely support the blade arm 130 from the rotational member 112. As such, in some embodiments, the blade arm 130 can hang from the rotational member 112 even when the corresponding connection members 120 are positioned in a relatively loosened state. This feature facilitates the installation process because an installer does not need to simultaneously support the blade arm 130, the connection member 120, and an installation tool (not shown) in order to secure the blade arm 130 to the rotational member 112.

It will be understood that the specific embodiment shown in FIG. 1 depicts four blade arms 130 positioned relative to corresponding connection members 120 in a support state. FIG. 1 also shows that the head portion 124 of each of these connection members 120 is positioned in relative alignment with one of the recessed portions 133 of the openings 136. FIG. 1 also shows the body portion 122 of each of these connection members 120 being positioned between the recessed portion 133 of the opening 136 and the head portion 124 of the connection member 120. FIG. 1 further shows that the body portion 122 of the connection member 120 is positioned at or near the closed end portion 138 of the opening 136 of the blade arm 130. As mentioned previously, FIG. 1 also shows each of the connection members 120 positioned in a relatively loosened state.

Once a blade arm 130 is positioned relative to corresponding connection members 120, the blade arm 130 can be secured to the rotational member 112 by urging the connection member 120 relative to the rotational member 112, such that the head portion 124 of the connection member 120 at least partially bears against the blade arm 130 adjacent to (e.g., proximate, near, within, inside, etc.) the opening 136 defined in the blade arm 130. In some embodiments, urging the connection member 120 relative to the rotational member 112 includes urging the connection member 120 relative to the rotational member 112, such that the blade arm 130 is connected to the rotational member 112, and the head portion 124 of the connection member 120 applies a force against the blade arm 130 sufficient to secure the blade arm 130 relative to the rotational member 112.

In some embodiments, urging the connection member 120 relative to the rotational member 112 includes urging the connection member 120 relative to the rotational member 112, such that the head portion 124 of the connection member 120 at least partially bears against the recessed portion 133 of the opening 136. Specifically, in some embodiments, urging the connection member 120 relative to the rotational member 112 includes tightening the connection member 120 within the corresponding aperture 114 of the rotational member 112. In some embodiments, urging the connection member 120 relative to the rotational member 112 includes moving the connection member 120 relative to the rotational member 112 in a direction that is substantially parallel to the rotational axis 113 and/or in a direction that is substantially perpendicular to the length of the opening 136.

In some embodiments, urging the connection member 120 relative to the rotational member 112 includes urging the connection member 120 from the first position to the second position and/or from a relatively loosened state towards a relatively tightened state. Still further, in some embodiments, urging the connection member 120 relative to the rotational member 112 includes urging the head portion 124 of the connection member 120 at least partially into the recessed portion 133 of the opening 136, such that: (a) a bottom portion of the head portion 124 at least partially bears against a lower portion of the recessed portion 133, (b) the head portion 124 is substantially prevented from moving laterally within the recessed portion 133, and/or (c) the blade arm 130 is substantially prevented from being moved laterally away from the rotational member 112. In some embodiments, urging the connection member 120 relative to the rotational member 112 includes urging the connection member 120, such that the blade arm 130 is substantially clamped between rotational member 112 and the head portion 124 of the connection member 120.

Of course, it will be understood that the structure and/or installation of the fan assembly 100 described above can be different in other embodiments within the scope of the present invention. For example, in some embodiments, the opening 136 includes an open end portion 137 and a closed end portion 138, but does not include a recessed portion 133 and/or an elongate portion 139. As another example, in some embodiments, the opening 136 includes a portion extending between the open end portion 137 and the closed end portion 138, but that portion is structured differently than the elongate portion 139 depicted in FIG. 1. As another example, in some embodiments, the opening 136 extends into the first connection portion 132 of the blade arm 130 in any direction other than that shown in FIG. 1. In one such embodiment, the opening 136 extends into the first connection portion 132 of the blade arm 130, such that the open end portion 137 of the opening 136 is positioned on the second end portion 132B, and such that the open end portion 137 is positioned between the closed end portion 138 of the opening 136 and the second connection portion 134 of the blade arm 130.

As still another example of how the embodiment of the fan assembly 100 shown in FIG. 1 can be different in other embodiments within the scope of the present invention, in some embodiments, one or more of the connection members 120 extend from the rotational member 112 in a direction that is not substantially parallel to the axis of rotation 113. For example, in some embodiments, one or more of the connection members 120 extend laterally away from a side of the rotational member 112, such that those one or more connection members 120 are substantially perpendicular to the axis of rotation 113. As a further example, in some embodiments, an opening 136 on a single blade arm 130 is not parallel with another opening 136 on that same blade arm 130; instead, each opening 136 is positioned on the blade arm 130 at an angle with respect to the others.

Also, in some alternative embodiments, instead of the connection members 120 embodied as round head screws, as shown in the embodiment illustrated in FIG. 1, one or more of the connection members 120 are embodied as another kind of screw, and/or are embodied as nails, rivets, plugs, and/or other types of fasteners. In some embodiments, a tool may be required to fasten a connection member 120 to the rotational member 112, such as, for example, a screwdriver, hammer, wrench, pliers, and/or the like. However, in other embodiments, one or more of the connection members 120 may be fastened to the rotational member 112 without the use of a tool, such as, for example, in embodiments where one or more of the connection members 120 are embodied as thumb screws or some other kind of toolless fastener.

Second Embodiment

Referring now to FIGS. 2-2B, a series of views of a fan assembly 100A is provided, in accordance with an embodiment of the present invention. It will be understood that the fan assembly 100A is an alternative embodiment of the fan assembly 100 illustrated in FIG. 1. It will also be understood that the fan assembly 100A is generally similar to the fan assembly 100, except that, as shown in FIGS. 2-2B, the fan assembly 100A includes a clip 105 that can be used to secure the rotational member 112 relative to the motor housing 110 during transportation and/or installation of the fan assembly 100A.

More specifically, in accordance with some embodiments, the clip 105 is structured to engage the connection member 120 and/or the motor housing 110 in order to impede and/or prevent the rotational member 112 from moving relative to the motor housing 110. It will be understood that, in some embodiments, as shown in FIG. 2, the clip 105 is structured to engage the connection member 120 in place of the blade arm 130, but in other embodiments not shown, the clip 105 is structured to engage the connection member 120 at the same time as the blade arm 130 is engaging the connection member 120.

As shown in FIG. 2, in accordance with some embodiments, the clip 105 can be disengaged from the connection member 120 and/or the motor housing 110 by, for example, sliding the clip 105 laterally away from the support member 111 in the direction A. Once the clip 105 has been removed from the fan assembly 100A, the blade arm 130 can be positioned relative to the connection member 120 by, for example, sliding the blade arm 130 laterally towards the support member 111 in the direction B shown in FIG. 2A. Then, once the blade arm 130 is positioned relative to the connection member 120, the blade arm 130 can be secured to the rotational member 112 by, for example, urging the connection member 120 relative to (e.g., towards, etc.) the rotational member 112 in the direction C shown in FIG. 2B. As mentioned previously, in some embodiments, urging the connection member 120 relative to the rotational member 112 includes urging the connection member 120 from the first position to the second position and/or from a relatively loosened state towards a relatively tightened state. As also mentioned previously, where the connection member 120 is embodied as a screw, as shown in FIGS. 2-2B, a screwdriver may be used to urge the connection member 120 relative to the rotational member 112.

Third Embodiment

Referring now to FIGS. 3-3B, a series of views of a blade arm 130A is provided, in accordance with an embodiment of the present invention. It will be understood that the blade arm 130A is an alternative embodiment of the blade arm 130 of the fan assembly 100 illustrated in FIG. 1. It will also be understood that the blade arm 130A is generally similar to the blade arm 130, except that, as shown in FIGS. 3-3B, the blade arm 130A includes a rib portion 132E and a chamfer portion 132F, and the opening 136 of the blade arm 130A includes a first recessed portion 137A and a second recessed portion 138A.

As shown in FIGS. 3 and 3B, in accordance with some embodiments, the rib portion 132E is positioned at and/or near the second end portion 132B of the first connection portion 132 of the blade arm 130A. In some embodiments, as shown in FIG. 3, the rib portion 132E extends away from the first connection portion 132 in a direction that is substantially perpendicular to the length of the opening 136. In other words, in some embodiments, the rib portion 132E serves to extend the surface area of the second end portion 132B of the first connection portion 132 of the blade arm 130A. As such, in embodiments where the blade arm 130A is used with a motor housing that includes an overhang portion having an inside surface (e.g., the motor housing 110 of FIG. 4 that includes the overhang portion 118 having the inside surface 118A, etc.), the rib portion 132E is structured such that it and/or the second end portion 132B can substantially conform to and/or abut (or nearly abut) the inside surface of the overhang portion. In such embodiments, when the blade arm 130A is in a secure state, the overhang portion and the rib portion 132E cooperate to prevent the blade arm 130A from sliding laterally away from the rotational member of the motor housing.

As shown in FIG. 3A, in accordance with some embodiments, the chamfer portion 132F is positioned at and/or near the first end portion 132A of the first connection portion 132 of the blade arm 130A. In some embodiments, as shown in FIG. 3A, the chamfer portion 132F is structured such that the first connection portion 132 has a first height H1 at a first point along the chamfer portion 132F and a second height H2 at a second point along the chamfer portion 132F, where the second height H2 is greater than the first height H1. Additionally or alternatively, in some embodiments, the chamfer portion 132F tapers outwardly from a first point positioned at and/or near the first end portion 132A to a second point positioned at an/or near a location between the first point and the second end portion 132B. In such embodiments, it will be understood that the chamfer portion 132F can serve to facilitate installation of the blade arm 130A onto a fan assembly. For example, in embodiments where a fan assembly includes a rotational member and a connection member having a protuberant head portion (e.g., the fan assembly 100 illustrated in FIG. 1 that includes the rotational member 112 and the connection member 120, etc.), the reduced height of the first connection portion 132 at and/or near the first end portion 132A enables an installer to more easily fit the leading edge (i.e., the first end portion 132A) of the blade arm 130A between the protuberant head portion of the connection member and the rotational member.

As shown in FIGS. 3 and 3B, the first recessed portion 137A is positioned in the opening 136 at and/or near the open end portion 137. Also, in accordance with some embodiments, the first recessed portion 137A is positioned at and/or near the first end portion 132A of the first connection portion 132 of the blade arm 130A. As also shown in FIGS. 3 and 3B, the second recessed portion 138A is positioned in the opening 136 at and/or near the closed end portion 138. Also, in accordance with some embodiments, the second recessed portion 138A is positioned between the first recessed portion 137A and the second end portion 132B of the first connection portion 132 of the blade arm 130A.

It will be understood that, in accordance with some embodiments, the first recessed portion 137A and the second recessed portion 138A both extend transversely into the opening 136. In other words, each of the first recessed portion 137A and the second recessed portion 138A generally extends into the opening 136 at an angle relative to the length of the opening 136. It will be understood that, in some embodiments, the first recessed portion 137A and the second recessed portion 138A extend into the opening 136 at different angles relative to each other, whereas in other embodiments, the recessed portions extend into the opening 136 in parallel with each other. In some embodiments, as shown in FIGS. 3 and 3B, both the first recessed portion 137A and the second recessed portions 138A extend into the opening 136 in a direction that is substantially perpendicular to the length of the opening 136.

Also, as shown in FIGS. 3 and 3B, in accordance with some embodiments, the second recessed portion 138A extends transversely further into the opening 136 than the first recessed portion 137A. In other words, in some embodiments, the first recessed portion 137A and the second recessed portion 138A are structured such that the first connection portion 132 has a third height H3 at a third point along the first recessed portion 137A and a fourth height H4 at a fourth point along the second recessed portion 138A, where the third height H3 is greater than the fourth height H4. In addition to transversely extending into the opening 136 by different amounts, in some embodiments, as shown in FIG. 3, the first recessed portion 137A extends transversely into the opening 136 by substantially the same amount along the length of the opening 136 defining the first recessed portion 137A, and the second recessed portion 138A extends transversely into the opening 136 by substantially the same amount along the length of the opening 136 defining the second recessed portion 138A. In other words, in some embodiments, the recessed portion 137A and the recessed portion 138A are on different "levels" within the opening 136.

Additionally or alternatively, in some embodiments, the first recessed portion 137A is structured such that the first connection portion 132 has a fifth height at a fifth point positioned on the first connection portion 132, outside of the opening 136, and at and/or near the first end portion 132A. In such embodiments, the fifth height H5 is greater than the third height H3, and the third height H3 is greater than the fourth height H4. Additionally or alternatively, in some embodiments, the portion of the connection member 132 defining the fifth height H5 is on a different "level" than the portion of the connection member 132 defining the first recessed portion 137A and/or the portion defining the second recessed portion 138A.

FIGS. 3 and 3B further illustrate that the first recessed portion 137A and the second recessed portion 138A are structured to facilitate installation of the blade arm 130A onto a fan assembly. For example, in embodiments where a fan assembly includes a rotational member and a connection member having a protuberant head portion (e.g., the fan assembly 100 illustrated in FIG. 1 that includes the rotational member 112 and the connection member 120, etc.), the reduced height of the first connection portion 132 at and/or near the first recessed portion 137A enables an installer to more easily fit the leading edge (i.e., the first end portion 132A) of the blade arm 130A between the protuberant head portion of the connection member and the rotational member. Additionally, in such embodiments, the reduced height of the first connection portion 132 at and/or near the second recessed portion 138A provides for a more secure interface between the blade arm 130A and the head portion of the connection member. More specifically, when the body portion of the connection member is positioned in the second recessed portion 138A and is urged from a relatively loosened state towards a relatively tightened state, the head portion of the connection member can abut the second recessed portion 138A of the opening 136, such that the blade arm 130A is prevented, by the difference in the third height H3 and fourth height H4 of the first connection member 132, from sliding laterally away from the rotational member. In addition, when compared to the opening 136 shown in FIG. 1, the reduced height of the first connection portion 132 at the first recessed portion 137A provides additional clearance for the head portion of a connection member to fit within the opening 136. As such, this structure enables an installer to use relatively short connection members to install the blade arm 130A onto a fan assembly, thereby reducing or eliminating the possibility that the connection members interfere with the internal components of the motor housing (e.g., the motor, etc.).

Fourth Embodiment

Referring now to FIGS. 4-4D, a series of views of a fan assembly 100B is provided, in accordance with an embodiment of the present invention. It will be understood that the fan assembly 100B is an alternative embodiment of the fan assembly 100 illustrated in FIG. 1. It will also be understood that the fan assembly 100B is generally similar to the fan assembly 100, except that, as shown in FIGS. 4-4D, the fan assembly 100B includes a plate 103, the rotational member 112 includes an overhang portion 118, the blade arm 130B includes a groove portion 132G, and the opening 136 of the blade arm 130B includes a recessed portion 137B.

As shown in FIGS. 4, 4C, and 4D, the overhang portion 118 of the motor housing 110 includes an inside surface 118A that extends in a direction substantially perpendicular to the rotational member 112 and/or parallel with the rotational axis of the rotational member 112 (not shown). It will be understood that the overhang portion 118 is structured such that the rib portion 103A of the plate 103 substantially conforms to and/or abuts (or nearly abuts) the inside surface 118A of the overhang portion 118 when the plate 103 is secured to the rotational member 112.

As also shown in FIGS. 4, 4C, and 4D, the plate 103 includes a rib portion 103A, apertures 103B, a first end portion 103C, and a second end portion 103D. In some embodiments, as shown in FIGS. 4, 4C, and 4D, the rib portion 103A is positioned at and/or near the second end portion 103D, and the rib portion 103A extends away from the plate 103 in a direction that is substantially perpendicular to the width of the plate 103 (i.e., a straight line drawn from the first end portion 103C to the second end portion 103D). It will be understood that, in some embodiments, the plate 103 is secured to the rotational member 112 using the connection members 120, but that, in other embodiments, the plate 103 is secured to the rotational member 112 by one or more adhesives, welds, and/or the like. It will also be understood that, in some embodiments, the motor housing 110 is at least partially preassembled, such that the plate 103 is secured to the rotational member 112 before the connection members 120 and/or the blade arms 130B are attached to the rotational member 112. Further, in some embodiments, the plate 103 is embodied as a stamped metal plate, but it will be understood that, in other embodiments, the plate 103 can be manufactured in some other way and/or can include one or more other materials.

As shown in FIG. 4B, the groove portion 132G of the blade arm 130B is positioned at and/or near the bottom surface of the first connection portion 132 of the blade arm 130B and/or at and/or near the second end portion 132B of the first connection portion 132. In some embodiments, as shown in FIG. 4B, the groove portion 132G tapers inwardly from a first point positioned at and/or near the second end portion 132B to a second point positioned at an/or near a location between the first point and the first end portion 132A. It will be understood that the groove portion 132G is structured such that the groove portion 132G substantially conforms to and/or abuts (or nearly abuts) the rib portion 103A of the plate 103 when, as shown in FIG. 4D, the blade arm 130B is secured to the plate 103 by the connection members 120. It will also be understood that, when the blade arm 130B is positioned in a secure state, the groove portion 132G and the rib portion 103A cooperate to prevent the blade arm 130B from sliding laterally away from the connection members 120.

As shown in FIGS. 4A-4D, in accordance with some embodiments, the opening 136 defines the recessed portion 137B, such that the recessed portion 137B extends along the length of the opening 136 from approximately the open end portion 137 to the closed end portion 138. In addition, the recessed portion 137B extends transversely into the opening 136, which means that the recessed portion 137B generally extends into the opening 136 at an angle relative to the length of the opening 136. In some embodiments, as shown in FIGS. 4A-4D, the recessed portion 137B extends transversely into the opening 136 in a direction that is substantially perpendicular to the length of the opening 136. Also, in some embodiments, as shown in FIGS. 4A-4D, the recessed portion 137B extends transversely into the opening 136 by substantially the same amount along the length of the opening 136 that defines the recessed portion 137B (i.e., the recessed portion 137B is on the same "level").

It will be understood that, in accordance with some embodiments, the recessed portion 137B is structured to facilitate installation of the blade arm 130B onto the fan assembly 100B. Specifically, the reduced height of the first connection portion 132 at and/or near the recessed portion 137B enables an installer to more easily fit the leading edge (i.e., the first end portion 132A) of the blade arm 130B between the plate 103 and the head portions 124 of the connection members 120. (In addition, in some embodiments, the blade arm 130B includes a chamfer portion 132F to further facilitate this installation.) It will be understood that, when compared to the opening 136 shown in FIG. 1, the reduced height of the first connection portion 132 at the recessed portion 137B provides additional clearance for the head portion 124 of the connection member 120 to fit within the opening 136. As such, this structure enables an installer to use relatively short connection members 120 to install the blade arm 130B onto the fan assembly 100B, thereby reducing or eliminating the possibility that the connection members 120 interfere with the internal components of the motor housing 110 (e.g., the motor, etc.).

In some embodiments, the installation of the blade arm 130B onto the rotational member 112 of the fan assembly 100B includes: (a) securing the plate 103 to the rotational member 112, such that the rib portion 103A of the plate 103 abuts or nearly abuts the inside surface 118A of the overhang portion 118 and/or such that the apertures 103B of the plate 103 substantially align with the apertures 114 of the rotational member 112; (b) positioning the blade arm 130B relative to the plate 103, such that the rib portion 103A of the plate 103 abuts or nearly abuts the groove portion 132G of the blade arm 130B and/or such that the apertures 103B of the plate 103 substantially align with the openings 136 of the blade arm 130B; and/or (c) screwing the connection members 120 into the apertures 103B of the plate 103 and into the apertures 114 of the rotational member 112, such that the head portions 124 fits closely against the recessed portions 137B and/or such that the blade arm 130B is secured relative to the rotational member 112. Any one or all of the foregoing steps (a)-(c) can be performed as pre-installation steps (e.g., before the fan assembly 100B is delivered to the installation site) to facilitate the aspects of installation that occur on-site and/or might be performed by a consumer or end-user. It will be understood that this installation process may be different in other embodiments of the present invention. For example, in some embodiments, the installation may include screwing the connection members 120 at least partially into the apertures 103B of the plate 103 before positioning the blade arm 130C relative to the plate 103. Also, in some embodiments, it will be understood that, when the blade arm 130B is secured relative to the rotational member 112, the connection member 120, the recessed portion 137B, the rib portion 103A, the groove portion 132G, and the inside surface 118A of the overhang portion 118 all cooperate to impede or prevent the blade arm 130B from sliding laterally away from the rotational member 112.

It will be understood that FIG. 4 illustrates the plate 103 secured to the rotational member 112 before the blade arm 130B is installed. FIGS. 4C and 4D illustrate the blade arm 130B positioned between the head portion 124 of the connection member 120 and the plate 103. FIGS. 4C and 4D also illustrate the head portions 124 of the connection members 120 positioned at least partially in the recessed portions 137B of the openings 136. FIGS. 4C and 4D further illustrate the blade arm 130B positioned in a secure state, such that the head portions 124 of the connection members 120 at least partially bear against the blade arm's first connection portion 132 adjacent to the openings 136.

Referring to FIG. 4C, in some embodiments, the overhang portion 118 may be separate from the rotational member 112 and not rotate therewith. In this regard, the overhang portion 118 may be held stationary with the motor housing 110. During installation, the first connection portion 132 can be brought into engagement with the corresponding connection member(s) 120 and wedged against the overhang portion's inside surface 118A while the connection member(s) 120 remain in a relatively loosened state with respect to the rotational member 112. The overhang portion's inside surface 118A may provide temporary lateral support to aid in preventing the first connection portion 132 from separating from the connection member(s) 120. As the connection members 120 are tightened during installation, the blade arm's first connection portion 132 is urged against the rotational member 112 and tends to draw away from the overhang portion's inside surface 118A, which prevents the first connection portion 132 from contacting the overhang portion 118 during operation.

Fifth Embodiment

Referring now to FIGS. 5-5A, a series of views of a fan assembly 100C is provided, in accordance with an embodiment of the present invention. It will be understood that the fan assembly 100C is an alternative embodiment of the fan assembly 100 illustrated in FIG. 1. It will also be understood that the fan assembly 100C is generally similar to the fan assembly 100, except that, as shown in FIGS. 5-5A, the fan assembly 100C includes a standoff 107 and a spacer 108, and the opening 136 includes a recessed portion 138B.

It will be understood that the standoff 107 includes a lip portion 107A, a body portion 107B, and a base portion 107D. The standoff 107 also defines a bore 107F therein, which can extend partially or entirely along the length of the standoff 107. It will also be understood that, in some embodiments, the standoff 107 is double-threaded, such that the bore 107F defines an interior threaded surface 107C, and such that the base portion 107D defines an exterior threaded surface 107E. As shown in FIG. 5A, in embodiments where the aperture 114 defines an interior threaded surface, the standoff 107 can be secured to the rotational member 112 by aligning the standoff 107 with the aperture 114 and then screwing the base portion 107D of the standoff 107 into the aperture 114. In such embodiments, the exterior threaded surface 107E of the base portion 107D of the standoff 107 is structured to cooperate (e.g., mesh, abut, etc.) with the interior threaded surface of the aperture 114 in order to secure the standoff 107 relative to and/or within the aperture 114.

It will also be understood that the bore 107F of the standoff 107 is structured to receive at least a portion of a connection member 120 therein. In embodiments where the connection member 120 includes an exterior threaded surface (e.g., when the connection member 120 is embodied as a screw, etc.), the exterior threaded surface of a connection member 120 is structured to cooperate with the interior threaded surface 107C of the bore 107F in order to secure the connection member 120 relative to and/or within the standoff 107. Also, in some embodiments where the bore 107F passes through the entire length of the standoff 107, at least part of the body portion 122 of the connection member 120 can pass entirely through the bore 107F and extend at least partially into the aperture 114. In such embodiments, the exterior threaded surface of the connection member 120 is structured to cooperate with the interior threaded surface of the aperture 114 in order to secure the connection member 120 relative to and/or within the aperture 114.

It will be understood that the lip portion 107A of the standoff 107 is structured to help secure the connection member 120 and/or the standoff 107 relative to the rotational member 112. For example, in some embodiments, the lip portion 107A of the standoff 107 is structured to provide lateral support to the connection member 120 when the connection member 120 is screwed into the standoff 107 and when the standoff 107 is screwed into the aperture 114. Specifically, as shown in FIGS. 5-5A, the lip portion 107A of the standoff 107 is structured to abut the surface of the rotational member 112 when the standoff 107 is screwed into the aperture 114. Additionally, the lip portion 107A of the standoff 107 has a width (and/or diameter) that is greater than the width (and/or diameter) of the body portion 107B of the standoff 107. In addition, the lip portion 107A has a width (and/or a diameter) that is greater than the width (and/or diameter) of the aperture 114. Accordingly, when the base portion 107D of the standoff 107 is secured within the aperture 114 and when the connection member 120 is received in the standoff 107, the lip portion 107A impedes or prevents the connection member 120 from moving laterally and/or pivoting relative to the aperture 114.

Also shown in FIGS. 5-5A, the recessed portion 138B is positioned in the opening 136 and extends along the length of the opening 136 from approximately the elongate portion 139 to the closed end portion 138. In addition, the recessed portion 138B extends transversely into the opening 136, such that the recessed portion 138B extends into the opening 136 at an angle relative to the length of the opening 136. In some embodiments, as shown in FIGS. 5-5A, the recessed portion 138B extends transversely into the opening 136 in a direction that is substantially perpendicular to the length of the opening 136. Also, in some embodiments, as shown, the recessed portion 138B extends transversely into the opening 136 by substantially the same amount along the length of the opening 136 from approximately the elongate portion 139 to the closed end portion 138 (i.e., the recessed portion 138B is on the same "level").

It will be understood that the connection member 120, the standoff 107, and the recessed portion 138B all cooperate to secure the blade arm 130C to the rotational member 112. Specifically, the opening 136 of the blade arm 130C is structured to receive the standoff 107 therein, and the recessed portion 138B of the opening 136 is structured to interface with the head portion 124 of the connection member 120. In some embodiments, the structure of the recessed portion 138B substantially conforms to the structure of the head portion 124 of the connection member 120. For example, as shown in FIGS. 5-5A, the head portion 124 of the connection member 120 can have a round structure and the recessed portion 138B can have a corresponding round structure. In such embodiments, the round head portion 124 of the connection member 120 is structured to fit closely against and/or at least partially within the round recessed portion 138B.

In some embodiments, the installation of the blade arm 130C onto the rotational member 112 of the fan assembly 100C includes: (a) screwing the base portion 107D of the standoff 107 into the aperture 114; (b) positioning the blade arm 130C relative to the standoff 107, such that the standoff 107 is positioned at least partially within the closed end portion 138 of the opening 136; and/or (c) screwing the connection member 120 into the bore 107F of the standoff 107, such that the head portion 124 fits closely against the recessed portion 138B and/or such that the blade arm 130C is secured relative to the rotational member 112. It will be understood that this installation process may be different in other embodiments of the present invention. For example, in some embodiments, the installation may include screwing the connection member 120 at least partially into the bore 107F of the standoff 107 before positioning the blade arm 130C relative to the standoff 107. Also, in some embodiments, it will be understood that, when the blade arm 130C is secured relative to the rotational member 112, the recessed portion 138B of the opening 136 and the head portion 124 of the connection member 120 cooperate to impede or prevent the blade arm 130C from sliding laterally away from the rotational member 112. Any one or all of the foregoing steps (a)-(c) can be performed as pre-installation steps (e.g., before the fan assembly 100C is delivered to the installation site) to facilitate the aspects of installation that occur on-site and/or might be performed by a consumer or end-user.

It will also be understood that the use of the standoff 107 can serve several purposes. For example, as shown in FIGS. 5-5A, the standoff 107 can enable an installer to use relatively short connection members when installing the blade arm 130C onto the rotational member 112. Specifically, the standoff 107 can cooperate with a smaller connection member to serve as a longer connection member in order to secure the blade arm 130C relative to the rotational member 112. As another example, the standoff 107 can also enable an installer to use relatively long connection members to install the blade arm 130C onto the fan assembly 100C. Specifically, in some embodiments where the bore 107F extends through the entire length of the standoff 107, the standoff 107 can serve to separate the head portion of the longer connection member from the rotational member 112 and/or from the aperture 114, thereby reducing or eliminating the possibility that the longer connection members would interfere with the internal components of the motor housing (e.g., the motor, etc.).

It will also be understood that, if additional separation is preferred, one or more washers (e.g., washers, spacers, springs, wear pads, gaskets, etc.) 108 can be used, as shown in FIGS. 5-5A. The washer 108 is structured to receive the body portion of the connection member therethrough and can be positioned between the head portion of the connection member and the standoff 107 in order to increase the separation between the head portion of and the rotational member 112 and/or the aperture 114. Of course, in embodiments where either long or short connection members are used, the washer 108 can also be used, for example, to distribute loads, avoid corrosion, and/or prevent unnecessary wear, etc.

Sixth Embodiment

Referring now to FIGS. 6-6A, a series of views of a fan assembly 100D is provided, in accordance with an embodiment of the present invention. It will be understood that the fan assembly 100D is an alternative embodiment of the fan assembly 100C illustrated in FIGS. 5-5A. It will also be understood that the fan assembly 100D is generally similar to the fan assembly 100C, except that: (a) the standoff 109 of the fan assembly 100D is structured differently than the standoff 107 of the fan assembly 100C; (b) the aperture 114 defines an interior surface that is smooth and not threaded; and (c) the standoff 109 is pressed into the aperture 114 instead of being screwed into the aperture 114.

As shown in FIG. 6A, the standoff 109 includes a lip portion 109A and a body portion 109B that are similar to the corresponding features of the standoff 107 of the fan assembly 100C. Also similar, the standoff 109 defines a bore 109F therein, which can extend partially or entirely along the length of the standoff 109. As shown, the bore 109F defines an interior threaded surface 109C, but, unlike the double-threaded standoff 107, the standoff 109 is single-threaded. It will also be understood that the bore 109F is structured to receive at least a portion of a connection member 120 therein. In embodiments where the connection member 120 includes an exterior threaded surface (e.g., when the connection member 120 is embodied as a screw, etc.), the exterior threaded surface of a connection member 120 is structured to cooperate with the interior threaded surface 109C of the bore 109F in order to secure the connection member 120 relative to and/or within the standoff 109.

It will also be understood that the aperture 114 is structured to receive the standoff 109 therein. Specifically, in some embodiments, as shown in FIG. 6A, the standoff 109 can be press fit (e.g., friction fit, snap fit, interference fit, etc.) in the aperture 114 by fitting the body portion 109B of the standoff 109 through the aperture 114 until the standoff 109 is secured relative to and/or within the aperture 114. In some embodiments, the standoff 109 is secured relative to and/or within the aperture 114 when the lip portion 109A of the standoff 109 abuts or nearly abuts the surface of the rotational member 112. It will be understood that, in some embodiments, the standoff 109 is installed in the aperture 114 by using one or more tools (e.g., hammer, etc.), but that in other embodiments, the standoff 109 is installed in the aperture 114 without the use of tools. Alternatively, in some embodiments, the standoff 109 can be structured to include a threaded exterior surface that engages a correspondingly threaded version of the aperture 114 and that is located on the body portion 109B adjacent to the lip portion 109A.

It will also be understood that the standoff 109 can be structured to provide one or more of the benefits mentioned in connection with the standoff 107 of the fan assembly 100C. For example, in some embodiments, the lip portion 109A of the standoff 109 is structured to abut or nearly abut and/or otherwise conform to the surface of the rotational member 112 when the standoff 109 is fit into the aperture 114. As another example, in some embodiments, the lip portion 109A of the standoff 109 is structured to provide lateral support to the connection member 120 when the standoff 109 is secured within the aperture 114 and when the connection member 120 is secured within the standoff 109.

In some embodiments, the installation of the blade arm 130C onto the rotational member 112 of the fan assembly 100D includes: (a) fitting the body portion 109B of the standoff 109 through the aperture 114 until the lip portion 109A abuts or nearly abuts the surface of the rotational member 112; (b) positioning the blade arm 130C relative to the standoff 109, such that the standoff 109 is positioned at least partially within the closed end portion 138 of the opening 136; and/or (c) screwing the connection member 120 into the bore 109F of the standoff 109, such that the head portion 124 fits closely against the recessed portion 138B and/or such that the blade arm 130C is secured relative to the rotational member 112. It will be understood that this installation process may be different in other embodiments of the present invention. For example, in some embodiments, the installation may include screwing the connection member 120 at least partially into the bore 109F of the standoff 109 before positioning the blade arm 130C relative to the standoff 109. Also, in some embodiments, it will be understood that, when the blade arm 130C is secured relative to the rotational member 112, the recessed portion 138B and the head portion 124 of the connection member 120 cooperate to impede or prevent the blade arm 130C from sliding laterally away from the rotational member 112. Any one or all of the foregoing steps (a)-(c) can be performed as pre-installation steps (e.g., before the fan assembly 100D is delivered to the installation site) to facilitate the aspects of installation that occur on-site and/or might be performed by a consumer or end-user.

It will also be understood that the use of the standoff 109 can serve one or more of the same purposes as the standoff 107. For example, as shown in FIGS. 6-6A, the standoff 109 enables an installer to use relatively short connection members 120 when installing the blade arm 130C onto the rotational member 112. Specifically, the standoff 109 can cooperate with a smaller connection member to serve as a longer connection member in order to secure the blade arm 130C relative to the rotational member 112. As another example, the standoff 109 can also enable an installer to use relatively long connection members to install the blade arm 130C onto the fan assembly 100D. Specifically, in some embodiments where the bore 109F extends through the entire length of the standoff 109, the standoff 109 can serve to separate the head portion 124 of the connection member 120 from the rotational member 112 and/or from the aperture 114, thereby reducing or eliminating the possibility that the longer connection members could interfere with the internal components of the motor housing (e.g., the motor, etc.). Also, as with the fan assembly 100C, the fan assembly 100D can include one or more washers 108.

Seventh Embodiment

Referring now to FIG. 7, an elevational and cross-sectional view of a rotational member 115 and a connection member 120 is provided, in accordance with an embodiment of the present invention. It will be understood that the rotational member 115 is an alternative embodiment of the rotational member 112 illustrated in, for example, FIGS. 1, 4C, and 6A. It will also be understood that the rotational member 115 is generally similar to the rotational member 112, except that the rotational member 115 includes a raised portion 115A.

As shown in FIG. 7, the raised portion 115A of the rotational member 115 is positioned adjacent to and/or around the aperture 114. The raised portion 115A also has an interior threaded surface 115B that is structured to cooperate with the exterior threaded surface of the connection member 120 in order to secure the connection member 120 relative to and/or within the raised portion 115A and/or the aperture 114. In addition, when the connection member 120 is secured relative to the raised portion 115A, the raised portion 115A is structured such that the raised portion 115A extends away from the rotational member 115 and towards the head portion 124 of the connection member 120. Also, when the connection member 120 is secured relative to the raised portion 115A, the raised portion 115A extends completely around a portion of the body portion 122 of the connection member 120.

Also, it will be understood that the rotational member 115 having the raised portion 115A can serve one or more of the same purposes as the standoffs 107 and 109 illustrated in FIGS. 5-5A and FIGS. 6-6A respectively, including, for example, enabling an installer to use relatively short or relatively long connection members when installing a blade arm (e.g., the blade arm 130C, etc.) onto the rotational member 115.

Eighth Embodiment

Referring now to FIG. 8, a perspective view of a fan assembly 200 is provided, in accordance with an embodiment of the present invention. It will be understood that the fan assembly 200 provides another example of an alternative embodiment of the fan assembly 100 illustrated in FIG. 1. It will also be understood that the fan assembly 200 is generally similar to the fan assembly 100. However, as shown in FIG. 8, the rotational member 112 of the fan assembly 200 includes a plurality of flange portions 216 extending from a surface of the rotational member 112. As shown in FIG. 8 (and in FIGS. 11A and 11B), in some embodiments, one or more of the flange portions 216 have a generally L-shaped structure. Also, in some embodiments, the rotational member 112 defines one or more recessed portions 215 that are positioned below the flange portions 216 and correspond to where the flange material is cut away and uplifted from the surface of the rotational member 112. In addition, the plurality of blade arms 130 of the fan assembly 200 each include a first connection portion 132 that defines a slot portion 231.

As shown in FIG. 8, the flange portions 216 extend from a surface of the rotational member 112 and laterally in a direction away from the rotational axis 113 of the rotational member 112. The slot portion 231 of each blade arm 130 extends into a bottom surface of the first end portion 132A of the first connection portion 132 of the blade arm 130, such that the slot portion 231 has a depth (or a minor dimension) that extends substantially parallel to the two openings 136 and/or has a length (or major dimension) that extends approximately perpendicular to the two openings 136. Further, the slot portion 231 of the blade arm 130 is structured to at least partially receive the flange portion 216 of the rotational member 112 therein, such that the flange portion 216 engages a surface of the slot portion 231.

It will also be understood that, in accordance with some embodiments, the process of installing the fan assembly 200 includes one or more of the operations described above in connection with installing the fan assembly 100. For example, in some embodiments of the fan assembly 200, installing the blade arm 130 to the rotational member 112 includes at least two operations: (1) positioning the blade arm 130 relative to the connection members 120 to achieve a support state, and (2) urging the connection members 120 relative to the rotational member 112 to achieve a secure state. In a support state of the embodiment illustrated in FIG. 8, the connection members 120 are positioned in a relatively loosened state and/or in the first position, the head portions 124 of the connection members 120 cooperate with corresponding recessed portions 133 of the openings 136, and/or the flange portion 216 cooperates with the slot portion 231, such that the blade arm 130 is supported relative to the rotational member 112 of the motor. In a secure state, the connection members 120 are positioned in a relatively tightened state and/or in the second position, and/or the head portions 124 of connection members 120 at least partially bear against corresponding recessed portions 133 of the openings 136, such that the blade arm 130 is supported and secured relative to the rotational member 112 of the motor. In some embodiments, when the blade arm 130 is positioned in a secure state, the flange portion 216 cooperates with and/or at least partially bears against the slot portion 231.

It will be understood that the cooperation of the flange portion 216 and the slot portion 231 facilitates the installation of the blade arm 130 to the rotational member 112 because this structure helps to guide the blade arm 130 into position relative to the rotational member 112. This structure also provides a more secure connection between the blade arm 130 and the rotational member 112 because the interface between the flange portion 216 and the slot portion 231 supplements the interface between the openings 136 and the corresponding connection members 120.

Ninth Embodiment

Referring now to FIG. 9, a perspective view of a fan assembly 300 is provided, in accordance with an embodiment of the present invention. It will be understood that the fan assembly 300 is provided as another example of an alternative embodiment of the fan assembly 100 illustrated in FIG. 1. It will be understood that the fan assembly 300 is generally similar to the fan assembly 100. However, as shown in FIG. 9, in addition to the two openings 136, the blade arm 130 of the fan assembly 300 also defines a supplemental opening 336 therein. In accordance with some embodiments, the supplemental opening 336 is positioned between the two openings 136 on the blade arm 130. In some embodiments, the supplemental opening 336 extends into the first end portion 132A of the first connection portion 132 of the blade arm 130, such that the supplemental opening 336 is parallel with the other two openings 136.

It will be understood that, in accordance with some embodiments, the supplemental opening 336 includes one or more of the features of the openings 136 already described herein. For example, like the openings 136, the supplemental opening 336 includes an open end portion 337, a closed end portion 338, an optional elongate portion 339, and an optional recessed portion 333. As another example, each supplemental opening 336 has a length that generally extends from approximately the open end portion 337 of the supplemental opening 336 to approximately the closed end portion 338 of the supplemental opening 336. In addition, the recessed portion 333 of the supplemental opening 336 extends transversely into the supplemental opening 336, which means that the recessed portion 333 generally extends into the supplemental opening 336 at an angle relative to the length of the supplemental opening 336. However, unlike the recessed portion 133 of the opening 136 shown in FIG. 1, which is positioned at or near the closed end portion 138 of the opening 136, the recessed portion 333 of the supplemental opening 336 shown in FIG. 9 extends transversely through the supplemental opening 336 substantially all the way along the length of the supplemental opening 336. In some descriptions herein the two openings 136 of a blade arm may be referred to as the first and second openings, and the supplemental opening 336 may be referred to as the third opening.

Also like the openings 136, the supplemental opening 336 is structured to receive a connection member 120 therein. Specifically, in some embodiments, the supplemental opening 336 is structured so that the body portion 122 of a connection member 120 can enter the open end portion 337 of the supplemental opening 336, move through the elongate portion 339, and terminate at or near the closed end portion 338. Accordingly, in such embodiments, the diameter (or width) of the body portion 122 of the connection member 120 is less than the width of the open end portion 337 of the supplemental opening 336, less than the width of the elongate portion 339, and less than the diameter (or width) of the recessed portion 333. As also shown in FIG. 9, in some embodiments, the diameter (or width) of the head portion 124 of the connection member 120 is greater than the width of the open end portion 337, greater than the width of the elongate portion 339, and greater than the diameter (or width) of the bottom portion of the recessed portion 333 of the supplemental opening 336. Thus, it will be understood that, in such embodiments, the head portion 124 of the connection member 120 cannot pass entirely and transversely through any portion of the supplemental opening 336. In some embodiments, the supplemental opening 336 may be a simple bore through the arm 130 in which the connection member is inserted to provide added securement after the blade arm 130 is connected to the rotational member 112.

It will also be understood that, in accordance with some embodiments, the process of installing the fan assembly 300 includes one or more of the operations described above in connection with installing the fan assembly 100. For example, in some embodiments of the fan assembly 300, installing the blade arm 130 to the rotational member 112 includes at least two operations: (1) positioning the blade arm 130 relative to the connection members 120 to achieve a support state, and (2) urging the connection members 120 relative to the rotational member 112 to achieve a secure state. In a support state of the embodiment illustrated in FIG. 9, the connection members 120 are positioned in a relatively loosened state and/or in the first position, the head portions 124 of two of the connection members 120 cooperate with corresponding recessed portions 133 of the openings 136, and/or the head portion 124 of another connection member 120 cooperates with the recessed portion 333 of the supplemental opening 336, such that the blade arm 130 is supported relative to the rotational member 112 of the motor. In a secure state, the connection members 120 are positioned in a relatively tightened state and/or in the second position, the head portions 124 of the two connection members 120 at least partially bear against the corresponding recessed portions 133 of the openings 136, and/or the head portion 124 of the other connection member 120 at least partially bears against the recessed portion 333 of the supplemental opening 336, such that the blade arm 130 is supported and secured relative to the rotational member 112 of the motor.

It will be understood that the alternative structure illustrated in FIG. 9 facilitates the installation of the blade arm 130 to the rotational member 112 because the cooperation of a connection member 120 with the supplemental opening 336 helps to guide the blade arm 130 into position relative to the rotational member 112. This structure also provides a more secure connection between the blade arm 130 and the rotational member 112 by virtue of the interface between the connection member 120 and the supplemental opening 336, which is in addition to the interface between the openings 136 and their corresponding connection members 120. Here again, in some embodiments, the supplemental opening 336 may be a simple bore through the arm 130 in which the connection member is inserted to provide added securement after the arm is connected to the rotational member via connection of connection members 120 to openings 136.

Tenth Embodiment

Referring now to FIG. 10, a perspective view of a fan assembly 400 is provided, in accordance with an embodiment of the present invention. It will be understood that the fan assembly 400 is provided as another example of an alternative embodiment of the fan assembly 100 illustrated in FIG. 1. It will be understood that the fan assembly 400 is generally similar to the fan assembly 100. However, as shown in FIG. 10, the rotational member 112 of the fan assembly 400 includes at least one tab 417 which projects out (e.g., in a direction toward the rotational axis 413) from the first end portion 432A of the first connection portion 432 of each blade arm 430.

Each tab 417 can be structured so as to stabilize the blade arm 430 when the blade arm 430 is held in the first position (or initial support state). The tab 417 can be either an integral portion of the blade arm 430 or implemented as a separate piece connected to the blade arm 430 in a rigid manner. Such stabilization can be provided, for example, by structuring the tab 417 so that, when the first connection portion 432 is in an initial support state, the tab 417 makes contact with the rotational member 412 at a distance that is closer to the rotational axis 413 than the point where the first connection portion 432 would make contact if the tab 417 were absent. This can effectively reduce an angle between the first connection member 432 and the rotational member 412 when the first connection member 432 is placed in the initial support state and can improve the stability of blade arm 430 in that state.

In some other embodiments, the functionality provided by the tab 417 can be provided using alternative structures that achieve improved stabilization, with or without the tabs 417, and/or that effectively reduce (in the first position or the initial support state) the angle between the first connection portion 432 and the rotational member 412.

Eleventh Embodiment

Referring now to FIGS. 11-11D, a series of views of a fan assembly 500 is provided, in accordance with an embodiment of the present invention. It will be understood that the fan assembly 500 is provided as an example of an alternative embodiment of the fan assembly 200 illustrated in FIG. 8. It will be understood that the fan assembly 500 is generally similar to the fan assembly 200. However, as shown in FIG. 11, instead of the two openings 136, the plurality of blade arms 130 of the fan assembly 500 each define two apertures 533 therein.

As shown in FIGS. 11-11D, in accordance with some embodiments, each aperture 533 extends transversely into the first connection portion 132 of the blade arm 130 at a location that is proximate to the second end portion 132B. In addition, each aperture 533 includes a top portion 537 and a bottom portion 538. As shown in FIGS. 11 and 11C, in accordance with some embodiments, the aperture 533 may have a substantially recessed and/or frusto-conical structure. In some embodiments, the top portion 537 of the aperture 533 has a diameter that is greater than a diameter of the bottom portion 538 of the aperture 533, such that the aperture 533 tapers from approximately the top portion 537 to approximately the bottom portion 538. In addition, the body portion 122 of the connection member 120 has a diameter that is less than a diameter of the bottom portion 538 of the aperture 533, but the head portion 124 of the connection member 120 has a diameter that is greater than the diameter of the bottom portion of the aperture 533. As such, it will be understood that the head portion 124 of the connection member 120 cannot pass entirely through the bottom portion 538 of the aperture 533. However, in some embodiments, the top portion 537 of the aperture 533 has a diameter that is greater than the diameter of the head portion 124 of the connection member, such that the head portion 124 can be positioned at least partially within the aperture 533.

In addition, as shown in FIG. 11C, in some embodiments, the bottom portion 538 of the aperture 533 has a substantially triangular structure, which enables the aperture 533 to better retain the body portion 122 of the connection member 120 therein and/or therethrough, without requiring the use of threads in the aperture 533. For example, in some embodiments, the bottom portion 538 of the aperture 533 has a diameter that is greater than a diameter of the body portion 122 of the connection member 120, such that the body portion 122 can be fit through the bottom portion 538 of the aperture 533, so that the substantially triangular structure engages and holds the body portion 122. As such, this structure helps prevent the connection members 120 from falling out of their corresponding apertures 533 during an installation and/or operation of the fan assembly 500.

It will also be understood that, in accordance with some embodiments, the process of installing the fan assembly 500 includes one or more of the operations described above in connection with installing the fan assembly 100 and/or fan assembly 200. For example, in some embodiments of the fan assembly 500, installing the blade arm 130 to the rotational member 112 includes at least two operations: (1) positioning the blade arm 130 relative to the flange portion 216 to achieve a support state, and (2) urging the connection members 120 relative to the rotational member 112 to achieve a secure state. In a support state of the embodiment illustrated in FIG. 11, the connection members 120 are carried by the blade arm 130 within the apertures 533 and are positioned in a relatively loosened state within the apertures 533, and/or the flange portion 216 cooperates with the slot portion 231, such that the blade arm 130 is supported relative to the rotational member 112 of the motor. In a secure state, the connection members 120 are positioned in a relatively tightened state within the apertures 533 of the blade arm 130 and within the apertures 114 of the rotational member 112, and/or the head portions 124 of connection members 120 at least partially bear against the bottom portions 538 and/or top portions 537 of the apertures 533, such that the blade arm 130 is supported and secured relative to the rotational member 112 of the motor. In some embodiments, when the blade arm 130 is in a secure state, the flange portion 216 cooperates with and/or at least partially bears against the slot portion 231.

As with the fan assembly 200, it will be understood that the cooperation of the flange portion 216 and the slot portion 231 in the fan assembly 500 facilitates the installation of the blade arm 130 to the rotational member 112 because this structure helps to guide the blade arm 130 into position relative to the rotational member 112. This structure also provides a more secure connection between the blade arm 130 and the rotational member 112 because the interface between the flange portion 216 and the slot portion 231 supplements the interface between the corresponding connection members 120 and the corresponding apertures 533 and apertures 114.

Twelfth Embodiment

Referring now to FIGS. 12-12D, a series of views of a fan assembly 600 is provided, in accordance with an embodiment of the present invention. In some embodiments, as shown, the fan assembly 600 includes a motor housing 610, a plurality of connection members 620, a plurality of blade arms 630, and a plurality of fan blades 640. It will be understood that the motor housing 610 houses a motor (not shown) therein, and that the motor includes a rotational member 612 disposed thereon. It will also be understood that the motor delivers power to the rotational member 612, and that, when powered, the rotational member 612 rotates about a rotational axis 613.

As shown in FIG. 12, it will be understood that, in accordance with some embodiments, the rotational member 612 is positioned on a bottom surface of the motor housing 610, such that the plurality of blade arms 630, when in a secure state, extend downwardly and laterally away from the rotational member 612. In some of these embodiments, as shown in FIG. 12, the motor housing 610 is suspended from a ceiling surface (not shown) by a support member 611. As such, in some embodiments, the fan assembly 600 is configured such that the blade arms 630, when in a secure state, are positioned between at least part of the rotational member 612 and a floor surface (not shown). Also, in some embodiments, the rotational axis 613 extends through the support member 611, such that the longitudinal axis of the support member 611 is substantially collinear with the rotational axis 613. Additionally or alternatively, in accordance with some embodiments, the fan assembly 600 is assembled so that the longitudinal axis of the support member 611 is substantially perpendicular to the rotational member 612.

However, in accordance with other embodiments of the present invention not shown, the rotational member 612 can be positioned on a top surface of the motor housing 610, such that the plurality of blade arms 630, when in a secure state, extend upwardly and laterally away from the rotational member 612. In some of these embodiments, the blade arms 630, when in a secure state, are positioned between a ceiling surface and at least part of the rotational member 612. It will further be understood that, in accordance with some embodiments, the fan assembly 600 can be assembled such that a line passing through the motor housing 610, the rotational member 612, and one or more blade arms 630 extends in a substantially vertical direction, a substantially horizontal direction, and/or in any other direction in between.

Each of the plurality of blade arms 630 illustrated in FIGS. 12-12D includes a first connection portion 632, an elongate portion 635, and a second connection portion 634. The first connection portion 632 of the blade arm 630 is structured to connect the blade arm 630 to the rotational member 612 of the motor by using one or more of the connection members 620. The second connection portion 634 of the blade arm 630 is structured to connect the blade arm 630 to the fan blade 640. The elongate portion 635 of the blade arm 630 is structured to connect the first connection portion 632 to the second connection portion 634. It will be understood that, when the blade arm 630 is secured to the rotational member 612 at a location between the rotational member 612 and the floor surface, the elongate portion 635 of the blade arm 630 extends from a location near the first connection portion 632 to a location near the second connection portion 634 in a direction towards the floor surface (not shown) and away from the rotational member 612. Additionally, as shown in FIG. 12, the elongate portion 635 twists from approximately the first connection portion 632 to approximately the second connection portion 634, such that the fan blade 640 is oriented at an angle with respect to the floor surface and/or with respect to the rotational axis 613.

Also shown in FIG. 12, the first connection portion 632 of each blade arm 630 defines a generally wedge-shaped body having a first end portion 632A, a second end portion 632B, a first side portion 632C, and a second side portion 632D. The body of the first connection portion 632 tapers inwardly from approximately the second end portion 632B to approximately the first end portion 632A, such that the length of the second end portion 632B is greater than the length of the first end portion 632A. In addition, the first connection portion 632 of the blade arm 630 defines two apertures 633 therein that are each structured to receive a corresponding connection member 620 therein. It will be understood that, when a connection member 620 is received within a corresponding aperture 633, the connection member 620 can be urged into, away from, and/or otherwise relative to the aperture 633. It will also be understood that the each of the connection members 620 can be urged within the aperture 633 between a relatively loosened state and a relatively tightened state. It will be understood that less of the connection member 620 is positioned outside of the aperture 633 in a relatively tightened state than when the connection member 620 is positioned in a relatively loosened state. It will also be understood that, for example, the connection members 620 illustrated in FIG. 12 are positioned in a relatively tightened state and that the connection members 620 illustrated in FIG. 12C are positioned in a relatively loosened state.

In some embodiments, one or more of the connection members 620 are captively received in corresponding apertures 633, such that each captive connection member 620 may be urged within and relative to a corresponding aperture 633, but can not be removed from that aperture 633. This feature substantially eliminates the possibility that the connection members 620 will fall out or become lost during the installation of the fan assembly 600. In addition, the use of captive connection members 620 facilitates the installation process because an installer does not need to simultaneously support the blade arm 630, the connection member 620, and an installation tool (not shown) in order to secure the blade arm 630 to the rotational member 612. It will also be understood that, in some embodiments, the captive connection members 620 are pre-installed on the first connecting end 632 of the blade arm 630, thereby eliminating the need to connect the connection members 620 to the blade arm 630 at the point of installation.

Additionally, as shown in FIG. 12, each connection member 620 includes a body portion 622 and a head portion 624. The body portion 622 of the connection member 620 is embodied as an elongate body, and the head portion 624 is embodied as a protuberance disposed on an end of that elongate body. In some embodiments, as shown in FIGS. 12-12D, each of the connection members 620 is embodied as a round head screw having a protuberant, round head portion 624 and a cylindrical, elongate body portion 622. As shown, the diameter of the protuberant, round head portion 624 is greater than the diameter of the cylindrical, elongate body portion 622. In addition, as shown in FIGS. 12B and 12C, in accordance with some embodiments, the elongate body portion 622 of each connection member 620 includes a threaded portion, and each of the corresponding apertures 633 in the blade arm 630 includes a corresponding threaded portion, such that each threaded connection member 620 may be screwed into, and away from, a corresponding threaded aperture 633. Also as shown in FIGS. 12B and 12C, in accordance with some embodiments, a locking member 660, such as, for example, a lock washer, is disposed on each connection member 620 in order to better secure the blade arm 630 to the rotational member 612. It will also be understood that, in such embodiments, a screwdriver or other installation tool (not shown) is typically used for urging the connection member 620 relative to the aperture 633.

FIGS. 12-12D also illustrate that, in accordance with some embodiments, the rotational member 612 includes an outer rim portion 612A, a plurality of spoke portions 612B, and a plurality of flange portions 616. It will be understood that, as shown, the spoke portions 612B connect the outer rim portion 612A to the flange portions 616. In addition, each flange portion 616 includes a distal end portion 616A, a first surface portion 616B, and a second surface portion 616C. In accordance with some embodiments, when the blade arm 630 is in a secure state, the second surface portion 616C is positioned between the first surface portion 616B and the ceiling surface. In addition, it will be understood that, in accordance with some embodiments, each flange portion 616 defines one aperture 615 and two openings 614 therein. As shown, each opening 614 is embodied as a generally concave surface that extends into the distal end portion 616A of each flange portion 616. As shown in FIG. 12B, in accordance with some embodiments, each opening 614 includes an open end portion 614A, a closed end portion 614C, and an elongate portion 614B. The open end portion 614A of the opening 614 is positioned at or near the distal end portion 616A of the flange 616 of the rotational member 612. The closed end portion 614C is positioned on the flange 616 at a location between the open end portion 614A of the opening 614 and a central portion of the rotational axis 613. The elongate portion 614B of the opening 614 extends between the open end portion 614A and the closed end portion 614C. It will be understood that, in some alternative embodiments not shown, the opening 614 includes at least one recessed portion (e.g., the recessed portion 133 described and illustrated in connection with FIG. 1, etc.) that extends transversely into the opening 614 and/or that is structured to receive the head portion 624 of the connection member 620 at least partially therein.

Each opening 614 has a length that generally extends from the open end portion 614A of the opening 614 to the closed end portion 614C of the opening 614. As shown in FIGS. 12B and 12C, when the blade arm 630 is in a secure state, the length of each opening 614 extends in a direction that is substantially perpendicular to the rotational axis 613. As also shown, in some embodiments, both of the openings 614 on a single flange portion 616 are identically structured. In some embodiments, as shown in FIGS. 12A and 12B, each of the openings 614 on a single flange portion 616 extends into the flange portion 616 in a direction that is substantially parallel to a direction in which the other extends. In other words, in some embodiments, an opening 614 on a single flange portion 616 is parallel with the other opening 614 on that same flange portion 616.

FIGS. 12-12D also show that each opening 614 is structured to receive the body portion 622 of a connection member 620 therein. In particular, in some embodiments, each opening 614 is structured so that the body portion 622 of a connection member 620 can enter the open end portion 614A of the opening 614, move through the elongate portion 614B, and terminate (and/or remain) at or near the closed end portion 614C. Accordingly, in such embodiments, the diameter (or width) of the body portion 622 of the connection member 620 is less than the width of the open end portion 614A of the opening 614, less than the width of the elongate portion 614B, and less than the diameter (or width) of the portion of the opening 614 at or near the closed end portion 614C. As also shown in FIGS. 12-12D, in some embodiments, the diameter (or width) of the head portion 624 of the connection member 620 is greater than the width of the open end portion 614A, greater than the width of the elongate portion 614B, and greater than the diameter (or width) of the portion of the opening 614 at or near the closed end portion 614C of the opening 614. Thus, it will be understood that, in such embodiments, the head portion 624 of the connection member 620 cannot pass entirely and transversely through any portion of the opening 614.

It will be understood that, in some embodiments, the first connection portion 632 of the blade arm 630 defines an aperture 655 that is structured to carry a resisting member 650 therein. In accordance with some embodiments, the resisting member 650 includes a spring-loaded ball detent that is structured to move within the aperture 655. As such, in some embodiments, the resisting member 650 is structured to substantially mate with the aperture 615 on the flange portion 616 of the rotational member 612 in order to better support and/or secure the blade arm 630 relative to the rotational member 612 during installation. Thus, in accordance with some embodiments, positioning and/or securing the blade arm 630 relative to the flange portion 616 of the rotational member 612 also includes positioning the resisting member 650 in relative alignment with the aperture 615, such that at least part of the resisting member 650 engages the inside walls of the aperture 615.

It will also be understood that, in some embodiments, the motor housing 610 includes an overhang portion 618. As shown in FIG. 12B, the overhang portion 618 includes an inside surface 618A that extends in a direction substantially perpendicular to the rotational member 612 and/or parallel with the rotational axis 613. It will be understood that the overhang portion 618 is structured such that, when the first connection portion 632 of blade arm 630 is positioned at least partially between (e.g., wedged between, etc.) the overhang portion 618 and the second surface portion 616C of the flange portion 616, the second end portion 632B of the blade arm 630 substantially conforms to and/or abuts (or nearly abuts) the inside surface 618A of the overhang portion 618. As such, the overhang portion 618 and the connection members 620 cooperate to prevent the blade arm 630 from sliding laterally away from the rotational axis 613 of the rotational member 612. Thus, it will be understood that, in accordance with some embodiments, positioning the blade arm 630 relative to a flange portion 616 of the rotational member 612 also includes positioning the first connection portion 632 of blade arm 630 at least partially between the overhang portion 618 and the second surface portion 616C of the flange portion 616. In some embodiments, it will be understood that a slight torque and/or pivot may be required to position the first connection portion 632 of blade arm 630 at least partially between the overhang portion 618 and the second surface portion 616C of the flange portion 616 in order to achieve a support state. Once in position, the connection members 620 can be moved from a relatively loosened state to a relatively tightened state by urging the connection members 620 into the corresponding apertures 633 in order to achieve a secure state.

It will further be understood that the process of installing the blade arm 630 to the rotational member 612 typically includes at least two operations: (1) positioning the blade arm 630 relative to a flange portion 616 of the rotational member 612 to achieve a support state; and (2) urging the connection members 620 relative to the first connecting end 632 of the blade arm 630 to achieve a secure state. In a support state, the connection members 620 are positioned in a relatively loosened state and/or within the apertures 633, the head portions 624 of the connection members 620 cooperate with one or more portions of the corresponding openings 614, and/or the resisting member 650 engages the aperture 615 of the flange portion 616, such that the blade arm 630 is supported relative to the rotational member 612 of the motor. In a secure state, the connection members 620 are positioned in a relatively tightened state within the apertures 633, the head portions 624 of the connection members 620 at least partially bear against at least one or more of the portions of the openings 614, and/or the resisting member 650 engages the aperture 615 of the flange portion 616, such that the blade arm 630 is supported and secured relative to the rotational member 612 of the motor.

It will be understood that the cooperation of the resisting member 650 and the aperture 615 facilitates the installation of the blade arm 630 to the rotational member 612 because this structure helps to guide the blade arm 630 into position relative to the rotational member 612. This structure also provides a more secure connection between the blade arm 630 and the rotational member 612 because the interface between the resisting member 650 and the aperture 615 supplements the interface between the openings 614 and the corresponding connection members 620.

Further, it will be understood that, in some embodiments, positioning the blade arm 630 relative to the flange portion 616 of the rotational member 612 includes positioning the body portion 622 of the connection member 620 at or near the closed end 614C of the opening 614. More specifically, in some embodiments, positioning the blade arm 630 relative to the flange portion 616 includes sliding the blade arm 630 relative to (e.g., towards, etc.) the flange portion 616, such that the body portion 622 of the connection member 620 enters the open end portion 614A of the opening 614, moves through the elongate portion 614B, and then terminates (and/or remains) at or near the closed end portion 614C. It will be understood that, in some of these embodiments, the blade arm 630 can be slid relative to the flange portion 616 in a direction that is substantially perpendicular to the rotational axis 613 of the rotational member 612. In some embodiments, positioning the blade arm 630 relative to the flange portion 616 of the rotational member 612 additionally or alternatively includes positioning the first connection portion 632 of the blade arm 630 at least partially between the outer rim portion 612A and the second surface portion 616C of the flange portion 616.

Once the blade arm 630 is positioned relative to the corresponding flange portion 616 of the rotational member 612, the blade arm 630 can be secured to the rotational member 612 by urging the connection members 620 relative to the first connection portion 632 of the blade arm 630 (and/or flange portion 616), such that the locking member 660 and/or the head portion 624 of the connection member 620 at least partially bears against at least some portion of the opening 614 of the flange portion 616. Specifically, in some embodiments, urging the connection member 620 relative to the blade arm 630 includes tightening the connection member 620 within the corresponding aperture 633 of the first connecting end 632 of the blade arm 630, so that the flange portion 616 (and/or a section thereof near the distal end portion 616A) is tightly held by a compressive force between each head portion 624 and the first connecting end 632. In some embodiments, urging the connection member 620 relative to the blade arm 630 includes moving the connection member 620 relative to the flange portion 616 in a direction that is substantially parallel to the rotational axis 613 and/or in a direction that is substantially perpendicular to the length of the opening 614.

In some embodiments, urging the connection member 620 relative to the blade arm 630 and/or flange portion 616 includes urging the connection member 620 from a relatively loosened state towards a relatively tightened state. Still further, in some embodiments, urging the connection member 620 relative to the blade arm 630 includes urging the head portion 624 of the connection member 620 at least partially towards the opening 614, such that: (a) the head portion 624 is substantially prevented from moving laterally within the opening 614, and/or (b) the blade arm 630 is substantially prevented from being moved away from the second surface portion 616C of the flange portion 616.

As illustrated in FIGS. 12A and 12B, in some embodiments, the edges of the spoke portions 612B may cooperate with the edges of a first connection portion 632 of a blade arm 630 in order to aid in guiding the first connection portion 632 into place and/or to provide added lateral support from the rotation of the blade arm 630 relative to the flange portions 616 during installation and/or operation.

Thirteenth Embodiment

Referring now to FIGS. 13-13E, a series of views of a fan assembly 700 is provided, in accordance with an embodiment of the present invention. In some embodiments, as shown, the fan assembly 700 includes a motor housing 710, a plurality of connection members 720, a plurality of blade arms 730, and a plurality of fan blades 740. It will be understood that the motor housing 710 houses a motor (not shown) therein, and the motor includes a rotational member 712 disposed thereon. It will also be understood that the motor delivers power to the rotational member 712, and that, when powered, the rotational member 712 rotates about a rotational axis 713.

As shown in FIG. 13, it will be understood that, in accordance with some embodiments, the rotational member 712 is positioned on a bottom surface of the motor housing 710, such that the plurality of blade arms 730, when in a secure state, extend downwardly and laterally away from the rotational member 712. In some of these embodiments, as shown in FIG. 13, the motor housing 710 is suspended from a ceiling surface (not shown) by a support member (not shown). As such, in some embodiments, the fan assembly 700 is configured such that the blade arms 730, when in a secure state, are positioned between the rotational member 712 and a floor surface (not shown). Also, in some embodiments, the rotational axis 713 extends through the support member, such that the longitudinal axis of the support member is substantially collinear with the rotational axis 713. Additionally or alternatively, in accordance with some embodiments, the fan assembly 700 is assembled so that the longitudinal axis of the support member is substantially perpendicular to the rotational member 712.

However, in accordance with other embodiments of the present invention not shown, the rotational member 712 can be positioned on a top surface of the motor housing 710, such that the plurality of blade arms 730, when in a secure state, extend upwardly and laterally away from the rotational member 712. In some of these embodiments, the blade arms 730, when in a secure state, are positioned between a ceiling surface and the rotational member 712. It will further be understood that, in accordance with some embodiments, the fan assembly 700 can be assembled such that a line passing through the motor housing 710, the rotational member 712, and one or more blade arms 730 extends in a substantially vertical direction, a substantially horizontal direction, and/or in any other direction in between.

It will also be understood that, in some embodiments, as shown in FIGS. 13-13E, the rotational member 712 includes an outer rim portion 716 that defines a plurality of slots 717 therein. Each slot 717 is structured to receive a flange portion 736 of a blade arm 730 (described in more detail below) at least partially therein. In addition, in some embodiments, the rotational member 712 defines a plurality of apertures 714 therein, and each aperture 714 is structured to receive a connection member 720 at least partially therein.

Each of the plurality of blade arms 730 illustrated in FIGS. 13-13E includes a first connection portion 732, an elongate portion 735, and a second connection portion 734. The first connection portion 732 of the blade arm 730 is structured to connect the blade arm 730 to the rotational member 712 of the motor. The second connection portion 734 of the blade arm 730 is structured to connect the blade arm 730 to the fan blade 740. The elongate portion 735 of the blade arm 730 is defined between the first connection portion 732 and the second connection portion 734. It will be understood that, when the blade arm 730 is secured to the rotational member 712 at a location between the rotational member 712 and a floor surface, the elongate portion 735 of the blade arm 730 extends from a location near the first connection portion 732 to a location near the second connection portion 734 in a direction towards the floor surface and away from the rotational member 712. Additionally, as shown in FIGS. 13-13E, the elongate portion 735 twists from approximately the first connection portion 732 to approximately the second connection portion 734, such that the fan blade 740 is oriented at an angle with respect to the floor surface and/or with respect to the rotational axis 713.

As shown in FIG. 13, the first connection portion 732 of each blade arm 730 defines a generally wedge-shaped body having a first end portion 732A, a second end portion 732B, a first side portion 732C, and a second side portion 732D. The body of the first connection portion 732 tapers inwardly from approximately the second end portion 732B to approximately the first end portion 732A, such that the length of the second end portion 732B is greater than the length of the first end portion 732A. In addition, the first connection portion 732 of the blade arm 730 defines two generally L-shaped flange portions 736. In accordance with some embodiments, as shown in FIG. 13, each of the flange portions 736 extend from a location proximate the first end portion 732A of the first connection member 732 in a direction away from the first connection member 732 and in a direction towards the second end portion 732B. As such, it will be understood that the first connection portion 732 and the flange portion 736 cooperate to form a substantially C-shaped structure.

As shown in FIGS. 13A-13E, in accordance with some embodiments, the fan assembly 700 also includes a retention ring 750. As shown, the retention ring 750 includes an outer rim portion 754 and a plurality of thumb flanges 758. The outer rim portion 754 defines an outer surface 755 that is structured to conform to and/or abut (or nearly abut) the first end portion 732A of the first connection portion 732 of the blade arm 730. In addition, the retention ring 750 defines an aperture 756 and two substantially keyhole-shaped apertures 752 therein. Like the apertures 714 in the rotational member 712, the aperture 752 and the keyhole-shaped apertures 752 in the retention ring 750 are structured to receive a corresponding connection member 720 at least partially therein. Also, it will be understood that each of the keyhole-shaped apertures 752 includes a round portion 752A and an elongate portion 752B. As shown in FIG. 13A, the round portion 752A has a diameter (and/or width) that is greater than the width of the elongate portion 752B.

Each of the plurality of connection members 720 includes a body portion 722 and a head portion 724. The body portion 722 of the connection member 720 is embodied as an elongate body, and the head portion 724 is embodied as a protuberance disposed on an end of that elongate body. In some embodiments, as shown in FIGS. 13-13E, each of the connection members 720 is embodied as a round head screw having a protuberant, round head portion 724 and a cylindrical, elongate body portion 722. As shown, the diameter of the protuberant, round head portion 724 is greater than the diameter of the cylindrical, elongate body portion 722. In addition, as shown in FIG. 13D, in accordance with some embodiments, the elongate body portion 722 of each connection member 720 includes a threaded portion, and each of the corresponding apertures 714 in the rotational member 712 includes a corresponding threaded portion, such that each threaded connection member 720 may be screwed into, and away from, a corresponding threaded aperture 714. Also as shown in FIG. 13D, in accordance with some embodiments, a locking member 760, such as, for example, a lock washer, is disposed on one or more of the connection members 720 in order to better secure the blade arm 730 to the rotational member 712. It will also be understood that, in such embodiments, a screwdriver or other installation tool (not shown) is typically used for urging the connection member 720 relative to the aperture 714.

It will be understood that, when a connection member 720 is received within a corresponding aperture 714, the connection member 720 can be urged into, away from, and/or otherwise relative to the aperture 714. It will also be understood that the each of the connection members 720 can be urged within the aperture 714 between a relatively loosened state and a relatively tightened state. It will be understood that less of the connection member 720 is positioned outside of the aperture 714 in a relatively tightened state than when the connection member 720 is positioned in a relatively loosened state. It will also be understood that, for example, the connection members 720 illustrated in FIG. 13 are positioned in a relatively loosened state and that the connection members 720 illustrated in FIG. 13E are positioned in a relatively tightened state.

Also, it will be understood that the diameter (and/or width) of the body portion 722 of the connection member 720 is less than the diameter (and/or width) of the round portion 752A of the keyhole-shaped aperture 752, less than the width of the elongate portion 752B, less than the diameter (and/or width) of the aperture 756 in the retention ring 750, and less than the diameter (and/or width) of aperture 714 in the rotational member 712. In addition, the diameter (and/or width) of the head portion 724 of the connection member 720 is less than the diameter (and/or width) of the round portion 752A of the keyhole-shaped aperture 752, greater than the width of the elongate portion 752B, greater than the diameter (and/or width) of the aperture 756 in the retention ring 750, and greater than the diameter (and/or width) of aperture 714 in the rotational member 712. Thus, it will be understood that, in accordance with some embodiments, the head portion 724 of the connection member 720 can pass entirely and transversely through the round portion 752A of the keyhole-shaped aperture 752 but cannot pass entirely and transversely through any one of the elongate portion 752B of the keyhole-shaped aperture 752, the aperture 756 in the retention ring 750, or the aperture 714 in the rotational member 712.

It will be understood that several operations of the process for installing the blade arm 730 to the rotational member 712, and/or states resulting from one or more operations of the installation process, are represented by FIGS. 13-13E. First, as shown in FIG. 7, each of the blade arms 730 is positioned (e.g., slid, etc.) relative to the outer rim portion 716 of the rotational member 712, such that flange portions 736 of each blade arm 730 are received at least partially in a corresponding slot 717 in the rotational member 712. In accordance with some embodiments, the blade arm 730 is in a support state as a result of this operation. Once all of the blade arms 730 are positioned in this way, the retention ring 750 is positioned relative to the rotational member 712, as shown in FIGS. 13A and 13B, such that: (a) the head portions 724 of the connection members 720 are received through corresponding round portions 752A of the keyhole-shaped apertures 752, (b) the body portions 722 of the connection members 729 are received in the corresponding round portions 752A of the keyhole-shaped apertures 752, (c) the first connection portion 732 of the blade arm 730 is positioned (e.g., wedged, etc.) at least partially between the outer rim portion 716 of the rotational member 712 and the outer surface 755 of the outer rim portion 754 of the retention ring 750. Thereafter, as shown in FIG. 13C, the retention ring 750 is rotated relative to the connection members 720, such that: (a) the body portions 722 of the connection member 720 move from being received in the round portions 752A of the keyhole-shaped apertures 752 to being received in the elongate portions 752B of the keyhole-shaped apertures 752, and (b) the aperture 756 in the retention ring 750 is moved into relative alignment with the aperture 714 in the rotational member 712. In some embodiments, the blade arm 730 is in a support state as a result of this operation.

Once the retention ring 750 has been rotated in this way, the body portion 722 of a connection member 720 is inserted through the aperture 756 of the retention ring 750 and at least partially urged from a relatively loosened state to a relatively tightened state within the aperture 714 of the rotational member 712, as shown in FIGS. 13D and 13E. It will be understood that, in some embodiments, the locking member 760 is also used with the inserted connection member 720 in order to better secure the retention ring 750 to the rotational member 712. Before, after, or simultaneous with inserting and/or tightening the connection member 720 into and/or within the apertures 756 and 714, the other two connection members 720 are also urged from relatively loosened state to a relatively tightened state within corresponding apertures 714, such that the head portions 724 of those connection members 720 at least partially bear against retention ring 750 at or near the elongate portions 752B and/or the round portions 752A of the keyhole-shaped apertures 752. In some embodiments, the blade arm 730 is in a secure state as a result of this operation. Thereafter, as shown in FIG. 13E, when the connection members 720 are tightened within their corresponding apertures 714 in this way, (a) the connection members 720 are substantially prevented from moving laterally within the apertures 714, and/or (b) the blade arms 730 are substantially prevented from being moved laterally away from either the outer rim portion 716 of the rotational member 712 or the outer surface 755 of the outer rim portion 754 of the retention ring 750.

Fourteenth Embodiment

Referring now to FIGS. 14-14B, a series of views of a blade arm 530 is provided, in accordance with an embodiment of the present invention. It will be understood that the blade arm 530 is an alternative embodiment of the blade arm 130 of the fan assembly 100 illustrated in FIG. 1. It will also be understood that the blade arm 530 is generally similar to the blade arm 130. For example, the blade arm 530 includes a first connection portion 532, a pair of openings 536, an elongate portion 535, and a second connection portion (not shown in FIGS. 14-14B). However, in contrast to the blade arm 130, the first connection portion 532 of the blade arm 530 includes a rib portion 532E and at least one tab 532F.

As shown in FIG. 14, the first connection portion 532 of the blade arm 530 defines a generally wedge-shaped body having a first end portion 532A, a second end portion 532B, a first side portion 532C, and a second side portion 532D. The body of the first connection portion 532 tapers inwardly from the second end portion 532B towards the first end portion 532A, such that the length of the second end portion 532B is greater than the length of the first end portion 532A. In some embodiments, when the blade arm 530 is installed on the rotational member 112 (as shown in FIG. 14B), the first side portion 532C of the first connection portion 532 is structured to cooperatively mate with the second side portion 532D of the first connection portion 532 of a second blade arm 530 that is positioned adjacent to the first blade arm 530. Thus, adjacent blade arms 530, once installed on the rotational member 112, laterally support each other around the axis of rotation 113, thereby creating desired alignment and restricting movement of the blade arms 530 relative to the connection members 120 and/or the rotational member 112. This feature also facilitates the process of installing the blade arms 530 on the rotational member 112, as the side portions 532C, 532D of the first connection portion 532 of an already-installed blade arm 530 provide sliding surfaces for guiding adjacent blade arms 530 into position relative to corresponding connection members 120 and/or the rotational member 112.

FIG. 14 further illustrates that the first connection portion 532 of the blade arm 530 defines at least two openings 536 therein. Each opening 536 is embodied as a generally concave surface (e.g., groove, slot, recess, nook, depression, pit, niche, hollow, concavity, etc.) that extends into the first end portion 532A of the first connection portion 532 towards the second end portion 532B. Each opening 536 includes an open end portion 537, a closed end portion 538, and an elongate portion 539. The open end portion 537 is positioned at and/or near the first end portion 532A of the first connection portion 532 of the blade arm 530. The closed end portion 538 is positioned on the first connection portion 532 of the blade arm 530 at a location between the open end portion 537 of the opening 536 and the elongate portion 534 of the blade arm 530. The elongate portion 539 is positioned on the first connection portion 532 at a location between the open end portion 537 and the closed end portion 538.

Each opening 536 has a length that generally extends from the open end portion 537 of the opening 536, through the elongate portion 539, and to the closed end portion 538. As shown in FIG. 14B, when a bottom surface of the first connection portion 532 of the blade arm 530 is positioned substantially flush with a top surface of the rotational member 112, the length of each opening 536 extends in a direction that is substantially perpendicular to the rotational axis 113. In some embodiments, both of the openings 536 extend into the blade arm 530 in the same direction, such that the length of each opening 536 extends in a direction that is substantially parallel to the length of the other opening 536. Further, in some embodiments, both of the openings 536 on a single blade arm 530 can be identically structured.

In addition to the openings 536, the first connection portion 532 of the blade arm 530 may also define a pair of recessed portions 533. In some embodiments, the recessed portions 533 extend "transversely" into the first connection portion 532. As shown, the recessed portions 533 may be positioned on the first connection portion 532 such that each recessed portion 533 includes an opening 536 at least partially therein. In other words, each opening 536 is positioned within a corresponding recessed portion 533, such that the area defined by the recessed portion 533 is greater than the area defined by the opening 536. As such, in some embodiments, the recessed portion 533 generally extends towards the opening 536 at an angle relative to the length of the opening 536. In some embodiments, as shown in FIG. 14, the recessed portion 533 extends towards the opening 536 in a direction that is substantially perpendicular to the length of the opening 536.

In some embodiments, each recessed portion 533 is structured to interface with the head portion 124 of a connection member 120. In some of these embodiments, the structure of the recessed portion 533 substantially conforms to the structure of the head portion 124 of the connection member 120. For example, as shown in FIGS. 14 and 14B, in some embodiments, the head portion 524 of the connection member 120 has a round structure and the recessed portion 533 has a corresponding round structure. In such embodiments, the round head portion 124 of the connection member 120 is structured to fit at least partially into, and/or at least partially bear against, the substantially round recessed portion 533. In some cases, the head portion 124 can be urged towards and/or into the recessed portion 533, such that the head portion 124 closely fits against the recessed portion 533, thereby providing a more secure connection between the blade arm 530 and the rotational member 112. Also, it will also be understood that, in some embodiments, the head portion 124 of the connection member 120 cannot pass entirely and transversely through any portion of the recessed portion 533.

In some embodiments, such as the one shown in FIG. 14, each opening 536 is structured to substantially resemble a "U"-shaped slot. Specifically, in such embodiments, the opening 536 has a substantially rectangular shape from the open end portion 537, through the elongate portion 539, and up to about the closed end portion 538. As shown in FIG. 14, the recessed portion 533 can have a substantially circular shape and/or may at least partially surrounds the opening 536. As shown, the diameter of the substantially circular recessed portion 533 can be greater than the width of the substantially rectangular opening 536.

In some embodiments, each opening 536 is structured to receive the body portion 122 of a connection member 120 therein. In particular, in some embodiments, each opening 536 is structured so that the body portion 122 of a connection member 120 can enter the open end portion 537 of the opening 536, move through the elongate portion 539, and terminate (and/or remain) at or near the closed end portion 538. Accordingly, in such embodiments, the diameter (or width) of the body portion 122 of the connection member 120 is less than the width of the open end portion 537, less than the width of the elongate portion 539, and/or less than the width of the closed end portion 533. Further, in some embodiments, the diameter (or width) of the head portion 124 of the connection member 120 is greater than the width of the open end portion 537, greater than the width of the elongate portion 539, and/or greater than the width of the closed end portion 538. Thus, it will be understood that, in some embodiments, the head portion 124 of the connection member 120 cannot pass entirely and transversely through any portion of the opening 536.

As shown in the illustrated embodiment, the first connection portion 532 of the blade arm 530 may also define a tab 532F, which can project away from the first connection portion 532 and/or first end portion 532A. As such, the openings 536 may be positioned at least partially between the tab 532F and the elongate portion 535. Further, as shown in FIG. 14, the tab 532F is an integral portion of the blade arm 530, but in other embodiments, the tab 532F may be implemented as a separate piece (e.g., on the rotational member 112) connected to the blade arm 530 in a rigid manner.

In some embodiments, the tab 532F is structured to bear against the rotational member 112, and/or fit within and/or bear against a slot, groove, aperture, and/or other opening (not shown) defined in the rotational member 112, such that the combination of the tab 532F and connection members 120 can be used to secure the blade arm 530 to the rotational member 112. It will be understood that, in such embodiments, the cooperation of the tab 532F and the rotational member 112 (and/or the opening in the rotational member 112) results in a more secure connection between the blade arm 530 and the rotational member 112 than if the tab 532 were absent (and only the connection members 120 were used to secure the blade arm 530 to the rotational member 112).

Additionally or alternatively, in some embodiments, the tab 532F is structured so as to stabilize the blade arm 530 when the blade arm 530 is held in the first position (or initial support state) relative to the fan assembly 1400. Such stabilization can be provided, for example, by structuring the tab 532F so that, when the first connection portion 532 is in an initial support state, the tab 532F makes contact with the rotational member 112 at a distance that is closer to the rotational axis 113 than the point where the first connection portion 532 would make contact if the tab 532F were absent. This can effectively reduce an angle between the first connection member 532 and the rotational member 112 when the first connection member 532 is placed in the initial support state and can improve the stability of blade arm 530 in that state.

In addition to the tab 532F, the first connection portion 532 of the blade arm 530 also defines a rib portion 532E, which can be positioned at and/or near the second end portion 532B of the first connection portion 532. In some embodiments, the rib portion 532E extends away from the first connection portion 532 in a direction that is substantially perpendicular to the length of the opening 536. In other words, in some embodiments, the rib portion 532E serves to extend the surface area of the second end portion 532B of the first connection portion 532. As such, in embodiments where the blade arm 530 is used with a motor housing that includes an overhang portion having an inside surface (e.g., the motor housing 110 of FIG. 4 that includes the overhang portion 118 having the inside surface 118A, etc.), the rib portion 532E is structured such that it and/or the second end portion 532B can substantially conform to and/or abut (or nearly abut) the inside surface of the overhang portion. In such embodiments, when the blade arm 530 is in a secure state, the overhang portion and the rib portion 532E cooperate to prevent the blade arm 530 from sliding laterally away from the rotational member of the motor housing.

In addition, as shown in FIGS. 14-14B, the rib portion 532E can provide the location where the elongate portion 535 of the blade arm 530 connects to the first connection portion 532. Also, in some embodiments, the rib portion 532E is structured as a thin plate, the rest of the first connection portion 532 is structured as a thin plate, and the rib portion 532E is positioned substantially perpendicular to the rest of the first connection portion 532. In such embodiments, this configuration reduces the volume and weight of the overall blade arm 530, while at the same time providing a surface (i.e., the rib portion 532E) for the elongate portion 535 to connect to the first connection portion 532.

Fifteenth Embodiment

Referring now to FIGS. 15 and 15A, a series of views of a spacer 205 is provided, in accordance with an embodiment of the present invention. In some embodiments, the spacer 205 is embodied as the clip 105 shown in FIGS. 2-2B (or vice versa). Additionally or alternatively, in some embodiments, the spacer 205 can be secured to the fan assembly 1500 (shown in FIG. 15A) in the same or similar way as the clip 105 is secured to the fan assembly 100A (shown in FIGS. 2-2B and described previously herein) (or vice versa).

As shown in FIG. 15, the spacer 205 can include a connection portion 201 and two grip portions 203. In some embodiments, the connection portion 201 extends between each of the grip portions 203, and/or each grip portion 203 is connected to and/or positioned substantially perpendicular to the connection portion 201. In some embodiments, the grip portions 203 are positioned on the spacer 205, such that each grip portion 203 is substantially parallel to the other grip portion 203. Further, in some embodiments, the grip portions 203 and connection portion 201 are structured such that the spacer 205 is shaped like a "C" when viewing the spacer 205 from a location above the spacer 205.

As shown in FIG. 15, each grip portion 203 may be divided into a first grip finger 203A and a second grip finger 203B. In some embodiments, the spacer 205 and/or the grip portion 203 is made from some pliable material (e.g., plastic), such that the first grip finger 203A can be separated from the second grip finger 203B when, for example, the body 122 of a connection member 120 is slid therethrough.

Further, as shown in FIG. 15, each grip portion 203 and/or pair of grip fingers 203A, 203B may define at least one opening 230 therein. In some embodiments, the opening 230 extends between and/or parallel to the first and second grip fingers 203A, 203B on the grip portion 203. Each opening 230 is embodied as a generally concave surface that extends into a first end of a grip portion 203 towards the connection portion 201. The opening 230 includes an open end portion 232, a closed end portion 238, and an elongate portion 239. The closed end portion 238 is positioned on the grip portion 203 at a location between the connection portion 201 and the open end portion 232. The elongate portion 239 is positioned on the grip portion 203 at a location between the open end portion 232 and the closed end portion 238. Also, each opening 230 has a length that generally extends from the open end portion 232 to the closed end portion 238. In some embodiments, as shown in FIG. 15, the spacer 205 is structured such that the lengths of the openings 230 are substantially parallel to each other and/or perpendicular to the length of the connection portion 201.

In some embodiments, each opening 230 is structured to receive the body portion 122 of a connection member 120 therein. For example, in some embodiments, the body portion 122 can be slid through the open end portion 232 and into the elongate portion 239 of the opening 236. Further, in some embodiments, each opening 230 has a width that is less than a width dimension (and/or diameter) of the head portion 124 of a connection member 120. Accordingly, in such embodiments, the head portion 124 of a connection member 120 cannot pass transversely through the opening 230.

As shown in FIG. 15, the elongate portions 239 of the openings 230 (and/or the grip fingers 203A, 203B) may include a plurality of teeth 236. In some embodiments, the teeth 236 are embodied as a plurality of projections that extend transversely into the elongate portion of the opening 230. Additionally or alternatively, in some embodiments, the teeth 236 extend into the opening 230, such that one or more (or all) of the teeth 236 are substantially perpendicular to the length of the opening 230. Also, as shown in the illustrated embodiment, the plurality of teeth 236 may be divided into a first set of teeth 236A and a second set of teeth 236B. In some embodiments, the first set of teeth 236A for each opening 236 is positioned opposite the second set of teeth 236B, so that the first set 236A and the second set 236B extend towards and/or oppose each other. In some embodiments, the distance between the first set of teeth 236A and the second set of teeth 236B is less than or equal to a width dimension of a connection member 120.

Additionally, in some embodiments, the first set of teeth 236A and the second set of teeth 236B each includes a stop 237. In some embodiments, the stop 237 is positioned at a location between the first set of teeth 236A (and/or the second set of teeth 236B) and the closed end portion 238 of the opening 230. Also, in some embodiments, the stop 237 is shaped like an individual tooth 236, but the stop 237 is generally larger and extends into the opening 230 farther than a tooth 236. In some embodiments, the distance between opposing stops 237 is less than a width dimension of a connection member 120. Further, in some embodiments, the stop 237 is structured and/or positioned along the opening 230, such that it is difficult or impossible to separate the grip fingers 203A, 203B by an amount sufficient to permit the passage of the body portion 122 of a connection member 120 into the closed end portion of the opening 230. Accordingly, in such embodiments, the pair of stops 237 acts to prevent a connection member 120 from being inserted too far into an opening 230 of the spacer 205.

It will be understood that the spacer 205 can be used for a variety of purposes. As one example, the spacer 205 can be used to facilitate the installation of the fan assembly 1500 by serving as a placeholder for a blade arm 530 before that blade arm 530 is installed onto the fan assembly 1500. As shown in FIG. 15A, the spacer 205 may be secured to the fan assembly 1500 at a location at least partially between the rotational member 112 and a pair of "pre-installed" connection members 120. In addition, as illustrated, the spacer 205 can be positioned at least partially between the head portions 124 of the connection members 120 and the rotational member 112. As such, the spacer 205 may be structured and/or positioned to keep and/or maintain the head portion 124 of a connection member 120 a predetermined distance away from the rotational member 112. In some of these embodiments, the predetermined distance is at least the distance required to allow the first connection portion 532 of the blade arm 530 to be positioned between the rotational member 112 and the head portion 124 of the connection member 120. In other words, the spacer 205 may have a height dimension that is at least as high as a height dimension of the first connection portion 532 of the blade arm 530. Accordingly, when the fan assembly 1500 is ready to be installed, the spacer 205 may be removed from the fan assembly 1500 and the blade arm 530 can be inserted in its place. In some embodiments, the spacer 205 can be removed and the blade arm 530 can be inserted in its place in order to achieve a relatively loosened state similar to that discussed in connection with FIG. 1. As such, the spacer 205 advantageously helps avoid instances where the connection member 120 is inserted too far into the rotational member 112, such that the connection member 120 must be at least partially withdrawn from the rotational member 112 in order to insert the first connection portion 532 of the blade arm 530 between the head portion 124 and the rotational member 112.

As another example, the spacer 205 can be used to secure the rotational member 112 from rotating relative to the motor housing 110. Specifically, the spacer 205 can be positioned at a location at least partially between the rotational member 112 and the motor housing 110, such that the spacer 205 at least partially engages and/or bears against the motor housing 110 and a pair of connection members 120 extending away from the rotational member 112. In some cases, this relative positioning may enable the spacer 205 to impede and/or prevent the rotational member 112 from moving relative to the motor housing 110. As such, the spacer 205 can be used to secure the fan assembly 1500 during, for example, pre-installation, packaging, transportation, and/or installation. Indeed, in some embodiments, the spacer 205 may be structured and/or positioned to cooperate with the packaging (e.g., box, packing foam, etc.) of the fan assembly 1500 in order to prevent rotation of the rotational member 112 during transit.

To help secure and/or facilitate installation of the fan assembly 1500, the spacer 205 can be positioned on the fan assembly 1500 so that the openings 230 and/or grip fingers 203A, 203B of the spacer 205 receive and/or grip the pair of connection members 120, as shown in FIG. 15A. In some embodiments, the first set of teeth 236A and the second set of teeth 236B cooperate to bear against the sides of the body portion 122 of the connection member 120. In some embodiments, where the connection member 120 is embodied as a screw, at least some of the teeth 236 and/or the stop(s) 237 contact, engage, bear against, and/or grip the threads of the screw.

The following describes an exemplary use of the spacer 205 with respect to the fan assembly 1500 shown in FIG. 15A. Before the fan assembly 1500 is packaged and/or shipped to the customer, the spacer 205 can be secured to the fan assembly 1500, as is shown in FIG. 15A. Specifically, in accordance with some embodiments, the connection members 120 are installed on the rotational member 112, such that they are at least partially withdrawn from the rotational member 112. Thereafter, the spacer 205 is positioned at least partially between the head portions 124 of the connection members 120 and the rotational member 112. Specifically, in some embodiments, the openings 230 of the spacer 205 are positioned relative to a pair of connection members 120, such that the body portions 122 of the connection members 120 enter the open end portions 232 of the openings 230 and move through the elongate portions 239 towards the closed end portions 238. In some embodiments, the spacer 205 is moved towards the rotational axis 113 and/or in the direction B shown in FIG. 15A until the grip fingers 203A, 203B and/or teeth 236 "snap" around the body portions 122 of the connection members 120.

In some embodiments, each connection member 120 is moved between the grip fingers 203A, 203B and/or through the opening 230 until the pair of opposing stops 237 contacts the body portion 122 of the connection member 120. In some of these embodiments, the body portion 122 cannot be moved in the opening 230 past the stop 237 because, for example, the distance between the opposing stops 237 is smaller than a width dimension of the body portion 122 of the connection member 120. Also, it will be understood that the openings 230 of the spacer 205 may taper outwardly from a location at and/or near the elongate portion 239 to a location at and/or near the open end portion 232, which enables the spacer 205 to more easily receive the connection members 120 when the spacer 205 is being positioned onto the fan assembly 1500.

Once the spacer 205 receives the connection members 120 in the openings 230 and/or is positioned between the rotational member 112 and the head portions 124 of the connection members 120, each of the connection members 120 is urged relative to (e.g., towards) the rotational member 112 until its head portion 124 at least partially bears against the top surface of the spacer 205. In some of these embodiments, the height dimension of the spacer 205 is structured so that the distance between the rotational member 112 and the head portions 124 of the connection members 120 (when the head portions 124 are contacting the top surface of the spacer 205) is greater than a height dimension of the first connection portion 532 of the blade arm 530. Also, it will be understood that urging the head portions 124 against the top surface of the spacer 205 may help impede and/or prevent the rotational member 112 from moving relative to the motor housing 110. Further, in some embodiments, as shown in FIG. 15A, a washer 108 may be inserted between the head portion 124 of the connection member 120 and the top surface of the spacer 205.

After one or more spacers 205 are secured to the fan assembly 1500, the fan assembly 1500 is packaged and/or shipped to the customer. Thereafter, when the fan assembly 1500 is ready to be installed, each spacer 205 can be removed from the fan assembly 1500 and a blade arm 530 can be installed in its place. In some embodiments, the spacer 205 is disengaged from the connection members 120 and/or motor housing 110 by: (a) at least partially withdrawing the connection members 120 away from the surface of the spacer 205; and then (b) sliding the spacer 205 laterally away from the rotational axis 113 of the fan assembly 1500 in the direction A shown in FIG. 15A.

Once the spacer 205 has been removed, the blade arm 530 can be installed by, for example, sliding the blade arm 530 laterally towards the connection members 120 and/or the rotational axis 113 in the direction B shown in FIG. 15A. Once the blade arm 530 is positioned relative to the connection members 120, the blade arm 530 can be secured to the rotational member 112 by urging the connection members 120 relative to (e.g., towards, etc.) the rotational member 112 in the direction C shown in FIG. 15A. As mentioned previously, in some embodiments, the urging of the connection members 120 relative to the rotational member 112 may include urging the connection members 120 from a first position to a second position and/or from a relatively loosened state to a relatively tightened state. As also mentioned previously, where the connection member 120 is embodied as a screw, as shown in FIG. 15A, a screwdriver may be used to urge the connection members 120 relative to the rotational member 112.

The embodiments of the present invention described above relate to fan assemblies and methods for assembling same. It will be understood that some of these embodiments may be characterized as "easy install" fan assemblies because they include an "easy install" blade arm to motor connection and/or an "easy install" blade arm to fan blade connection. As such, although many of the embodiments illustrated and described herein relate to easy install blade arm to motor connections, it will be understood that any one or more of these embodiments can also include one or more easy install blade arm to fan blade connections. Examples of such easy install blade arm to fan blade connections are disclosed in U.S. Pat. Nos. 6,336,792, 7,281,899, 6,802,694, 6,171,059, 6,010,306, 7,396,210, 6,352,411, 6,872,053, 6,688,850, 6,309,183, 6,210,117, and/or 6,039,540; U.S. Patent Publication No. 2008-0273979; and/or U.S. patent application Ser. No. 11/895,552. Each of these references is incorporated herein by reference in its entirety. In this regard, an easy install fan assembly according to the present invention includes both an easy install blade arm to motor connection, such as described in the embodiments above, and an easy install blade arm to fan blade connection, such as described in one of the above U.S. patent references.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. In view of this disclosure, those skilled in the art will appreciate that various adaptations, combinations, and modifications of the just described embodiments may be configured without departing from the scope and spirit of the invention. Therefore, it is to be understood that, within the scope of the appended claims, the invention may be practiced other than as specifically described herein.

What is claimed is:

1. A fan assembly comprising:

a rotational member adapted to rotate about a rotational axis;

at least two connection members structured for connection to the rotational member, wherein the at least two connection members comprise a body portion and a head portion; and a blade arm defining at least two openings therein, wherein each of the openings comprises an open end portion and a closed end portion, wherein the blade arm and the connection members are configured so that, after the connection members are at least partially connected to the rotational member and while the rotational axis is vertically oriented, the blade arm can be brought into a state of at least preliminary support from the connection members by sliding the blade arm relative to the at least two connection members such that the body portion of at least two of the connection members enters the open end portion of a respective one of the at least two openings and moves through the at least two openings as the blade arm slides in a direction towards the rotational axis of the rotational member; and wherein the connection members and the blade arm are structured such that, when the blade arm is connected to the rotational member, the head portions of at least two of the connection members at least partially bear against the blade arm adjacent to the respective ones of the at least two openings defined in the blade arm.

2. The fan assembly of claim 1, wherein at least one of the connection members is configured to have at least a first position and a second position, wherein in the first position, the head portion of the connection member is spaced apart from the rotational member at a distance greater than a dimension of the blade arm, such that, when the blade arm is positioned relative to the rotational member, the head portion of the connection member rests against the blade arm to support the blade arm relative to the rotational member, and wherein in the second position, the head portion of the connection member is spaced apart from the rotational member at a distance approximating a dimension of the blade arm, such that, when the blade arm is connected to the rotational member, the head portion of the connection member applies a force against the blade arm sufficient to secure the blade arm relative to the rotational member.

3. The fan assembly of claim 1, wherein at least one of the openings comprises a length extending approximately from the open end portion of the opening to approximately the closed end portion of the opening, and wherein the opening further comprises a recessed portion extending transversely into the opening in a direction that is substantially perpendicular to the length of the opening.

4. The fan assembly of claim 1, wherein the body portion of at least one of the connection members comprises a first width, wherein the head portion of the connection member comprises a second width, wherein the open end portion of the opening comprises a third width, wherein the second width is greater than the third width, and wherein the third width is greater than the first width.

5. The fan assembly of claim 3, wherein the recessed portion of at least one of the openings is positioned at or near the closed end portion of the opening.

6. The fan assembly of claim 3, wherein at least one of the openings further comprises an elongate portion positioned between the open end portion and the closed end portion, and wherein the recessed portion of the opening is positioned at or near the closed end portion, and wherein the opening is structured to receive the body portion of the connection member through the open end portion of the opening, through the elongate portion, and at or near the closed end portion.

7. The fan assembly of claim 3, wherein the recessed portion of at least one of the openings is structured to at least partially receive the head portion of the connection member therein, such that, when the blade arm is in a secure state, the head portion of the connection member is substantially prevented from moving laterally within the recessed portion.

8. The fan assembly of claim 1, wherein the blade arm comprises a first connecting end for connecting the blade arm to the rotational member and a second connecting end for connecting the blade arm to a fan blade, wherein the open end portion of each of the openings is positioned at an end portion of the first connecting end of the blade arm, and wherein the closed end portion of each of the openings is positioned on the first connection portion of the blade arm at a location between the open end portion of each of the openings and the second connection portion of the blade arm.

9. A method for installing a blade arm to a rotational member of a fan motor, wherein the rotational member is adapted to rotate about a rotational axis, wherein the rotational member is structured for connection to at least two connection members, wherein each of the connection members comprises a body portion and a head portion, wherein the blade arm defines at least two openings therein, and wherein each of the openings comprises an open end portion and a closed end portion, the method comprising:

positioning the blade arm relative to the connection members; and urging the blade arm relative to the rotational member in a direction toward the rotational axis of the rotational member, such that the body portion of each connection member at least partially enters the opening in the blade arm, the head portion at least partially bears against the blade arm, and the blade arm is brought into a state of at least preliminary support from the connection members, said state of preliminary support being sustainable when the rotational axis is vertically oriented.

10. The method of claim 9 further comprising urging the connection member relative to the rotational member in a direction that is substantially parallel to the rotational axis.

11. The method of claim 9, wherein positioning the blade arm relative to the connection members comprises sliding the blade arm relative to the connection members, such that the body portion of each connection member enters the open end portion of a respective one of the openings and terminates at the closed end portion of the respective one of the openings.

12. The method of claim 9, wherein at least one of the openings further comprises an elongate portion that is positioned between the open end portion and the closed end portion, wherein the at least one opening further comprises a recessed portion that extends transversely into the at least one opening, wherein the recessed portion is positioned at or near the closed end portion of the at least one opening, and wherein positioning the blade arm relative to the connection members comprises sliding the blade arm relative to the connection members, such that the body portion of one of the connection members enters the open end portion of the at least one opening, moves through the elongate portion, and then terminates at or near the closed end portion.

13. The method of claim 9, wherein in a first position, the head portions of the connection members are spaced apart from the rotational member at a distance greater than a dimension of the blade arm, such that, when the blade arm is positioned relative to the connection members, the head portions of the connection members rest against the blade arm to support the blade arm relative to the rotational member.

14. The method of claim 13 further comprising urging the connection members relative to the rotational member so that the head portion of each of the connection members is spaced apart from the rotational member at a distance approximating a dimension of the blade arm, and such that, when the blade arm is connected to the rotational member, the head portion of each of the connection members applies a force against the blade arm sufficient to secure the blade arm relative to the rotational member.

15. The method of claim 12 urging the head portion of one of the connection members at least partially into the recessed portion of the opening, such that the head portion is substantially prevented from moving laterally within the recessed portion.

16. A blade arm comprising:

a first connection portion structured for connection to a rotational member of a fan motor, where the rotational member is adapted to rotate about a rotational axis, wherein the first connection portion defines at least two openings therein, wherein the openings comprise an open end portion and a closed end portion, and wherein the first connection portion is configured so that, after at least two connection members are at least partially connected to the rotational member, the blade arm can be brought into a state of at least preliminary support from the connection members by sliding the first connection portion in a direction toward the rotational axis of the rotational member, while the rotational axis is vertically oriented, such that portions of the connection members move through respective ones of the openings;

a second connection portion structured for connection to a fan blade; and an elongate portion positioned between the first connection portion and the second connection portion.

17. The blade arm of claim 16, wherein at least one of the openings comprises a length extending from approximately the open end portion of the opening to approximately the closed end portion, and wherein the first connection portion further defines a recessed portion that extends into the first connection portion in a direction that is substantially perpendicular to the length of the opening.

18. The blade arm of claim 17, wherein the recessed portion extends into the opening wherein the recessed portion is structured for receiving a head portion of a connection member at least partially therein, and wherein the opening is structured for receiving a body portion of the connection member at least partially therein.

19. The blade arm of claim 16, wherein the first connection portion further defines a tab that is structured for connection to the rotational member.

20. A fan assembly comprising:

a motor including a rotational member driven by the motor;

a connection member structured for connection to the rotational member and adapted to secure a blade arm to the rotational member, wherein the connection member comprises a head portion and a body portion; and a spacer defining an opening therein, wherein the opening comprises an open end portion and a closed end portion, wherein the opening is structured for receiving the body portion of the connection member therein, wherein said spacer is separate from the blade arm, and wherein the body portion of the connection member can be connected to the rotational member and positioned within the opening of the spacer, such that the spacer is positioned at least partially between the head portion of the connection member and the rotational member, and such that the head portion is maintained a predetermined distance away from the rotational member.

21. A fan assembly comprising:

a rotational member;

a connection member structured for connection to the rotational member, wherein the connection member comprises a head portion and a body portion;

a spacer defining an opening therein, wherein the opening comprises an open end portion and a closed end portion, wherein the opening is structured for receiving the body portion of the connection member therein, and wherein the body portion of the connection member can be connected to the rotational member and positioned within the opening of the spacer, such that the spacer is positioned at least partially between the head portion of the connection member and the rotational member, and such that the head portion is maintained a predetermined distance away from the rotational member; and a blade arm defining a second opening therein, wherein the second opening comprises an open end portion and a closed end portion, and wherein the second opening is structured for receiving the body portion of the connection member therein, wherein the blade arm comprises a height dimension less than the predetermined distance, so that the blade arm can be positioned, in place of the spacer, between the head portion of the connection member and the rotational member.

22. The fan assembly of claim 20, wherein the opening comprises a first set of teeth structured for at least partially bearing against the body portion of the connection member.

23. The fan assembly of claim 20, wherein the spacer comprises a first grip portion, a second grip portion, and a connection portion, wherein the first grip portion defines the opening therein, wherein the second grip portion defines a second opening therein, and wherein the connection portion is positioned at least partially between the first grip portion and the second grip portion, such that the spacer is C-shaped.

24. An easy install fan assembly comprising:

an easy install blade arm to motor connection comprising:

a rotational member adapted to rotate about a rotational axis;

at least two connection members structured for connection to the rotational member, wherein each of the connection members comprises a body portion and a head portion; and a blade arm defining at least two openings therein, wherein each of the openings comprises an open end portion and a closed end portion, wherein, when the blade arm is in a secure state, the head portions of the connection members at least partially bear against the blade arm, and wherein the blade arm and the connection members are configured so that, after the connection members are at least partially connected to the rotational member and while the rotational axis is vertically oriented, the blade arm can be brought into a state of at least preliminary support from the connection members by sliding the blade arm relative to the connection members such that the body portion of at least two of the connection members enters the open end of a respective one of the at least two openings as the blade arm slides in a direction towards the rotational axis of the rotational member; and an easy install blade arm to fan blade connection.

25. The method of claim 9, wherein the blade arm further comprises a first connecting end for connecting the blade arm to the rotational member and a second connecting end for connecting the blade arm to a fan blade, wherein the open end portion of each of the openings is positioned at an end portion of the first connecting end of the blade arm, and wherein the closed end portion of each of the openings is positioned on the first connection portion of the blade arm at a location between the open end portion of each of the openings and the second connection portion of the blade arm, wherein urging the blade arm comprises urging the blade arm relative to the rotational member in a direction toward the rotational axis of the rotational member, such that the body portion of each connection member enters a respective opening in the blade arm and is moved toward the closed end portion of the respective opening.

26. The blade arm of claim 16 further comprising a first connecting end for connecting the blade arm to the rotational member and a second connecting end for connecting the blade arm to a fan blade, wherein the open end portion of each of the openings is positioned at an end portion of the first connecting end of the blade arm, and wherein the closed end portion of each of the openings is positioned on the first connection portion of the blade arm at a location between the open end portion of each of the openings and the second connection portion of the blade arm.

27. The fan assembly of claim 21, wherein the opening comprises a first set of teeth structured for at least partially bearing against the body portion of the connection member.

28. The fan assembly of claim 21, wherein the spacer comprises a first grip portion, a second grip portion, and a connection portion, wherein the first grip portion defines the opening therein, wherein the second grip portion defines a second opening therein, and wherein the connection portion is positioned at least partially between the first grip portion and the second grip portion, such that the spacer is C-shaped.

29. The easy install fan assembly of claim 24, wherein said blade arm further comprises a first connecting end for connecting the blade arm to the rotational member and a second connecting end for connecting the blade arm to a fan blade, wherein the open end portion of each of the openings is positioned at an end portion of the first connecting end of the blade arm, and wherein the closed end portion of each of the openings is positioned on the first connection portion of the blade arm at a location between the open end portion of each of the openings and the second connection portion of the blade arm.

* * * * *